US011436972B2

(12) United States Patent
Tomizawa

(10) Patent No.: US 11,436,972 B2
(45) Date of Patent: Sep. 6, 2022

(54) LIGHT-EMITTING DEVICE AND DRIVING METHOD OF LIGHT-EMITTING DEVICE

(71) Applicant: Japan Display Inc., Tokyo (JP)

(72) Inventor: Kazunari Tomizawa, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 0 days.

(21) Appl. No.: 17/412,254

(22) Filed: Aug. 26, 2021

(65) Prior Publication Data

US 2022/0068196 A1 Mar. 3, 2022

(30) Foreign Application Priority Data

Sep. 1, 2020 (JP) ..... JP2020-147122

(51) Int. Cl.
*G09G 3/32* (2016.01)

(52) U.S. Cl.
CPC ..... *G09G 3/32* (2013.01); *G09G 2310/027* (2013.01)

(58) Field of Classification Search
CPC ..... G09G 3/32; G09G 2320/0238; G09G 3/2011; G09G 2310/027; G09G 3/3233; G09G 3/2037; G09G 3/2022
See application file for complete search history.

(56) References Cited

U.S. PATENT DOCUMENTS

2001/0035849 A1* 11/2001 Kimura ..... G09G 3/3266 345/76
2003/0090447 A1* 5/2003 Kimura ..... G09G 5/399 345/82
2015/0348463 A1* 12/2015 Lee ..... G09G 3/3233 345/212
2017/0213502 A1 7/2017 Henry et al.

FOREIGN PATENT DOCUMENTS

JP 2017-529557 A 10/2017

* cited by examiner

*Primary Examiner* — Muhammad N Edun
(74) *Attorney, Agent, or Firm* — Xsensus LLP

(57) ABSTRACT

A driving method of a light emitting device includes that the light emitting device has a plurality of pixels and performs gray-scale display in sections of the sub-frame periods in which one frame period for displaying one frame image is divided into a plurality of sub-frame periods. The driving method includes writing analog gray-scale data to the plurality of pixels to display analog gray-scales in one sub-frame period of the plurality of sub-frame periods, and writing first digital gray-scale data to the plurality of pixels to display first digital gray-scales in a sub-frame period of the same length as the one sub-frame period, and in a sub-frame period different from the one sub-frame period.

20 Claims, 66 Drawing Sheets

FIG. 6

| | 1st 1/16 SF | 3rd 1/16 SF | 1st 1/8SF | 2nd 1/8SF | 3rd 1/8SF | 4th 1/8SF | 5th 1/8SF | 6th 1/8SF | 7th 1/8SF | |
|---|---|---|---|---|---|---|---|---|---|---|
| Gray Level | Gamma Value 2.2 | Analog | D1 | D2 | D3 | D4 | D5 | D6 | D7 | D8 |
| 0 | 0.0000 | 0.000 | × | × | × | × | × | × | × | × |
| 1 | 0.0000 | 0.000 | × | × | × | × | × | × | × | × |
| 2 | 0.0000 | 0.000 | × | × | × | × | × | × | × | × |
| 3 | 0.0001 | 0.000 | × | × | × | × | × | × | × | × |
| 4 | 0.0001 | 0.000 | × | × | × | × | × | × | × | × |
| 5 | 0.0002 | 0.000 | × | × | × | × | × | × | × | × |
| 6 | 0.0003 | 0.004 | × | × | × | × | × | × | × | × |
| 7 | 0.0004 | 0.004 | × | × | × | × | × | × | × | × |
| 8 | 0.0005 | 0.008 | × | × | × | × | × | × | × | × |
| 9 | 0.0006 | 0.008 | × | × | × | × | × | × | × | × |
| 10 | 0.0008 | 0.012 | × | × | × | × | × | × | × | × |
| 11 | 0.0010 | 0.016 | × | × | × | × | × | × | × | × |
| 12 | 0.0012 | 0.016 | × | × | × | × | × | × | × | × |
| 13 | 0.0014 | 0.020 | × | × | × | × | × | × | × | × |
| 14 | 0.0017 | 0.023 | × | × | × | × | × | × | × | × |
| 15 | 0.0020 | 0.031 | × | × | × | × | × | × | × | × |
| 16 | 0.0023 | 0.035 | × | × | × | × | × | × | × | × |
| 17 | 0.0026 | 0.039 | × | × | × | × | × | × | × | × |
| 18 | 0.0029 | 0.047 | × | × | × | × | × | × | × | × |
| 19 | 0.0033 | 0.051 | × | × | × | × | × | × | × | × |
| 20 | 0.0037 | 0.059 | × | × | × | × | × | × | × | × |
| 21 | 0.0041 | 0.063 | × | × | × | × | × | × | × | × |
| 22 | 0.0046 | 0.070 | × | × | × | × | × | × | × | × |
| 23 | 0.0050 | 0.078 | × | × | × | × | × | × | × | × |
| 24 | 0.0055 | 0.086 | × | × | × | × | × | × | × | × |
| 25 | 0.0060 | 0.094 | × | × | × | × | × | × | × | × |
| 26 | 0.0066 | 0.102 | × | × | × | × | × | × | × | × |
| 27 | 0.0072 | 0.113 | × | × | × | × | × | × | × | × |
| 28 | 0.0078 | 0.121 | × | × | × | × | × | × | × | × |
| 29 | 0.0084 | 0.133 | × | × | × | × | × | × | × | × |
| 30 | 0.0090 | 0.141 | × | × | × | × | × | × | × | × |
| 31 | 0.0097 | 0.152 | × | × | × | × | × | × | × | × |
| 32 | 0.0104 | 0.164 | × | × | × | × | × | × | × | × |
| 33 | 0.0111 | 0.176 | × | × | × | × | × | × | × | × |
| 34 | 0.0119 | 0.188 | × | × | × | × | × | × | × | × |
| 35 | 0.0127 | 0.199 | × | × | × | × | × | × | × | × |
| 36 | 0.0135 | 0.215 | × | × | × | × | × | × | × | × |
| 37 | 0.0143 | 0.227 | × | × | × | × | × | × | × | × |
| 38 | 0.0152 | 0.242 | × | × | × | × | × | × | × | × |
| 39 | 0.0161 | 0.254 | × | × | × | × | × | × | × | × |
| 40 | 0.0170 | 0.270 | × | × | × | × | × | × | × | × |
| 41 | 0.0179 | 0.285 | × | × | × | × | × | × | × | × |
| 42 | 0.0189 | 0.301 | × | × | × | × | × | × | × | × |
| 43 | 0.0199 | 0.316 | × | × | × | × | × | × | × | × |
| 44 | 0.0210 | 0.332 | × | × | × | × | × | × | × | × |
| 45 | 0.0220 | 0.352 | × | × | × | × | × | × | × | × |
| 46 | 0.0231 | 0.367 | × | × | × | × | × | × | × | × |
| 47 | 0.0242 | 0.387 | × | × | × | × | × | × | × | × |
| 48 | 0.0254 | 0.402 | × | × | × | × | × | × | × | × |
| 49 | 0.0265 | 0.422 | × | × | × | × | × | × | × | × |
| 50 | 0.0278 | 0.441 | × | × | × | × | × | × | × | × |
| 51 | 0.0290 | 0.461 | × | × | × | × | × | × | × | × |
| 52 | 0.0303 | 0.480 | × | × | × | × | × | × | × | × |
| 53 | 0.0316 | 0.504 | × | × | × | × | × | × | × | × |
| 54 | 0.0329 | 0.523 | × | × | × | × | × | × | × | × |
| 55 | 0.0342 | 0.547 | × | × | × | × | × | × | × | × |
| 56 | 0.0356 | 0.566 | × | × | × | × | × | × | × | × |
| 57 | 0.0370 | 0.590 | × | × | × | × | × | × | × | × |
| 58 | 0.0385 | 0.613 | × | × | × | × | × | × | × | × |
| 59 | 0.0399 | 0.637 | × | × | × | × | × | × | × | × |
| 60 | 0.0415 | 0.660 | × | × | × | × | × | × | × | × |
| 61 | 0.0430 | 0.688 | × | × | × | × | × | × | × | × |
| 62 | 0.0446 | 0.711 | × | × | × | × | × | × | × | × |
| 63 | 0.0461 | 0.738 | × | × | × | × | × | × | × | × |

FIG. 7

| Gray Level | Gamma Value 2.2 | Analog | D1 (1st 1/16 SF) | D2 (3rd 1/16 SF) | D3 (1st 1/8SF) | D4 (2nd 1/8SF) | D5 (3rd 1/8SF) | D6 (4th 1/8SF) | D7 (5th 1/8SF) | D8 (6th 1/8SF, 7th 1/8SF) |
|---|---|---|---|---|---|---|---|---|---|---|
| 64 | 0.0478 | 0.762 | × | × | × | × | × | × | × | × |
| 65 | 0.0494 | 0.789 | × | × | × | × | × | × | × | × |
| 66 | 0.0511 | 0.816 | × | × | × | × | × | × | × | × |
| 67 | 0.0528 | 0.844 | × | × | × | × | × | × | × | × |
| 68 | 0.0546 | 0.871 | × | × | × | × | × | × | × | × |
| 69 | 0.0564 | 0.898 | × | × | × | × | × | × | × | × |
| 70 | 0.0582 | 0.930 | × | × | × | × | × | × | × | × |
| 71 | 0.0600 | 0.957 | × | × | × | × | × | × | × | × |
| 72 | 0.0619 | 0.988 | × | × | × | × | × | × | × | × |
| 73 | 0.0638 | 0.020 | ○ | × | × | × | × | × | × | × |
| 74 | 0.0658 | 0.051 | ○ | × | × | × | × | × | × | × |
| 75 | 0.0677 | 0.082 | ○ | × | × | × | × | × | × | × |
| 76 | 0.0697 | 0.113 | ○ | × | × | × | × | × | × | × |
| 77 | 0.0718 | 0.145 | ○ | × | × | × | × | × | × | × |
| 78 | 0.0738 | 0.180 | ○ | × | × | × | × | × | × | × |
| 79 | 0.0759 | 0.211 | ○ | × | × | × | × | × | × | × |
| 80 | 0.0781 | 0.246 | ○ | × | × | × | × | × | × | × |
| 81 | 0.0802 | 0.281 | ○ | × | × | × | × | × | × | × |
| 82 | 0.0824 | 0.316 | ○ | × | × | × | × | × | × | × |
| 83 | 0.0846 | 0.352 | ○ | × | × | × | × | × | × | × |
| 84 | 0.0869 | 0.387 | ○ | × | × | × | × | × | × | × |
| 85 | 0.0892 | 0.426 | ○ | × | × | × | × | × | × | × |
| 86 | 0.0915 | 0.461 | ○ | × | × | × | × | × | × | × |
| 87 | 0.0939 | 0.500 | ○ | × | × | × | × | × | × | × |
| 88 | 0.0963 | 0.539 | ○ | × | × | × | × | × | × | × |
| 89 | 0.0987 | 0.578 | ○ | × | × | × | × | × | × | × |
| 90 | 0.1011 | 0.617 | ○ | × | × | × | × | × | × | × |
| 91 | 0.1036 | 0.656 | ○ | × | × | × | × | × | × | × |
| 92 | 0.1062 | 0.695 | ○ | × | × | × | × | × | × | × |
| 93 | 0.1087 | 0.738 | ○ | × | × | × | × | × | × | × |
| 94 | 0.1113 | 0.777 | ○ | × | × | × | × | × | × | × |
| 95 | 0.1139 | 0.820 | ○ | × | × | × | × | × | × | × |
| 96 | 0.1166 | 0.863 | ○ | × | × | × | × | × | × | × |
| 97 | 0.1193 | 0.906 | ○ | × | × | × | × | × | × | × |
| 98 | 0.1220 | 0.949 | ○ | × | × | × | × | × | × | × |
| 99 | 0.1247 | 0.992 | ○ | × | × | × | × | × | × | × |
| 100 | 0.1275 | 0.039 | × | ○ | × | × | × | × | × | × |
| 101 | 0.1304 | 0.082 | × | ○ | × | × | × | × | × | × |
| 102 | 0.1332 | 0.129 | × | ○ | × | × | × | × | × | × |
| 103 | 0.1361 | 0.176 | × | ○ | × | × | × | × | × | × |
| 104 | 0.1390 | 0.223 | × | ○ | × | × | × | × | × | × |
| 105 | 0.1420 | 0.270 | × | ○ | × | × | × | × | × | × |
| 106 | 0.1450 | 0.316 | × | ○ | × | × | × | × | × | × |
| 107 | 0.1480 | 0.367 | × | ○ | × | × | × | × | × | × |
| 108 | 0.1511 | 0.414 | × | ○ | × | × | × | × | × | × |
| 109 | 0.1542 | 0.465 | × | ○ | × | × | × | × | × | × |
| 110 | 0.1573 | 0.516 | × | ○ | × | × | × | × | × | × |
| 111 | 0.1604 | 0.566 | × | ○ | × | × | × | × | × | × |
| 112 | 0.1636 | 0.617 | × | ○ | × | × | × | × | × | × |
| 113 | 0.1669 | 0.668 | × | ○ | × | × | × | × | × | × |
| 114 | 0.1701 | 0.719 | × | ○ | × | × | × | × | × | × |
| 115 | 0.1734 | 0.773 | × | ○ | × | × | × | × | × | × |
| 116 | 0.1768 | 0.828 | × | ○ | × | × | × | × | × | × |
| 117 | 0.1801 | 0.879 | × | ○ | × | × | × | × | × | × |
| 118 | 0.1835 | 0.934 | × | ○ | × | × | × | × | × | × |
| 119 | 0.1870 | 0.988 | × | ○ | × | × | × | × | × | × |
| 120 | 0.1905 | 0.047 | ○ | ○ | × | × | × | × | × | × |
| 121 | 0.1940 | 0.102 | ○ | ○ | × | × | × | × | × | × |
| 122 | 0.1975 | 0.160 | ○ | ○ | × | × | × | × | × | × |
| 123 | 0.2011 | 0.215 | ○ | ○ | × | × | × | × | × | × |
| 124 | 0.2047 | 0.273 | ○ | ○ | × | × | × | × | × | × |
| 125 | 0.2084 | 0.332 | ○ | ○ | × | × | × | × | × | × |
| 126 | 0.2120 | 0.391 | ○ | ○ | × | × | × | × | × | × |
| 127 | 0.2158 | 0.449 | ○ | ○ | × | × | × | × | × | × |

FIG. 8

| Gray Level | Gamma Value 2.2 | Analog | D1 (1st 1/16 SF, 3rd 1/16 SF, 1st 1/8SF) | D2 (2nd 1/8SF) | D3 (3rd 1/8SF) | D4 (3rd 1/8SF) | D5 (4th 1/8SF) | D6 (4th 1/8SF, 5th 1/8SF) | D7 (5th 1/8SF, 6th 1/8SF) | D8 (6th 1/8SF, 7th 1/8SF) |
|---|---|---|---|---|---|---|---|---|---|---|
| 128 | 0.2195 | 0.512 | ○ | ○ | × | × | × | × | × | × |
| 129 | 0.2233 | 0.570 | ○ | ○ | × | × | × | × | × | × |
| 130 | 0.2271 | 0.633 | ○ | ○ | × | × | × | × | × | × |
| 131 | 0.2310 | 0.695 | ○ | ○ | × | × | × | × | × | × |
| 132 | 0.2349 | 0.758 | ○ | ○ | × | × | × | × | × | × |
| 133 | 0.2388 | 0.820 | ○ | ○ | × | × | × | × | × | × |
| 134 | 0.2428 | 0.883 | ○ | ○ | × | × | × | × | × | × |
| 135 | 0.2468 | 0.945 | ○ | ○ | × | × | × | × | × | × |
| 136 | 0.2508 | 1.012 | ○ | ○ | × | × | × | × | × | × |
| 137 | 0.2549 | 0.078 | × | ○ | ○ | × | × | × | × | × |
| 138 | 0.2590 | 0.141 | × | ○ | ○ | × | × | × | × | × |
| 139 | 0.2632 | 0.207 | × | ○ | ○ | × | × | × | × | × |
| 140 | 0.2674 | 0.277 | × | ○ | ○ | × | × | × | × | × |
| 141 | 0.2716 | 0.344 | × | ○ | ○ | × | × | × | × | × |
| 142 | 0.2758 | 0.410 | × | ○ | ○ | × | × | × | × | × |
| 143 | 0.2801 | 0.480 | × | ○ | ○ | × | × | × | × | × |
| 144 | 0.2845 | 0.551 | × | ○ | ○ | × | × | × | × | × |
| 145 | 0.2888 | 0.617 | × | ○ | ○ | × | × | × | × | × |
| 146 | 0.2932 | 0.691 | × | ○ | ○ | × | × | × | × | × |
| 147 | 0.2977 | 0.762 | × | ○ | ○ | × | × | × | × | × |
| 148 | 0.3021 | 0.832 | × | ○ | ○ | × | × | × | × | × |
| 149 | 0.3066 | 0.902 | × | ○ | ○ | × | × | × | × | × |
| 150 | 0.3112 | 0.977 | × | ○ | ○ | × | × | × | × | × |
| 151 | 0.3158 | 0.051 | ○ | ○ | ○ | × | × | × | × | × |
| 152 | 0.3204 | 0.125 | ○ | ○ | ○ | × | × | × | × | × |
| 153 | 0.3250 | 0.199 | ○ | ○ | ○ | × | × | × | × | × |
| 154 | 0.3297 | 0.273 | ○ | ○ | ○ | × | × | × | × | × |
| 155 | 0.3345 | 0.348 | ○ | ○ | ○ | × | × | × | × | × |
| 156 | 0.3392 | 0.426 | ○ | ○ | ○ | × | × | × | × | × |
| 157 | 0.3440 | 0.504 | ○ | ○ | ○ | × | × | × | × | × |
| 158 | 0.3489 | 0.578 | ○ | ○ | ○ | × | × | × | × | × |
| 159 | 0.3537 | 0.656 | ○ | ○ | ○ | × | × | × | × | × |
| 160 | 0.3587 | 0.738 | ○ | ○ | ○ | × | × | × | × | × |
| 161 | 0.3636 | 0.816 | ○ | ○ | ○ | × | × | × | × | × |
| 162 | 0.3686 | 0.895 | ○ | ○ | ○ | × | × | × | × | × |
| 163 | 0.3736 | 0.977 | ○ | ○ | ○ | × | × | × | × | × |
| 164 | 0.3787 | 0.059 | × | ○ | ○ | ○ | × | × | × | × |
| 165 | 0.3838 | 0.137 | × | ○ | ○ | ○ | × | × | × | × |
| 166 | 0.3889 | 0.219 | × | ○ | ○ | ○ | × | × | × | × |
| 167 | 0.3941 | 0.305 | × | ○ | ○ | ○ | × | × | × | × |
| 168 | 0.3993 | 0.387 | × | ○ | ○ | ○ | × | × | × | × |
| 169 | 0.4045 | 0.469 | × | ○ | ○ | ○ | × | × | × | × |
| 170 | 0.4098 | 0.555 | × | ○ | ○ | ○ | × | × | × | × |
| 171 | 0.4151 | 0.641 | × | ○ | ○ | ○ | × | × | × | × |
| 172 | 0.4205 | 0.727 | × | ○ | ○ | ○ | × | × | × | × |
| 173 | 0.4259 | 0.813 | × | ○ | ○ | ○ | × | × | × | × |
| 174 | 0.4313 | 0.898 | × | ○ | ○ | ○ | × | × | × | × |
| 175 | 0.4368 | 0.988 | × | ○ | ○ | ○ | × | × | × | × |
| 176 | 0.4423 | 0.074 | ○ | ○ | ○ | ○ | × | × | × | × |
| 177 | 0.4479 | 0.164 | ○ | ○ | ○ | ○ | × | × | × | × |
| 178 | 0.4535 | 0.254 | ○ | ○ | ○ | ○ | × | × | × | × |
| 179 | 0.4591 | 0.344 | ○ | ○ | ○ | ○ | × | × | × | × |
| 180 | 0.4647 | 0.434 | ○ | ○ | ○ | ○ | × | × | × | × |
| 181 | 0.4704 | 0.523 | ○ | ○ | ○ | ○ | × | × | × | × |
| 182 | 0.4762 | 0.617 | ○ | ○ | ○ | ○ | × | × | × | × |
| 183 | 0.4820 | 0.711 | ○ | ○ | ○ | ○ | × | × | × | × |
| 184 | 0.4878 | 0.801 | ○ | ○ | ○ | ○ | × | × | × | × |
| 185 | 0.4936 | 0.895 | ○ | ○ | ○ | ○ | × | × | × | × |
| 186 | 0.4995 | 0.988 | ○ | ○ | ○ | ○ | × | × | × | × |
| 187 | 0.5054 | 0.086 | × | ○ | ○ | ○ | ○ | × | × | × |
| 188 | 0.5114 | 0.180 | × | ○ | ○ | ○ | ○ | × | × | × |
| 189 | 0.5174 | 0.277 | × | ○ | ○ | ○ | ○ | × | × | × |
| 190 | 0.5234 | 0.375 | × | ○ | ○ | ○ | ○ | × | × | × |
| 191 | 0.5295 | 0.469 | × | ○ | ○ | ○ | ○ | × | × | × |

FIG. 9

| Gray Level | Gamma Value 2.2 | Analog | D1 (1st 1/16 SF, 3rd 1/16 SF, 1st 1/8SF) | D2 (2nd 1/8SF) | D3 (3rd 1/8SF) | D4 (3rd 1/8SF) | D5 (4th 1/8SF) | D6 (5th 1/8SF) | D7 (6th 1/8SF) | D8 (7th 1/8SF) |
|---|---|---|---|---|---|---|---|---|---|---|
| 192 | 0.5356 | 0.566 | × | ○ | ○ | ○ | ○ | × | × | × |
| 193 | 0.5418 | 0.668 | × | ○ | ○ | ○ | ○ | × | × | × |
| 194 | 0.5480 | 0.766 | × | ○ | ○ | ○ | ○ | × | × | × |
| 195 | 0.5542 | 0.867 | × | ○ | ○ | ○ | ○ | × | × | × |
| 196 | 0.5605 | 0.965 | × | ○ | ○ | ○ | ○ | × | × | × |
| 197 | 0.5668 | 0.066 | ○ | ○ | ○ | ○ | ○ | × | × | × |
| 198 | 0.5732 | 0.168 | ○ | ○ | ○ | ○ | ○ | × | × | × |
| 199 | 0.5795 | 0.270 | ○ | ○ | ○ | ○ | ○ | × | × | × |
| 200 | 0.5860 | 0.375 | ○ | ○ | ○ | ○ | ○ | × | × | × |
| 201 | 0.5924 | 0.477 | ○ | ○ | ○ | ○ | ○ | × | × | × |
| 202 | 0.5989 | 0.582 | ○ | ○ | ○ | ○ | ○ | × | × | × |
| 203 | 0.6055 | 0.688 | ○ | ○ | ○ | ○ | ○ | × | × | × |
| 204 | 0.6121 | 0.793 | ○ | ○ | ○ | ○ | ○ | × | × | × |
| 205 | 0.6187 | 0.898 | ○ | ○ | ○ | ○ | ○ | × | × | × |
| 206 | 0.6253 | 0.004 | × | ○ | ○ | ○ | ○ | ○ | × | × |
| 207 | 0.6320 | 0.109 | × | ○ | ○ | ○ | ○ | ○ | × | × |
| 208 | 0.6388 | 0.219 | × | ○ | ○ | ○ | ○ | ○ | × | × |
| 209 | 0.6456 | 0.328 | × | ○ | ○ | ○ | ○ | ○ | × | × |
| 210 | 0.6524 | 0.438 | × | ○ | ○ | ○ | ○ | ○ | × | × |
| 211 | 0.6592 | 0.547 | × | ○ | ○ | ○ | ○ | ○ | × | × |
| 212 | 0.6661 | 0.656 | × | ○ | ○ | ○ | ○ | ○ | × | × |
| 213 | 0.6730 | 0.766 | × | ○ | ○ | ○ | ○ | ○ | × | × |
| 214 | 0.6800 | 0.879 | × | ○ | ○ | ○ | ○ | ○ | × | × |
| 215 | 0.6870 | 0.992 | × | ○ | ○ | ○ | ○ | ○ | × | × |
| 216 | 0.6941 | 0.102 | ○ | ○ | ○ | ○ | ○ | ○ | × | × |
| 217 | 0.7012 | 0.215 | ○ | ○ | ○ | ○ | ○ | ○ | × | × |
| 218 | 0.7083 | 0.332 | ○ | ○ | ○ | ○ | ○ | ○ | × | × |
| 219 | 0.7155 | 0.445 | ○ | ○ | ○ | ○ | ○ | ○ | × | × |
| 220 | 0.7227 | 0.563 | ○ | ○ | ○ | ○ | ○ | ○ | × | × |
| 221 | 0.7299 | 0.676 | ○ | ○ | ○ | ○ | ○ | ○ | × | × |
| 222 | 0.7372 | 0.793 | ○ | ○ | ○ | ○ | ○ | ○ | × | × |
| 223 | 0.7445 | 0.910 | ○ | ○ | ○ | ○ | ○ | ○ | × | × |
| 224 | 0.7519 | 0.027 | × | ○ | ○ | ○ | ○ | ○ | ○ | × |
| 225 | 0.7593 | 0.148 | × | ○ | ○ | ○ | ○ | ○ | ○ | × |
| 226 | 0.7667 | 0.266 | × | ○ | ○ | ○ | ○ | ○ | ○ | × |
| 227 | 0.7742 | 0.387 | × | ○ | ○ | ○ | ○ | ○ | ○ | × |
| 228 | 0.7818 | 0.508 | × | ○ | ○ | ○ | ○ | ○ | ○ | × |
| 229 | 0.7893 | 0.629 | × | ○ | ○ | ○ | ○ | ○ | ○ | × |
| 230 | 0.7969 | 0.750 | × | ○ | ○ | ○ | ○ | ○ | ○ | × |
| 231 | 0.8046 | 0.871 | × | ○ | ○ | ○ | ○ | ○ | ○ | × |
| 232 | 0.8122 | 0.992 | × | ○ | ○ | ○ | ○ | ○ | ○ | × |
| 233 | 0.8200 | 0.117 | ○ | ○ | ○ | ○ | ○ | ○ | ○ | × |
| 234 | 0.8277 | 0.242 | ○ | ○ | ○ | ○ | ○ | ○ | ○ | × |
| 235 | 0.8355 | 0.367 | ○ | ○ | ○ | ○ | ○ | ○ | ○ | × |
| 236 | 0.8434 | 0.492 | ○ | ○ | ○ | ○ | ○ | ○ | ○ | × |
| 237 | 0.8513 | 0.617 | ○ | ○ | ○ | ○ | ○ | ○ | ○ | × |
| 238 | 0.8592 | 0.746 | ○ | ○ | ○ | ○ | ○ | ○ | ○ | × |
| 239 | 0.8671 | 0.871 | ○ | ○ | ○ | ○ | ○ | ○ | ○ | × |
| 240 | 0.8751 | 0.000 | × | ○ | ○ | ○ | ○ | ○ | ○ | ○ |
| 241 | 0.8832 | 0.129 | × | ○ | ○ | ○ | ○ | ○ | ○ | ○ |
| 242 | 0.8913 | 0.258 | × | ○ | ○ | ○ | ○ | ○ | ○ | ○ |
| 243 | 0.8994 | 0.387 | × | ○ | ○ | ○ | ○ | ○ | ○ | ○ |
| 244 | 0.9075 | 0.520 | × | ○ | ○ | ○ | ○ | ○ | ○ | ○ |
| 245 | 0.9158 | 0.648 | × | ○ | ○ | ○ | ○ | ○ | ○ | ○ |
| 246 | 0.9240 | 0.781 | × | ○ | ○ | ○ | ○ | ○ | ○ | ○ |
| 247 | 0.9323 | 0.914 | × | ○ | ○ | ○ | ○ | ○ | ○ | ○ |
| 248 | 0.9406 | 0.047 | ○ | ○ | ○ | ○ | ○ | ○ | ○ | ○ |
| 249 | 0.9490 | 0.180 | ○ | ○ | ○ | ○ | ○ | ○ | ○ | ○ |
| 250 | 0.9574 | 0.316 | ○ | ○ | ○ | ○ | ○ | ○ | ○ | ○ |
| 251 | 0.9658 | 0.449 | ○ | ○ | ○ | ○ | ○ | ○ | ○ | ○ |
| 252 | 0.9743 | 0.586 | ○ | ○ | ○ | ○ | ○ | ○ | ○ | ○ |
| 253 | 0.9828 | 0.723 | ○ | ○ | ○ | ○ | ○ | ○ | ○ | ○ |
| 254 | 0.9914 | 0.859 | ○ | ○ | ○ | ○ | ○ | ○ | ○ | ○ |
| 255 | 1.0000 | 1.000 | ○ | ○ | ○ | ○ | ○ | ○ | ○ | ○ |

FIG. 31

| Gray Level | Gamma Value 2.2 | D6 (5th 1/8SF) | D4 (3rd 1/8SF) | D2 (1st 1/8SF) | Analog (1st 1/16 SF) | D1 (2nd 1/16 SF) | D3 (2nd 1/8SF) | D5 (4th 1/8SF) | D7 (6th 1/8SF) | D8 (7th 1/8SF) |
|---|---|---|---|---|---|---|---|---|---|---|
| 0 | 0.0000 | × | × | × | 0.000 | × | × | × | × | × |
| 1 | 0.0000 | × | × | × | 0.000 | × | × | × | × | × |
| 2 | 0.0000 | × | × | × | 0.000 | × | × | × | × | × |
| 3 | 0.0001 | × | × | × | 0.000 | × | × | × | × | × |
| 4 | 0.0001 | × | × | × | 0.000 | × | × | × | × | × |
| 5 | 0.0002 | × | × | × | 0.000 | × | × | × | × | × |
| 6 | 0.0003 | × | × | × | 0.004 | × | × | × | × | × |
| 7 | 0.0004 | × | × | × | 0.004 | × | × | × | × | × |
| 8 | 0.0005 | × | × | × | 0.008 | × | × | × | × | × |
| 9 | 0.0006 | × | × | × | 0.008 | × | × | × | × | × |
| 10 | 0.0008 | × | × | × | 0.012 | × | × | × | × | × |
| 11 | 0.0010 | × | × | × | 0.016 | × | × | × | × | × |
| 12 | 0.0012 | × | × | × | 0.016 | × | × | × | × | × |
| 13 | 0.0014 | × | × | × | 0.020 | × | × | × | × | × |
| 14 | 0.0017 | × | × | × | 0.023 | × | × | × | × | × |
| 15 | 0.0020 | × | × | × | 0.031 | × | × | × | × | × |
| 16 | 0.0023 | × | × | × | 0.035 | × | × | × | × | × |
| 17 | 0.0026 | × | × | × | 0.039 | × | × | × | × | × |
| 18 | 0.0029 | × | × | × | 0.047 | × | × | × | × | × |
| 19 | 0.0033 | × | × | × | 0.051 | × | × | × | × | × |
| 20 | 0.0037 | × | × | × | 0.059 | × | × | × | × | × |
| 21 | 0.0041 | × | × | × | 0.063 | × | × | × | × | × |
| 22 | 0.0046 | × | × | × | 0.070 | × | × | × | × | × |
| 23 | 0.0050 | × | × | × | 0.078 | × | × | × | × | × |
| 24 | 0.0055 | × | × | × | 0.086 | × | × | × | × | × |
| 25 | 0.0060 | × | × | × | 0.094 | × | × | × | × | × |
| 26 | 0.0066 | × | × | × | 0.102 | × | × | × | × | × |
| 27 | 0.0072 | × | × | × | 0.113 | × | × | × | × | × |
| 28 | 0.0078 | × | × | × | 0.121 | × | × | × | × | × |
| 29 | 0.0084 | × | × | × | 0.133 | × | × | × | × | × |
| 30 | 0.0090 | × | × | × | 0.141 | × | × | × | × | × |
| 31 | 0.0097 | × | × | × | 0.152 | × | × | × | × | × |
| 32 | 0.0104 | × | × | × | 0.164 | × | × | × | × | × |
| 33 | 0.0111 | × | × | × | 0.176 | × | × | × | × | × |
| 34 | 0.0119 | × | × | × | 0.188 | × | × | × | × | × |
| 35 | 0.0127 | × | × | × | 0.199 | × | × | × | × | × |
| 36 | 0.0135 | × | × | × | 0.215 | × | × | × | × | × |
| 37 | 0.0143 | × | × | × | 0.227 | × | × | × | × | × |
| 38 | 0.0152 | × | × | × | 0.242 | × | × | × | × | × |
| 39 | 0.0161 | × | × | × | 0.254 | × | × | × | × | × |
| 40 | 0.0170 | × | × | × | 0.270 | × | × | × | × | × |
| 41 | 0.0179 | × | × | × | 0.285 | × | × | × | × | × |
| 42 | 0.0189 | × | × | × | 0.301 | × | × | × | × | × |
| 43 | 0.0199 | × | × | × | 0.316 | × | × | × | × | × |
| 44 | 0.0210 | × | × | × | 0.332 | × | × | × | × | × |
| 45 | 0.0220 | × | × | × | 0.352 | × | × | × | × | × |
| 46 | 0.0231 | × | × | × | 0.367 | × | × | × | × | × |
| 47 | 0.0242 | × | × | × | 0.387 | × | × | × | × | × |
| 48 | 0.0254 | × | × | × | 0.402 | × | × | × | × | × |
| 49 | 0.0265 | × | × | × | 0.422 | × | × | × | × | × |
| 50 | 0.0278 | × | × | × | 0.441 | × | × | × | × | × |
| 51 | 0.0290 | × | × | × | 0.461 | × | × | × | × | × |
| 52 | 0.0303 | × | × | × | 0.480 | × | × | × | × | × |
| 53 | 0.0316 | × | × | × | 0.504 | × | × | × | × | × |
| 54 | 0.0329 | × | × | × | 0.523 | × | × | × | × | × |
| 55 | 0.0342 | × | × | × | 0.547 | × | × | × | × | × |
| 56 | 0.0356 | × | × | × | 0.566 | × | × | × | × | × |
| 57 | 0.0370 | × | × | × | 0.590 | × | × | × | × | × |
| 58 | 0.0385 | × | × | × | 0.613 | × | × | × | × | × |
| 59 | 0.0399 | × | × | × | 0.637 | × | × | × | × | × |
| 60 | 0.0415 | × | × | × | 0.660 | × | × | × | × | × |
| 61 | 0.0430 | × | × | × | 0.688 | × | × | × | × | × |
| 62 | 0.0446 | × | × | × | 0.711 | × | × | × | × | × |
| 63 | 0.0461 | × | × | × | 0.738 | × | × | × | × | × |

FIG. 32

| Gray Level | Gamma Value 2.2 | D6 (5th 1/8SF) | D4 (3rd 1/8SF) | D2 (1st 1/8SF) | Analog (1st 1/16 SF) | D1 (2nd 1/16 SF) | D3 (2nd 1/8SF) | D5 (4th 1/8SF) | D7 (6th 1/8SF) | D8 (7th 1/8SF) |
|---|---|---|---|---|---|---|---|---|---|---|
| 64 | 0.0478 | × | × | × | 0.762 | × | × | × | × | × |
| 65 | 0.0494 | × | × | × | 0.789 | × | × | × | × | × |
| 66 | 0.0511 | × | × | × | 0.816 | × | × | × | × | × |
| 67 | 0.0528 | × | × | × | 0.844 | × | × | × | × | × |
| 68 | 0.0546 | × | × | × | 0.871 | × | × | × | × | × |
| 69 | 0.0564 | × | × | × | 0.898 | × | × | × | × | × |
| 70 | 0.0582 | × | × | × | 0.930 | × | × | × | × | × |
| 71 | 0.0600 | × | × | × | 0.957 | × | × | × | × | × |
| 72 | 0.0619 | × | × | × | 0.988 | × | × | × | × | × |
| 73 | 0.0638 | × | × | × | 0.020 | ○ | × | × | × | × |
| 74 | 0.0658 | × | × | × | 0.051 | ○ | × | × | × | × |
| 75 | 0.0677 | × | × | × | 0.082 | ○ | × | × | × | × |
| 76 | 0.0697 | × | × | × | 0.113 | ○ | × | × | × | × |
| 77 | 0.0718 | × | × | × | 0.145 | ○ | × | × | × | × |
| 78 | 0.0738 | × | × | × | 0.180 | ○ | × | × | × | × |
| 79 | 0.0759 | × | × | × | 0.211 | ○ | × | × | × | × |
| 80 | 0.0781 | × | × | × | 0.246 | ○ | × | × | × | × |
| 81 | 0.0802 | × | × | × | 0.281 | ○ | × | × | × | × |
| 82 | 0.0824 | × | × | × | 0.316 | ○ | × | × | × | × |
| 83 | 0.0846 | × | × | × | 0.352 | ○ | × | × | × | × |
| 84 | 0.0869 | × | × | × | 0.387 | ○ | × | × | × | × |
| 85 | 0.0892 | × | × | × | 0.426 | ○ | × | × | × | × |
| 86 | 0.0915 | × | × | × | 0.461 | ○ | × | × | × | × |
| 87 | 0.0939 | × | × | × | 0.500 | ○ | × | × | × | × |
| 88 | 0.0963 | × | × | × | 0.539 | ○ | × | × | × | × |
| 89 | 0.0987 | × | × | × | 0.578 | ○ | × | × | × | × |
| 90 | 0.1011 | × | × | × | 0.617 | ○ | × | × | × | × |
| 91 | 0.1036 | × | × | × | 0.656 | ○ | × | × | × | × |
| 92 | 0.1062 | × | × | × | 0.695 | ○ | × | × | × | × |
| 93 | 0.1087 | × | × | × | 0.738 | ○ | × | × | × | × |
| 94 | 0.1113 | × | × | × | 0.777 | ○ | × | × | × | × |
| 95 | 0.1139 | × | × | × | 0.820 | ○ | × | × | × | × |
| 96 | 0.1166 | × | × | × | 0.863 | ○ | × | × | × | × |
| 97 | 0.1193 | × | × | × | 0.906 | ○ | × | × | × | × |
| 98 | 0.1220 | × | × | × | 0.949 | ○ | × | × | × | × |
| 99 | 0.1247 | × | × | × | 0.992 | ○ | × | × | × | × |
| 100 | 0.1275 | × | × | ○ | 0.039 | × | × | × | × | × |
| 101 | 0.1304 | × | × | ○ | 0.082 | × | × | × | × | × |
| 102 | 0.1332 | × | × | ○ | 0.129 | × | × | × | × | × |
| 103 | 0.1361 | × | × | ○ | 0.176 | × | × | × | × | × |
| 104 | 0.1390 | × | × | ○ | 0.223 | × | × | × | × | × |
| 105 | 0.1420 | × | × | ○ | 0.270 | × | × | × | × | × |
| 106 | 0.1450 | × | × | ○ | 0.316 | × | × | × | × | × |
| 107 | 0.1480 | × | × | ○ | 0.367 | × | × | × | × | × |
| 108 | 0.1511 | × | × | ○ | 0.414 | × | × | × | × | × |
| 109 | 0.1542 | × | × | ○ | 0.465 | × | × | × | × | × |
| 110 | 0.1573 | × | × | ○ | 0.516 | × | × | × | × | × |
| 111 | 0.1604 | × | × | ○ | 0.566 | × | × | × | × | × |
| 112 | 0.1636 | × | × | ○ | 0.617 | × | × | × | × | × |
| 113 | 0.1669 | × | × | ○ | 0.668 | × | × | × | × | × |
| 114 | 0.1701 | × | × | ○ | 0.719 | × | × | × | × | × |
| 115 | 0.1734 | × | × | ○ | 0.773 | × | × | × | × | × |
| 116 | 0.1768 | × | × | ○ | 0.828 | × | × | × | × | × |
| 117 | 0.1801 | × | × | ○ | 0.879 | × | × | × | × | × |
| 118 | 0.1835 | × | × | ○ | 0.934 | × | × | × | × | × |
| 119 | 0.1870 | × | × | ○ | 0.988 | × | × | × | × | × |
| 120 | 0.1905 | × | × | ○ | 0.047 | ○ | × | × | × | × |
| 121 | 0.1940 | × | × | ○ | 0.102 | ○ | × | × | × | × |
| 122 | 0.1975 | × | × | ○ | 0.160 | ○ | × | × | × | × |
| 123 | 0.2011 | × | × | ○ | 0.215 | ○ | × | × | × | × |
| 124 | 0.2047 | × | × | ○ | 0.273 | ○ | × | × | × | × |
| 125 | 0.2084 | × | × | ○ | 0.332 | ○ | × | × | × | × |
| 126 | 0.2120 | × | × | ○ | 0.391 | ○ | × | × | × | × |
| 127 | 0.2158 | × | × | ○ | 0.449 | ○ | × | × | × | × |

FIG. 33

| Gray Level | Gamma Value 2.2 | D6 (5th 1/8SF) | D4 (3rd 1/8SF) | D2 (1st 1/8SF) | Analog (1st 1/16 SF) | D1 (2nd 1/16 SF) | D3 (2nd 1/8SF) | D5 (4th 1/8SF) | D7 (6th 1/8SF) | D8 (7th 1/8SF) |
|---|---|---|---|---|---|---|---|---|---|---|
| 128 | 0.2195 | × | × | ○ | 0.512 | ○ | × | × | × | × |
| 129 | 0.2233 | × | × | ○ | 0.570 | ○ | × | × | × | × |
| 130 | 0.2271 | × | × | ○ | 0.633 | ○ | × | × | × | × |
| 131 | 0.2310 | × | × | ○ | 0.695 | ○ | × | × | × | × |
| 132 | 0.2349 | × | × | ○ | 0.758 | ○ | × | × | × | × |
| 133 | 0.2388 | × | × | ○ | 0.820 | ○ | × | × | × | × |
| 134 | 0.2428 | × | × | ○ | 0.883 | ○ | × | × | × | × |
| 135 | 0.2468 | × | × | ○ | 0.945 | ○ | × | × | × | × |
| 136 | 0.2508 | × | × | ○ | 1.012 | ○ | × | × | × | × |
| 137 | 0.2549 | × | × | ○ | 0.078 | × | ○ | × | × | × |
| 138 | 0.2590 | × | × | ○ | 0.141 | × | ○ | × | × | × |
| 139 | 0.2632 | × | × | ○ | 0.207 | × | ○ | × | × | × |
| 140 | 0.2674 | × | × | ○ | 0.277 | × | ○ | × | × | × |
| 141 | 0.2716 | × | × | ○ | 0.344 | × | ○ | × | × | × |
| 142 | 0.2758 | × | × | ○ | 0.410 | × | ○ | × | × | × |
| 143 | 0.2801 | × | × | ○ | 0.480 | × | ○ | × | × | × |
| 144 | 0.2845 | × | × | ○ | 0.551 | × | ○ | × | × | × |
| 145 | 0.2888 | × | × | ○ | 0.617 | × | ○ | × | × | × |
| 146 | 0.2932 | × | × | ○ | 0.691 | × | ○ | × | × | × |
| 147 | 0.2977 | × | × | ○ | 0.762 | × | ○ | × | × | × |
| 148 | 0.3021 | × | × | ○ | 0.832 | × | ○ | × | × | × |
| 149 | 0.3066 | × | × | ○ | 0.902 | × | ○ | × | × | × |
| 150 | 0.3112 | × | × | ○ | 0.977 | × | ○ | × | × | × |
| 151 | 0.3158 | × | × | ○ | 0.051 | ○ | ○ | × | × | × |
| 152 | 0.3204 | × | × | ○ | 0.125 | ○ | ○ | × | × | × |
| 153 | 0.3250 | × | × | ○ | 0.199 | ○ | ○ | × | × | × |
| 154 | 0.3297 | × | × | ○ | 0.273 | ○ | ○ | × | × | × |
| 155 | 0.3345 | × | × | ○ | 0.348 | ○ | ○ | × | × | × |
| 156 | 0.3392 | × | × | ○ | 0.426 | ○ | ○ | × | × | × |
| 157 | 0.3440 | × | × | ○ | 0.504 | ○ | ○ | × | × | × |
| 158 | 0.3489 | × | × | ○ | 0.578 | ○ | ○ | × | × | × |
| 159 | 0.3537 | × | × | ○ | 0.656 | ○ | ○ | × | × | × |
| 160 | 0.3587 | × | × | ○ | 0.738 | ○ | ○ | × | × | × |
| 161 | 0.3636 | × | × | ○ | 0.816 | ○ | ○ | × | × | × |
| 162 | 0.3686 | × | × | ○ | 0.895 | ○ | ○ | × | × | × |
| 163 | 0.3736 | × | × | ○ | 0.977 | ○ | ○ | × | × | × |
| 164 | 0.3787 | × | ○ | ○ | 0.059 | × | ○ | × | × | × |
| 165 | 0.3838 | × | ○ | ○ | 0.137 | × | ○ | × | × | × |
| 166 | 0.3889 | × | ○ | ○ | 0.219 | × | ○ | × | × | × |
| 167 | 0.3941 | × | ○ | ○ | 0.305 | × | ○ | × | × | × |
| 168 | 0.3993 | × | ○ | ○ | 0.387 | × | ○ | × | × | × |
| 169 | 0.4045 | × | ○ | ○ | 0.469 | × | ○ | × | × | × |
| 170 | 0.4098 | × | ○ | ○ | 0.555 | × | ○ | × | × | × |
| 171 | 0.4151 | × | ○ | ○ | 0.641 | × | ○ | × | × | × |
| 172 | 0.4205 | × | ○ | ○ | 0.727 | × | ○ | × | × | × |
| 173 | 0.4259 | × | ○ | ○ | 0.813 | × | ○ | × | × | × |
| 174 | 0.4313 | × | ○ | ○ | 0.898 | × | ○ | × | × | × |
| 175 | 0.4368 | × | ○ | ○ | 0.988 | × | ○ | × | × | × |
| 176 | 0.4423 | × | ○ | ○ | 0.074 | ○ | ○ | × | × | × |
| 177 | 0.4479 | × | ○ | ○ | 0.164 | ○ | ○ | × | × | × |
| 178 | 0.4535 | × | ○ | ○ | 0.254 | ○ | ○ | × | × | × |
| 179 | 0.4591 | × | ○ | ○ | 0.344 | ○ | ○ | × | × | × |
| 180 | 0.4647 | × | ○ | ○ | 0.434 | ○ | ○ | × | × | × |
| 181 | 0.4704 | × | ○ | ○ | 0.523 | ○ | ○ | × | × | × |
| 182 | 0.4762 | × | ○ | ○ | 0.617 | ○ | ○ | × | × | × |
| 183 | 0.4820 | × | ○ | ○ | 0.711 | ○ | ○ | × | × | × |
| 184 | 0.4878 | × | ○ | ○ | 0.801 | ○ | ○ | × | × | × |
| 185 | 0.4936 | × | ○ | ○ | 0.895 | ○ | ○ | × | × | × |
| 186 | 0.4995 | × | ○ | ○ | 0.988 | ○ | ○ | × | × | × |
| 187 | 0.5054 | × | ○ | ○ | 0.086 | × | ○ | ○ | × | × |
| 188 | 0.5114 | × | ○ | ○ | 0.180 | × | ○ | ○ | × | × |
| 189 | 0.5174 | × | ○ | ○ | 0.277 | × | ○ | ○ | × | × |
| 190 | 0.5234 | × | ○ | ○ | 0.375 | × | ○ | ○ | × | × |
| 191 | 0.5295 | × | ○ | ○ | 0.469 | × | ○ | ○ | × | × |

FIG. 34

| Gray Level | Gamma Value 2.2 | D6 (5th 1/8SF) | D4 (3rd 1/8SF) | D2 (1st 1/8SF) | Analog (1st 1/16 SF) | D1 (2nd 1/16 SF) | D3 (2nd 1/8SF) | D5 (4th 1/8SF) | D7 (6th 1/8SF) | D8 (7th 1/8SF) |
|---|---|---|---|---|---|---|---|---|---|---|
| 192 | 0.5356 | × | ○ | ○ | 0.566 | × | ○ | ○ | × | × |
| 193 | 0.5418 | × | ○ | ○ | 0.668 | × | ○ | ○ | × | × |
| 194 | 0.5480 | × | ○ | ○ | 0.766 | × | ○ | ○ | × | × |
| 195 | 0.5542 | × | ○ | ○ | 0.867 | × | ○ | ○ | × | × |
| 196 | 0.5605 | × | ○ | ○ | 0.965 | × | ○ | ○ | × | × |
| 197 | 0.5668 | × | ○ | ○ | 0.066 | ○ | ○ | ○ | × | × |
| 198 | 0.5732 | × | ○ | ○ | 0.168 | ○ | ○ | ○ | × | × |
| 199 | 0.5795 | × | ○ | ○ | 0.270 | ○ | ○ | ○ | × | × |
| 200 | 0.5860 | × | ○ | ○ | 0.375 | ○ | ○ | ○ | × | × |
| 201 | 0.5924 | × | ○ | ○ | 0.477 | ○ | ○ | ○ | × | × |
| 202 | 0.5989 | × | ○ | ○ | 0.582 | ○ | ○ | ○ | × | × |
| 203 | 0.6055 | × | ○ | ○ | 0.688 | ○ | ○ | ○ | × | × |
| 204 | 0.6121 | × | ○ | ○ | 0.793 | ○ | ○ | ○ | × | × |
| 205 | 0.6187 | × | ○ | ○ | 0.898 | ○ | ○ | ○ | × | × |
| 206 | 0.6253 | ○ | ○ | ○ | 0.004 | × | ○ | ○ | × | × |
| 207 | 0.6320 | ○ | ○ | ○ | 0.109 | × | ○ | ○ | × | × |
| 208 | 0.6388 | ○ | ○ | ○ | 0.219 | × | ○ | ○ | × | × |
| 209 | 0.6456 | ○ | ○ | ○ | 0.328 | × | ○ | ○ | × | × |
| 210 | 0.6524 | ○ | ○ | ○ | 0.438 | × | ○ | ○ | × | × |
| 211 | 0.6592 | ○ | ○ | ○ | 0.547 | × | ○ | ○ | × | × |
| 212 | 0.6661 | ○ | ○ | ○ | 0.656 | × | ○ | ○ | × | × |
| 213 | 0.6730 | ○ | ○ | ○ | 0.766 | × | ○ | ○ | × | × |
| 214 | 0.6800 | ○ | ○ | ○ | 0.879 | × | ○ | ○ | × | × |
| 215 | 0.6870 | ○ | ○ | ○ | 0.992 | × | ○ | ○ | × | × |
| 216 | 0.6941 | ○ | ○ | ○ | 0.102 | ○ | ○ | ○ | × | × |
| 217 | 0.7012 | ○ | ○ | ○ | 0.215 | ○ | ○ | ○ | × | × |
| 218 | 0.7083 | ○ | ○ | ○ | 0.332 | ○ | ○ | ○ | × | × |
| 219 | 0.7155 | ○ | ○ | ○ | 0.445 | ○ | ○ | ○ | × | × |
| 220 | 0.7227 | ○ | ○ | ○ | 0.563 | ○ | ○ | ○ | × | × |
| 221 | 0.7299 | ○ | ○ | ○ | 0.676 | ○ | ○ | ○ | × | × |
| 222 | 0.7372 | ○ | ○ | ○ | 0.793 | ○ | ○ | ○ | × | × |
| 223 | 0.7445 | ○ | ○ | ○ | 0.910 | ○ | ○ | ○ | × | × |
| 224 | 0.7519 | ○ | ○ | ○ | 0.027 | × | ○ | ○ | ○ | × |
| 225 | 0.7593 | ○ | ○ | ○ | 0.148 | × | ○ | ○ | ○ | × |
| 226 | 0.7667 | ○ | ○ | ○ | 0.266 | × | ○ | ○ | ○ | × |
| 227 | 0.7742 | ○ | ○ | ○ | 0.387 | × | ○ | ○ | ○ | × |
| 228 | 0.7818 | ○ | ○ | ○ | 0.508 | × | ○ | ○ | ○ | × |
| 229 | 0.7893 | ○ | ○ | ○ | 0.629 | × | ○ | ○ | ○ | × |
| 230 | 0.7969 | ○ | ○ | ○ | 0.750 | × | ○ | ○ | ○ | × |
| 231 | 0.8046 | ○ | ○ | ○ | 0.871 | × | ○ | ○ | ○ | × |
| 232 | 0.8122 | ○ | ○ | ○ | 0.992 | × | ○ | ○ | ○ | × |
| 233 | 0.8200 | ○ | ○ | ○ | 0.117 | ○ | ○ | ○ | ○ | × |
| 234 | 0.8277 | ○ | ○ | ○ | 0.242 | ○ | ○ | ○ | ○ | × |
| 235 | 0.8355 | ○ | ○ | ○ | 0.367 | ○ | ○ | ○ | ○ | × |
| 236 | 0.8434 | ○ | ○ | ○ | 0.492 | ○ | ○ | ○ | ○ | × |
| 237 | 0.8513 | ○ | ○ | ○ | 0.617 | ○ | ○ | ○ | ○ | × |
| 238 | 0.8592 | ○ | ○ | ○ | 0.746 | ○ | ○ | ○ | ○ | × |
| 239 | 0.8671 | ○ | ○ | ○ | 0.871 | ○ | ○ | ○ | ○ | × |
| 240 | 0.8751 | ○ | ○ | ○ | 0.000 | × | ○ | ○ | ○ | ○ |
| 241 | 0.8832 | ○ | ○ | ○ | 0.129 | × | ○ | ○ | ○ | ○ |
| 242 | 0.8913 | ○ | ○ | ○ | 0.258 | × | ○ | ○ | ○ | ○ |
| 243 | 0.8994 | ○ | ○ | ○ | 0.387 | × | ○ | ○ | ○ | ○ |
| 244 | 0.9075 | ○ | ○ | ○ | 0.520 | × | ○ | ○ | ○ | ○ |
| 245 | 0.9158 | ○ | ○ | ○ | 0.648 | × | ○ | ○ | ○ | ○ |
| 246 | 0.9240 | ○ | ○ | ○ | 0.781 | × | ○ | ○ | ○ | ○ |
| 247 | 0.9323 | ○ | ○ | ○ | 0.914 | × | ○ | ○ | ○ | ○ |
| 248 | 0.9406 | ○ | ○ | ○ | 0.047 | ○ | ○ | ○ | ○ | ○ |
| 249 | 0.9490 | ○ | ○ | ○ | 0.180 | ○ | ○ | ○ | ○ | ○ |
| 250 | 0.9574 | ○ | ○ | ○ | 0.316 | ○ | ○ | ○ | ○ | ○ |
| 251 | 0.9658 | ○ | ○ | ○ | 0.449 | ○ | ○ | ○ | ○ | ○ |
| 252 | 0.9743 | ○ | ○ | ○ | 0.586 | ○ | ○ | ○ | ○ | ○ |
| 253 | 0.9828 | ○ | ○ | ○ | 0.723 | ○ | ○ | ○ | ○ | ○ |
| 254 | 0.9914 | ○ | ○ | ○ | 0.859 | ○ | ○ | ○ | ○ | ○ |
| 255 | 1.0000 | ○ | ○ | ○ | 1.000 | ○ | ○ | ○ | ○ | ○ |

FIG. 36

| Gray Level | Gamma Value 2.2 | D1 (1st 1/32SF) | Analog (1/16 SF) | D2 (1/8 SF) | D3 (1/4SF) | D4 (1/2SF) |
|---|---|---|---|---|---|---|
| 0 | 0.0000 | × | 0.000 | × | × | × |
| 1 | 0.0000 | × | 0.000 | × | × | × |
| 2 | 0.0000 | × | 0.000 | × | × | × |
| 3 | 0.0001 | × | 0.000 | × | × | × |
| 4 | 0.0001 | × | 0.000 | × | × | × |
| 5 | 0.0002 | × | 0.000 | × | × | × |
| 6 | 0.0003 | × | 0.004 | × | × | × |
| 7 | 0.0004 | × | 0.004 | × | × | × |
| 8 | 0.0005 | × | 0.008 | × | × | × |
| 9 | 0.0006 | × | 0.008 | × | × | × |
| 10 | 0.0008 | × | 0.012 | × | × | × |
| 11 | 0.0010 | × | 0.016 | × | × | × |
| 12 | 0.0012 | × | 0.016 | × | × | × |
| 13 | 0.0014 | × | 0.020 | × | × | × |
| 14 | 0.0017 | × | 0.023 | × | × | × |
| 15 | 0.0020 | × | 0.031 | × | × | × |
| 16 | 0.0023 | × | 0.035 | × | × | × |
| 17 | 0.0026 | × | 0.039 | × | × | × |
| 18 | 0.0029 | × | 0.047 | × | × | × |
| 19 | 0.0033 | × | 0.051 | × | × | × |
| 20 | 0.0037 | × | 0.059 | × | × | × |
| 21 | 0.0041 | × | 0.063 | × | × | × |
| 22 | 0.0046 | × | 0.070 | × | × | × |
| 23 | 0.0050 | × | 0.078 | × | × | × |
| 24 | 0.0055 | × | 0.086 | × | × | × |
| 25 | 0.0060 | × | 0.094 | × | × | × |
| 26 | 0.0066 | × | 0.102 | × | × | × |
| 27 | 0.0072 | × | 0.113 | × | × | × |
| 28 | 0.0078 | × | 0.121 | × | × | × |
| 29 | 0.0084 | × | 0.133 | × | × | × |
| 30 | 0.0090 | × | 0.141 | × | × | × |
| 31 | 0.0097 | × | 0.152 | × | × | × |
| 32 | 0.0104 | × | 0.164 | × | × | × |
| 33 | 0.0111 | × | 0.176 | × | × | × |
| 34 | 0.0119 | × | 0.188 | × | × | × |
| 35 | 0.0127 | × | 0.199 | × | × | × |
| 36 | 0.0135 | × | 0.215 | × | × | × |
| 37 | 0.0143 | × | 0.227 | × | × | × |
| 38 | 0.0152 | × | 0.242 | × | × | × |
| 39 | 0.0161 | × | 0.254 | × | × | × |
| 40 | 0.0170 | × | 0.270 | × | × | × |
| 41 | 0.0179 | × | 0.285 | × | × | × |
| 42 | 0.0189 | × | 0.301 | × | × | × |
| 43 | 0.0199 | × | 0.316 | × | × | × |
| 44 | 0.0210 | × | 0.332 | × | × | × |
| 45 | 0.0220 | × | 0.352 | × | × | × |
| 46 | 0.0231 | × | 0.367 | × | × | × |
| 47 | 0.0242 | × | 0.387 | × | × | × |
| 48 | 0.0254 | × | 0.402 | × | × | × |
| 49 | 0.0265 | × | 0.422 | × | × | × |
| 50 | 0.0278 | × | 0.441 | × | × | × |
| 51 | 0.0290 | × | 0.461 | × | × | × |
| 52 | 0.0303 | × | 0.480 | × | × | × |
| 53 | 0.0316 | × | 0.504 | × | × | × |
| 54 | 0.0329 | × | 0.523 | × | × | × |
| 55 | 0.0342 | × | 0.547 | × | × | × |
| 56 | 0.0356 | × | 0.566 | × | × | × |
| 57 | 0.0370 | × | 0.590 | × | × | × |
| 58 | 0.0385 | × | 0.613 | × | × | × |
| 59 | 0.0399 | × | 0.637 | × | × | × |
| 60 | 0.0415 | × | 0.660 | × | × | × |
| 61 | 0.0430 | × | 0.688 | × | × | × |
| 62 | 0.0446 | × | 0.711 | × | × | × |
| 63 | 0.0461 | × | 0.738 | × | × | × |

FIG. 37

| Gray Level | Gamma Value 2.2 | D1 (1st 1/32SF) | Analog (1/16 SF) | D2 (1/8 SF) | D3 (1/4SF) | D4 (1/2SF) |
|---|---|---|---|---|---|---|
| 64 | 0.0478 | × | 0.762 | × | × | × |
| 65 | 0.0494 | × | 0.789 | × | × | × |
| 66 | 0.0511 | × | 0.816 | × | × | × |
| 67 | 0.0528 | × | 0.844 | × | × | × |
| 68 | 0.0546 | × | 0.871 | × | × | × |
| 69 | 0.0564 | × | 0.898 | × | × | × |
| 70 | 0.0582 | × | 0.930 | × | × | × |
| 71 | 0.0600 | × | 0.957 | × | × | × |
| 72 | 0.0619 | × | 0.988 | × | × | × |
| 73 | 0.0638 | ○ | 0.020 | × | × | × |
| 74 | 0.0658 | ○ | 0.051 | × | × | × |
| 75 | 0.0677 | ○ | 0.082 | × | × | × |
| 76 | 0.0697 | ○ | 0.113 | × | × | × |
| 77 | 0.0718 | ○ | 0.145 | × | × | × |
| 78 | 0.0738 | ○ | 0.180 | × | × | × |
| 79 | 0.0759 | ○ | 0.211 | × | × | × |
| 80 | 0.0781 | ○ | 0.246 | × | × | × |
| 81 | 0.0802 | ○ | 0.281 | × | × | × |
| 82 | 0.0824 | ○ | 0.316 | × | × | × |
| 83 | 0.0846 | ○ | 0.352 | × | × | × |
| 84 | 0.0869 | ○ | 0.387 | × | × | × |
| 85 | 0.0892 | ○ | 0.426 | × | × | × |
| 86 | 0.0915 | ○ | 0.461 | × | × | × |
| 87 | 0.0939 | ○ | 0.500 | × | × | × |
| 88 | 0.0963 | ○ | 0.539 | × | × | × |
| 89 | 0.0987 | ○ | 0.578 | × | × | × |
| 90 | 0.1011 | ○ | 0.617 | × | × | × |
| 91 | 0.1036 | ○ | 0.656 | × | × | × |
| 92 | 0.1062 | ○ | 0.695 | × | × | × |
| 93 | 0.1087 | ○ | 0.738 | × | × | × |
| 94 | 0.1113 | ○ | 0.777 | × | × | × |
| 95 | 0.1139 | ○ | 0.820 | × | × | × |
| 96 | 0.1166 | ○ | 0.863 | × | × | × |
| 97 | 0.1193 | ○ | 0.906 | × | × | × |
| 98 | 0.1220 | ○ | 0.949 | × | × | × |
| 99 | 0.1247 | ○ | 0.992 | × | × | × |
| 100 | 0.1275 | × | 0.039 | ○ | × | × |
| 101 | 0.1304 | × | 0.082 | ○ | × | × |
| 102 | 0.1332 | × | 0.129 | ○ | × | × |
| 103 | 0.1361 | × | 0.176 | ○ | × | × |
| 104 | 0.1390 | × | 0.223 | ○ | × | × |
| 105 | 0.1420 | × | 0.270 | ○ | × | × |
| 106 | 0.1450 | × | 0.316 | ○ | × | × |
| 107 | 0.1480 | × | 0.367 | ○ | × | × |
| 108 | 0.1511 | × | 0.414 | ○ | × | × |
| 109 | 0.1542 | × | 0.465 | ○ | × | × |
| 110 | 0.1573 | × | 0.516 | ○ | × | × |
| 111 | 0.1604 | × | 0.566 | ○ | × | × |
| 112 | 0.1636 | × | 0.617 | ○ | × | × |
| 113 | 0.1669 | × | 0.668 | ○ | × | × |
| 114 | 0.1701 | × | 0.719 | ○ | × | × |
| 115 | 0.1734 | × | 0.773 | ○ | × | × |
| 116 | 0.1768 | × | 0.828 | ○ | × | × |
| 117 | 0.1801 | × | 0.879 | ○ | × | × |
| 118 | 0.1835 | × | 0.934 | ○ | × | × |
| 119 | 0.1870 | × | 0.988 | ○ | × | × |
| 120 | 0.1905 | ○ | 0.047 | ○ | × | × |
| 121 | 0.1940 | ○ | 0.102 | ○ | × | × |
| 122 | 0.1975 | ○ | 0.160 | ○ | × | × |
| 123 | 0.2011 | ○ | 0.215 | ○ | × | × |
| 124 | 0.2047 | ○ | 0.273 | ○ | × | × |
| 125 | 0.2084 | ○ | 0.332 | ○ | × | × |
| 126 | 0.2120 | ○ | 0.391 | ○ | × | × |
| 127 | 0.2158 | ○ | 0.449 | ○ | × | × |

FIG. 38

| Gray Level | Gamma Value 2.2 | D1 (1st 1/32SF) | Analog (1/16 SF) | D2 (1/8 SF) | D3 (1/4SF) | D4 (1/2SF) |
|---|---|---|---|---|---|---|
| 128 | 0.2195 | ○ | 0.512 | ○ | × | × |
| 129 | 0.2233 | ○ | 0.570 | ○ | × | × |
| 130 | 0.2271 | ○ | 0.633 | ○ | × | × |
| 131 | 0.2310 | ○ | 0.695 | ○ | × | × |
| 132 | 0.2349 | ○ | 0.758 | ○ | × | × |
| 133 | 0.2388 | ○ | 0.820 | ○ | × | × |
| 134 | 0.2428 | ○ | 0.883 | ○ | × | × |
| 135 | 0.2468 | ○ | 0.945 | ○ | × | × |
| 136 | 0.2508 | ○ | 1.012 | ○ | × | × |
| 137 | 0.2549 | × | 0.078 | × | ○ | × |
| 138 | 0.2590 | × | 0.141 | × | ○ | × |
| 139 | 0.2632 | × | 0.207 | × | ○ | × |
| 140 | 0.2674 | × | 0.277 | × | ○ | × |
| 141 | 0.2716 | × | 0.344 | × | ○ | × |
| 142 | 0.2758 | × | 0.410 | × | ○ | × |
| 143 | 0.2801 | × | 0.480 | × | ○ | × |
| 144 | 0.2845 | × | 0.551 | × | ○ | × |
| 145 | 0.2888 | × | 0.617 | × | ○ | × |
| 146 | 0.2932 | × | 0.691 | × | ○ | × |
| 147 | 0.2977 | × | 0.762 | × | ○ | × |
| 148 | 0.3021 | × | 0.832 | × | ○ | × |
| 149 | 0.3066 | × | 0.902 | × | ○ | × |
| 150 | 0.3112 | × | 0.977 | × | ○ | × |
| 151 | 0.3158 | ○ | 0.051 | × | ○ | × |
| 152 | 0.3204 | ○ | 0.125 | × | ○ | × |
| 153 | 0.3250 | ○ | 0.199 | × | ○ | × |
| 154 | 0.3297 | ○ | 0.273 | × | ○ | × |
| 155 | 0.3345 | ○ | 0.348 | × | ○ | × |
| 156 | 0.3392 | ○ | 0.426 | × | ○ | × |
| 157 | 0.3440 | ○ | 0.504 | × | ○ | × |
| 158 | 0.3489 | ○ | 0.578 | × | ○ | × |
| 159 | 0.3537 | ○ | 0.656 | × | ○ | × |
| 160 | 0.3587 | ○ | 0.738 | × | ○ | × |
| 161 | 0.3636 | ○ | 0.816 | × | ○ | × |
| 162 | 0.3686 | ○ | 0.895 | × | ○ | × |
| 163 | 0.3736 | ○ | 0.977 | × | ○ | × |
| 164 | 0.3787 | × | 0.059 | ○ | ○ | × |
| 165 | 0.3838 | × | 0.137 | ○ | ○ | × |
| 166 | 0.3889 | × | 0.219 | ○ | ○ | × |
| 167 | 0.3941 | × | 0.305 | ○ | ○ | × |
| 168 | 0.3993 | × | 0.387 | ○ | ○ | × |
| 169 | 0.4045 | × | 0.469 | ○ | ○ | × |
| 170 | 0.4098 | × | 0.555 | ○ | ○ | × |
| 171 | 0.4151 | × | 0.641 | ○ | ○ | × |
| 172 | 0.4205 | × | 0.727 | ○ | ○ | × |
| 173 | 0.4259 | × | 0.813 | ○ | ○ | × |
| 174 | 0.4313 | × | 0.898 | ○ | ○ | × |
| 175 | 0.4368 | × | 0.988 | ○ | ○ | × |
| 176 | 0.4423 | ○ | 0.074 | ○ | ○ | × |
| 177 | 0.4479 | ○ | 0.164 | ○ | ○ | × |
| 178 | 0.4535 | ○ | 0.254 | ○ | ○ | × |
| 179 | 0.4591 | ○ | 0.344 | ○ | ○ | × |
| 180 | 0.4647 | ○ | 0.434 | ○ | ○ | × |
| 181 | 0.4704 | ○ | 0.523 | ○ | ○ | × |
| 182 | 0.4762 | ○ | 0.617 | ○ | ○ | × |
| 183 | 0.4820 | ○ | 0.711 | ○ | ○ | × |
| 184 | 0.4878 | ○ | 0.801 | ○ | ○ | × |
| 185 | 0.4936 | ○ | 0.895 | ○ | ○ | × |
| 186 | 0.4995 | ○ | 0.988 | ○ | ○ | × |
| 187 | 0.5054 | × | 0.086 | × | × | ○ |
| 188 | 0.5114 | × | 0.180 | × | × | ○ |
| 189 | 0.5174 | × | 0.277 | × | × | ○ |
| 190 | 0.5234 | × | 0.375 | × | × | ○ |
| 191 | 0.5295 | × | 0.469 | × | × | ○ |

FIG. 39

| Gray Level | Gamma Value 2.2 | D1 (1st 1/32SF) | Analog (1/16 SF) | D2 (1/8 SF) | D3 (1/4SF) | D4 (1/2SF) |
|---|---|---|---|---|---|---|
| 192 | 0.5356 | × | 0.566 | × | × | ○ |
| 193 | 0.5418 | × | 0.668 | × | × | ○ |
| 194 | 0.5480 | × | 0.766 | × | × | ○ |
| 195 | 0.5542 | × | 0.867 | × | × | ○ |
| 196 | 0.5605 | × | 0.965 | × | × | ○ |
| 197 | 0.5668 | ○ | 0.066 | × | × | ○ |
| 198 | 0.5732 | ○ | 0.168 | × | × | ○ |
| 199 | 0.5795 | ○ | 0.270 | × | × | ○ |
| 200 | 0.5860 | ○ | 0.375 | × | × | ○ |
| 201 | 0.5924 | ○ | 0.477 | × | × | ○ |
| 202 | 0.5989 | ○ | 0.582 | × | × | ○ |
| 203 | 0.6055 | ○ | 0.688 | × | × | ○ |
| 204 | 0.6121 | ○ | 0.793 | × | × | ○ |
| 205 | 0.6187 | ○ | 0.898 | × | × | ○ |
| 206 | 0.6253 | × | 0.004 | ○ | × | ○ |
| 207 | 0.6320 | × | 0.109 | ○ | × | ○ |
| 208 | 0.6388 | × | 0.219 | ○ | × | ○ |
| 209 | 0.6456 | × | 0.328 | ○ | × | ○ |
| 210 | 0.6524 | × | 0.438 | ○ | × | ○ |
| 211 | 0.6592 | × | 0.547 | ○ | × | ○ |
| 212 | 0.6661 | × | 0.656 | ○ | × | ○ |
| 213 | 0.6730 | × | 0.766 | ○ | × | ○ |
| 214 | 0.6800 | × | 0.879 | ○ | × | ○ |
| 215 | 0.6870 | × | 0.992 | ○ | × | ○ |
| 216 | 0.6941 | ○ | 0.102 | ○ | × | ○ |
| 217 | 0.7012 | ○ | 0.215 | ○ | × | ○ |
| 218 | 0.7083 | ○ | 0.332 | ○ | × | ○ |
| 219 | 0.7155 | ○ | 0.445 | ○ | × | ○ |
| 220 | 0.7227 | ○ | 0.563 | ○ | × | ○ |
| 221 | 0.7299 | ○ | 0.676 | ○ | × | ○ |
| 222 | 0.7372 | ○ | 0.793 | ○ | × | ○ |
| 223 | 0.7445 | ○ | 0.910 | ○ | × | ○ |
| 224 | 0.7519 | × | 0.027 | × | ○ | ○ |
| 225 | 0.7593 | × | 0.148 | × | ○ | ○ |
| 226 | 0.7667 | × | 0.266 | × | ○ | ○ |
| 227 | 0.7742 | × | 0.387 | × | ○ | ○ |
| 228 | 0.7818 | × | 0.508 | × | ○ | ○ |
| 229 | 0.7893 | × | 0.629 | × | ○ | ○ |
| 230 | 0.7969 | × | 0.750 | × | ○ | ○ |
| 231 | 0.8046 | × | 0.871 | × | ○ | ○ |
| 232 | 0.8122 | × | 0.992 | × | ○ | ○ |
| 233 | 0.8200 | ○ | 0.117 | × | ○ | ○ |
| 234 | 0.8277 | ○ | 0.242 | × | ○ | ○ |
| 235 | 0.8355 | ○ | 0.367 | × | ○ | ○ |
| 236 | 0.8434 | ○ | 0.492 | × | ○ | ○ |
| 237 | 0.8513 | ○ | 0.617 | × | ○ | ○ |
| 238 | 0.8592 | ○ | 0.746 | × | ○ | ○ |
| 239 | 0.8671 | ○ | 0.871 | × | ○ | ○ |
| 240 | 0.8751 | × | 0.000 | ○ | ○ | ○ |
| 241 | 0.8832 | × | 0.129 | ○ | ○ | ○ |
| 242 | 0.8913 | × | 0.258 | ○ | ○ | ○ |
| 243 | 0.8994 | × | 0.387 | ○ | ○ | ○ |
| 244 | 0.9075 | × | 0.520 | ○ | ○ | ○ |
| 245 | 0.9158 | × | 0.648 | ○ | ○ | ○ |
| 246 | 0.9240 | × | 0.781 | ○ | ○ | ○ |
| 247 | 0.9323 | × | 0.914 | ○ | ○ | ○ |
| 248 | 0.9406 | ○ | 0.047 | ○ | ○ | ○ |
| 249 | 0.9490 | ○ | 0.180 | ○ | ○ | ○ |
| 250 | 0.9574 | ○ | 0.316 | ○ | ○ | ○ |
| 251 | 0.9658 | ○ | 0.449 | ○ | ○ | ○ |
| 252 | 0.9743 | ○ | 0.586 | ○ | ○ | ○ |
| 253 | 0.9828 | ○ | 0.723 | ○ | ○ | ○ |
| 254 | 0.9914 | ○ | 0.859 | ○ | ○ | ○ |
| 255 | 1.0000 | ○ | 1.000 | ○ | ○ | ○ |

LIGHT-EMITTING DEVICE AND DRIVING METHOD OF LIGHT-EMITTING DEVICE

CROSS-REFERENCE TO RELATED APPLICATION

This application is based upon and claims the benefit of priority from the prior Japanese Patent Application No. 2020-147122, filed on Sep. 1, 2020, the entire contents of which are incorporated herein by reference.

FIELD

An embodiment of the present invention relates to a light-emitting device and a driving method of the light-emitting device.

BACKGROUND

Recently, light-emitting devices in which each of a plurality of pixels is formed by light-emitting elements have attracted attention. The light-emitting element is, for example, a Light-emitting Diode (LED), a minute light-emitting diode (micro LED), and an Electro Luminescence (EL) element, and the like. In the light-emitting device in which a plurality of pixels is formed by light-emitting elements, for example, a current control method, a PWM (pulse-width modulation) control method, and a time division control method are used to control the gray-scales of the plurality of pixels. The current control method is an analog control method, and the PWM control method and the time division control method are digital control methods.

SUMMARY

A driving method of a light-emitting device. The light-emitting device has a plurality of pixels and performs gray-scale display in sections of the sub-frame periods in which one frame period for displaying one frame image is divided into a plurality of sub-frame periods. The driving method includes writing analog gray-scale data to the plurality of pixels to display analog gray-scales in one sub-frame period of the plurality of sub-frame periods, and writing first digital gray-scale data to the plurality of pixels to display first digital gray-scales in a sub-frame period of the same length as the one sub-frame period, and in a sub-frame period different from the one sub-frame period.

A light-emitting device includes a plurality of pixels each provided with a light-emitting element, a frame memory storing analog gray-scale data and first digital gray-scale data, and a control section receiving an input of the analog gray-scale data from the frame memory to write the analog gray-scale data to any one pixel of the plurality of pixels, and receiving input of the first digital gray-scale data from the frame memory to write the first digital gray-scale data to any one pixel. The control section divides a frame period for displaying an image of one frame into a plurality of sub-frame periods. One sub-frame period of the plurality of sub-frame periods is an analog gray-scale display period in which the control section writes the analog gray-scale data to the plurality of pixels to perform analog gray-scale display. A sub-frame period different from the one sub-frame period is the same length period as the one sub-frame period. A sub-frame period different from the one sub-frame period is a period of the same length period as the one sub-frame period and is the period for displaying the first digital gray-scales in which the plurality of pixels is written with the first digital gray-scale data by the control section.

BRIEF DESCRIPTION OF DRAWINGS

FIG. 6 is a diagram showing gray-scales (0 to 63 gray-scales) of pixels and data corresponding to each gray-scale according to an embodiment of the present invention;

FIG. 7 is a diagram showing gray-scales (64 to 127 gray-scales) of pixels and data corresponding to each gray-scale according to an embodiment of the present invention;

FIG. 8 is a diagram showing gray-scales (128 to 191 gray-scales) of pixels and data corresponding to each gray-scale according to an embodiment of the present invention;

FIG. 9 is a diagram showing gray-scales (192 to 255 gray-scales) of pixels and data corresponding to each gray-scale according to an embodiment of the present invention;

FIG. 31 is a diagram showing gray-scales (0 to 63 gray-scales) of pixels and data corresponding to each gray-scale according to an embodiment of the present invention;

FIG. 32 is a diagram showing gray-scales (64 to 127 gray-scales) of pixels and data corresponding to each gray-scale according to an embodiment of the present invention;

FIG. 33 is a diagram showing gray-scales (128 to 191 gray-scales) of pixels and data corresponding to each gray-scale according to an embodiment of the present invention;

FIG. 34 is a diagram showing gray-scales (192 to 255 gray-scales) of pixels and data corresponding to each gray-scale according to an embodiment of the present invention;

FIG. 36 is a diagram showing gray-scales (0 to 63 gray-scales) of pixels and data corresponding to each gray-scale according to an embodiment of the present invention;

FIG. 37 is a diagram showing gray-scales (64 to 127 gray-scales) of pixels and data corresponding to each gray-scale according to an embodiment of the present invention;

FIG. 38 is a diagram showing gray-scales (128 to 191 gray-scales) of pixels and data corresponding to each gray-scale according to an embodiment of the present invention;

FIG. 39 is a diagram showing gray-scales (192 to 255 gray-scales) of pixels and data corresponding to each gray-scale according to an embodiment of the present invention;

DESCRIPTION OF EMBODIMENTS

Figure 1:
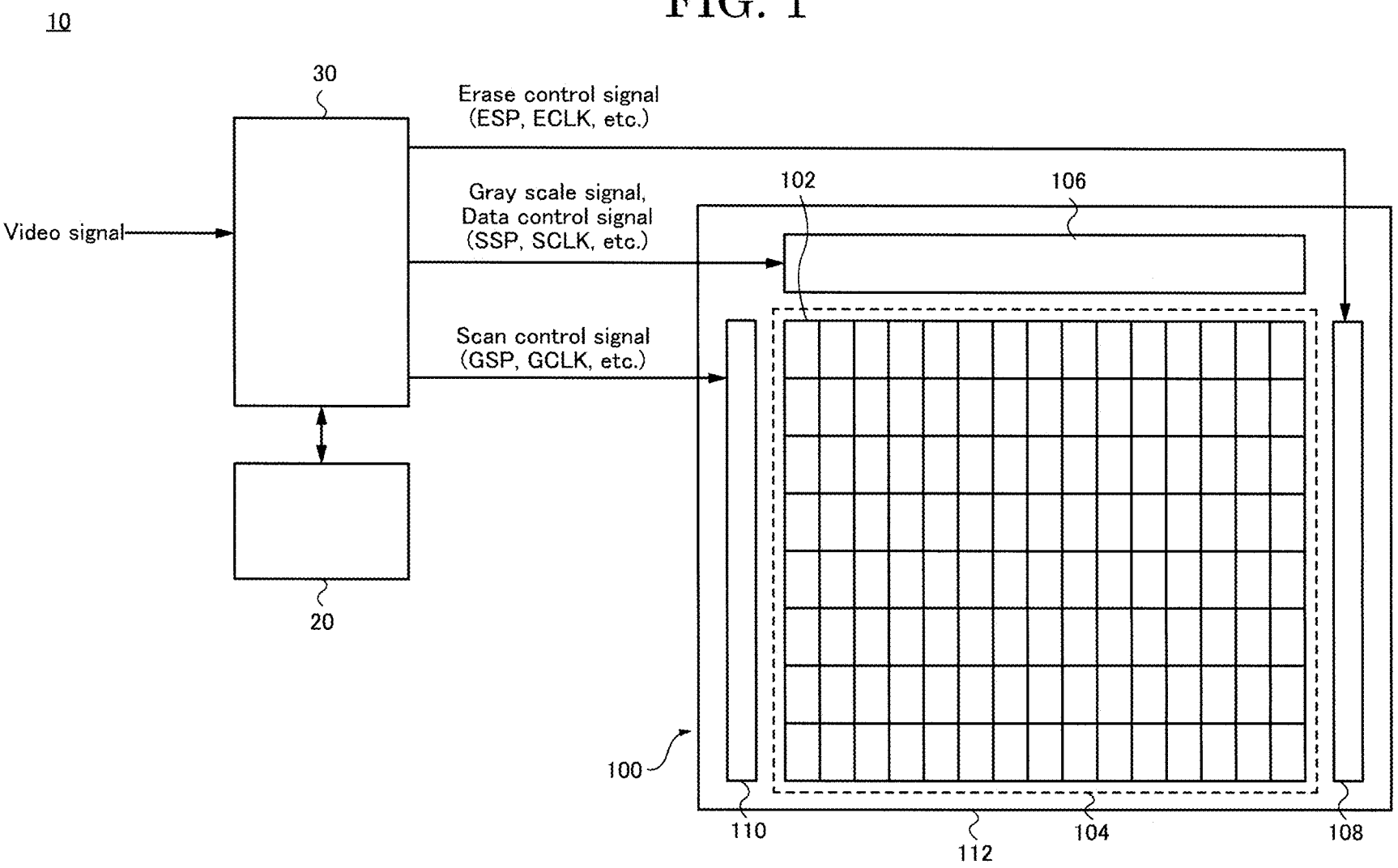
FIG. 1 is a schematic plan view showing a configuration of a light-emitting device according to an embodiment of the present invention.

For example, in a light-emitting device using a micro LED, a LED and an ORED element and the like, when controlling the gray-scale of a plurality of pixels using the current control method, gray-scale control at low gray-scales (weak current) is particularly difficult, and there is a possibility that the image quality of the display device is reduced. Further, in the light-emitting device using the micro LED, when controlling the gray-scale of a plurality of pixels using the time division control method, for example, since the number of scans in one frame period is larger than the current control method, it is difficult to increase the number of gray-scales. As a result, even if the number of gray-scales is increased, display becomes difficult due to a decrease in writing time caused by the increase in the number of scans.

In view of such a problem, it is one purpose of an embodiment of the present invention to provide a light-emitting device and a driving method of the light-emitting device to suppress deterioration of image quality.

In a number of embodiments described below, configurations of a light-emitting device and a driving method of the light-emitting device according to an embodiment of the present invention are illustrated.

Embodiments of the present invention will be described below with reference to the drawings and the like. However, the present invention can be implemented in many different modes and should not be construed as being limited to the description of the following embodiments. For clarity of explanation, the drawings may be schematically represented with respect to configurations and the like of the respective parts as compared with actual embodiments but are merely an example and do not limit the interpretation of the present invention. In addition, in the present specification and each drawing, the same reference numerals (or reference numerals denoted by A, B, and the like) are given to the same elements as those described above with reference to the preceding drawings, and a detailed description thereof may be omitted as appropriate. The letters "first" and "second" to each element are convenient labels used to distinguish each element and have no further meaning unless otherwise stated.

When expressions such as "a includes A, B or C", "a includes any of A, B and C", "a includes one selected from a group consisting of A, B and C", and "a includes one selected from a group consisting of A, B and C", are used in an embodiment of the present invention, unless otherwise specified, a does not exclude a case in which a plurality of combinations of A to C is included. Furthermore, these expressions do not exclude the case where a includes other elements.

A substrate described herein has at least one planar main surface on which are provided an insulating layer, a semiconductor layers, and a conductive layers, or elements such as a transistor and a light-emitting element. In the following explanation, it is assumed that one main surface of the substrate is used as a reference in a cross-sectional view.

In a light-emitting device using a light-emitting element according to an embodiment of the present invention, the light-emitting element may be a self-luminous element such as a light-emitting LED, a micro LED, or an organic EL element. The light-emitting device according to an embodiment of the present invention is, for example, a light-emitting device using a micro LED for the light-emitting element.

1. First Embodiment

<1-1. Overall Configuration of Light-Emitting Device 10>

Figure 2:
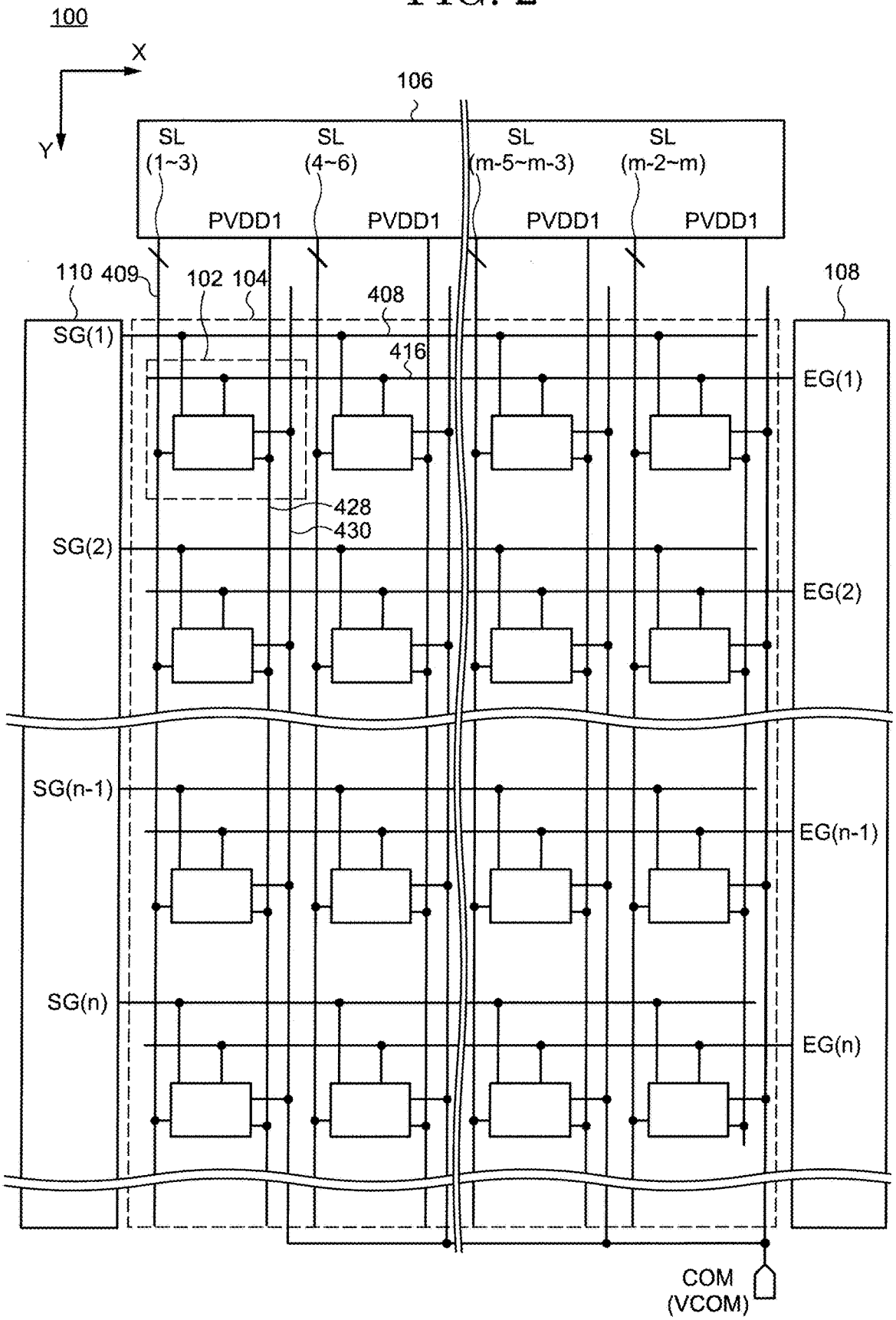
FIG. 2 is a schematic plan view showing a display panel included in a light-emitting device according to an embodiment of the present invention.

FIG. 1 and FIG. 2 are schematic plan views showing a configuration of a light-emitting device 10 according to an embodiment of the present invention. The configuration of the light-emitting device 10 shown in FIGS. 1 and 2 is only an example, and the configuration of the light-emitting device 10 is not limited to the configuration shown in FIGS. 1 and 2.

Figure 3:
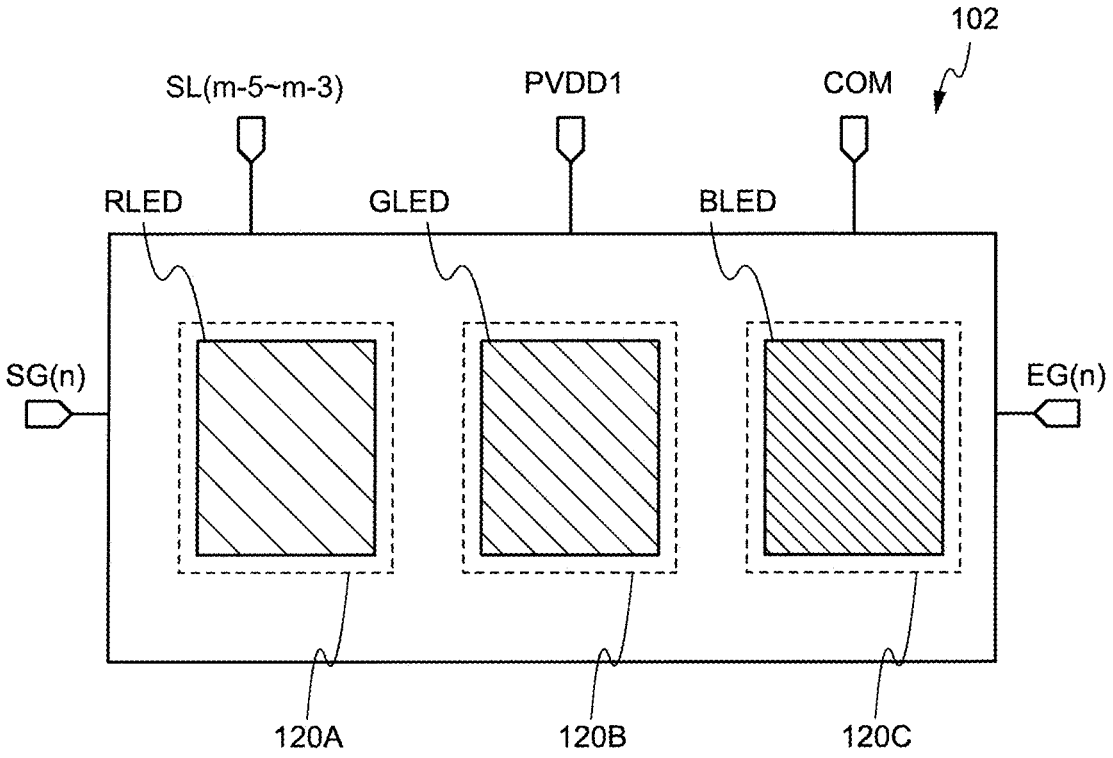
FIG. 3 is a schematic plan view showing a configuration of a pixel according to an embodiment of the present invention.

As shown in FIG. 1, the light-emitting device 10 has a storage device 20, a timing control circuit 30, and a display panel 100. The display panel 100 has a pixel 102, a display section 104, a video signal line drive circuit 106, an erasing signal line drive circuit 108, a scan signal line drive circuit 110, and a substrate 112. The display section 104, the video signal line drive circuit 106, the erasing signal line drive circuit 108, and the scan signal line drive circuit 110 are provided on the top surface of the substrate 112. The storage device 20 and the timing control circuit 30 may be provided on the top surface of the substrate 112. The display section 104 has a plurality of pixels 102 for displaying an image on the light-emitting device 10. Each of the plurality of pixels 102 has, for example, a sub-pixel 120A (FIG. 3), a sub-pixel 120B (FIG. 3), and a sub-pixel 120C (FIG. 3).

The plurality of pixels 102 is arranged in a matrix in the x-direction and the y-direction intersecting in the x-direction. Each of the plurality of pixels 102 includes a plurality of sub-pixels (FIG. 3), each of the plurality of sub-pixels having at least a transistor (FIG. 3) and a light-emitting element LED (FIG. 3). The light-emitting device 10 according to an embodiment of the present invention can display an image on the display section 104 by driving the transistor and making the light-emitting element LED emit light or not to emit light. In an embodiment of the present invention, for example, the x-direction is referred to as a first direction and the y-direction is referred to as a second direction. The emission intensity or luminance of the light-emitting element is controlled by the current flowing through the light-emitting element.

The timing control circuit 30 is supplied with a video signal, a timing signal for controlling the operation of the circuit, and a power supply voltage and the like from an external circuit (not shown). The external circuit (not shown) supplies, for example, a drive voltage VDDH1 (FIG. 3), a common voltage VCOM (FIG. 3), and a reference voltage VSS (not shown) to the storage device 20, the timing control circuit 30, and the display panel 100.

The timing control circuit 30 generates, for example, a data control signal, a scan control signal, an erase control signal, and a gray-scale signal using the video signal, the timing signal for controlling the operation of the circuit, and the power supply voltage. The timing control circuit 30 may supply the drive voltage VDDH1, the common voltage VCOM, and the reference voltage VSS to the display panel 100. The timing control circuit 30 may generate a new voltage using the drive voltage VDDH1, the common voltage VCOM, and the reference voltage VSS, then supply the generated new voltage to the display panel 100.

In an embodiment, one frame (1Frame, 1F) period includes a plurality of sub-frame (Sub Frame, SF) periods.

In one sub-frame period of the plurality of sub-frame periods, the gray-scale signal is input to the pixel. In an embodiment of the present invention, the gray-scale signal includes analog data and a time division gray-scale signal, the details of which will be described later. As described later, the time division gray-scale signal includes a first control signal to an eighth control signal. In an embodiment of the present invention, the time division gray-scale signal is a signal related to the time division control method and is a binary signal of an on signal for causing the light-emitting element to emit light at a predetermined luminance (preferably, maximal luminance) over a period of the sub-frame, or an off signal for causing the light-emitting element not to emit light over the sub-frame period. The time division control method divides one frame period into a plurality of sub-frame periods, controls the emission and non-emission (on/off of the light-emitting element) of the light-emitting element in each sub-frame period, and controls the gray-scale of the pixel by controlling the length of the light-emitting element on/off time in the whole frame. The time division control method is, for example, a method called a digital method (digital gray-scale method). For example, when one frame is divided into eight sub-frames, a pixel having four sub-frames as the light-emitting period has twice the luminance in one frame than a pixel having two sub-frames as the light-emitting period. Each of the first control signal to the eighth control signal may be referred to as first digital gray-scale data, second digital gray-scale data, third digital gray-scale data, fourth digital gray-scale data, fifth digital gray-scale data, sixth digital gray-scale data, seventh digital gray-scale data, and eighth digital gray-scale data. On the other hand, the analog data may be referred to as analog gray-scale data. The analog data is not the binary data as described above but is data capable of setting the multi-stage voltage in according to the luminance. In the light-emitting device 10, the luminance of the light-emitting element is controlled on the basis of the voltage. The display method of such a light-emitting element is called an analogue gray-scale method. For example, when a light-emitting element A is caused to emit light by the analog gray-scale data of the first voltage in the above-described one sub-frame and another light-emitting element B is caused to emit light by the analog gray-scale data of the second voltage in the same one sub-frame, if the first voltage is larger than the second voltage, the light-emitting element A is brighter than the light-emitting element B even in the same one sub-frame period.

The timing control circuit 30 outputs, for example, the video signal for each frame to the storage device 20. The storage device 20 is, for example, a frame memory for storing the video signal for each frame. The storage device 20 includes a look-up table or the like that stores the gray-scale signal corresponding to the video signal of each pixel. The look-up table also has the gray-scale signal corresponding to the video signal of each pixel, and a data table associated with the emission intensity or luminance. The timing control circuit 30 reads the gray-scale signal corresponding to the video signal of each pixel for each frame period stored in the storage device 20 from the storage device 20 and supplies the gray-scale signal, and the data control signal, to the video signal line drive circuit 106. The timing control circuit 30 generates the scan control signal that controls a scanning line (FIG. 3) for each sub-frame period and supplies the scan control signal to the scan signal line drive circuit 110. In addition, the timing control circuit 30 generates the erase control signal that controls erasing lines in a number of sub-frame periods and supplies the erase control signal to the erasing signal line drive circuit 108.

The data control signal includes, for example, a start pulse SSP and a clock signal SCLK which control the timing of supplying data to the pixels in sequence. The scan control signal includes, for example, a start pulse GSP and a clock signal GCLK. The erase control signal includes, for example, a start pulse ESP and a clock signal ECLK.

The scan signal line drive circuit 110, the video signal line drive circuit 106, and the erasing signal line drive circuit 108 use the respective signals and power supply voltages supplied from the timing control circuit 30 to drive the transistor (FIG. 4) included in the pixel 102. Consequently, the LED (FIG. 4) of the respective pixels emits or does not emit light, and an image is displayed on the display section 104. In an embodiment of the present invention, the timing control circuit 30, the scan signal line drive circuit 110, the video signal line drive circuit 106, and the erasing signal line drive circuit 108 may be collectively referred to as a control section, and the timing control circuit 30, the scan signal line drive circuit 110, and the video signal line drive circuit 106 may be collectively referred to as a control section, and the scan signal line drive circuit 110, and the video signal line drive circuit 106 may be collectively referred to as a control section.

As shown in FIG. 2, the scan signal line drive circuit 110 is connected to a plurality of scanning lines 408. The scan signal line drive circuit 110 uses the scan control signal to generate a scan signal SG (n). Each of the plurality of scanning lines 408 is connected to the plurality of pixels 102 located in the nth row in the display section 104. The scan signal SG (n) is supplied to each of the plurality of scanning lines 408. For example, the scan signal SG (1) is supplied to the first scanning line, the scan signal SG (2) is supplied to the second scanning line, the scan signal SG (n-1) is supplied to the (n-1)th scanning line, and the scan signal SG (n) is supplied to the nth scanning line.

The video signal line drive circuit 106 is connected to a plurality of video lines 409. Each of the plurality of video lines 409 is connected to the plurality of pixels 102 located in the mth column in the display section 104. A gray-scale signal Vsig (m) (FIG. 4) is supplied to each of the plurality of video lines 409. The plurality of video lines 409 is a video line SL (1), a video line SL (2), . . . , and a video line SL (m). For example, the gray-scale signal Vsig (1) is supplied to the first video line SL (1), the gray-scale signal Vsig (2) is supplied to the second video line SL (2), the gray-scale signal Vsig (m-2) is supplied to the m-second video line SL (m-2), the gray-scale signal Vsig (m-1) is supplied to the m-first video line SL (m-1), and the gray-scale signal Vsig (m) is supplied to the mth video line SL (m). A drive power supply line PVDD1 is commonly connected to the plurality of pixels 102. The drive voltage VDDH1 (FIG. 3) is supplied to the drive power supply line PVDD1.

The erasing signal line drive circuit 108 is connected to a plurality of erasing lines 416. The erasing signal line drive circuit 108 uses the erase control signal to generate an erasing signal EG (n). Each of the plurality of erasing lines 416 is connected to the plurality of pixels 102 located in the nth row in the display section 104. The erasing signal EG (n) is supplied to each of the plurality of erasing lines 416. For example, the erasing signal EG (1) is supplied to the first erasing line, the erasing signal EG (2) is supplied to the second erasing line, the erasing signal EG (n-1) is supplied to the (n-1)th erasing line, and the erasing signal EG (n) is supplied to the nth erasing line.

In an embodiment of the present invention, for example, an external circuit such as a power supply circuit (not shown) is connected to a common power supply line, and a common power supply line COM is connected to a common power supply line 430. The common voltage VCOM is supplied to the common power supply line COM from the external circuit. In an embodiment of the present invention, an example is shown in which the video signal line drive circuit 106 is connected to the drive power supply line PVDD1. In the video signal line drive circuit 106, the drive power supply line PVDD1 is connected to the external circuit (not shown), and the drive voltage VDDH1 (FIG. 3) may be supplied to the drive power supply line PVDD1 from the external circuit. In an embodiment of the present invention, the value m is any integer greater than or equal to 1. In an embodiment of the present invention, the value n is any integer greater than or equal to 1. For example, the value m is 12 and the value n is 4.

<1-2. Configuration of Pixel 102>

Figure 4:
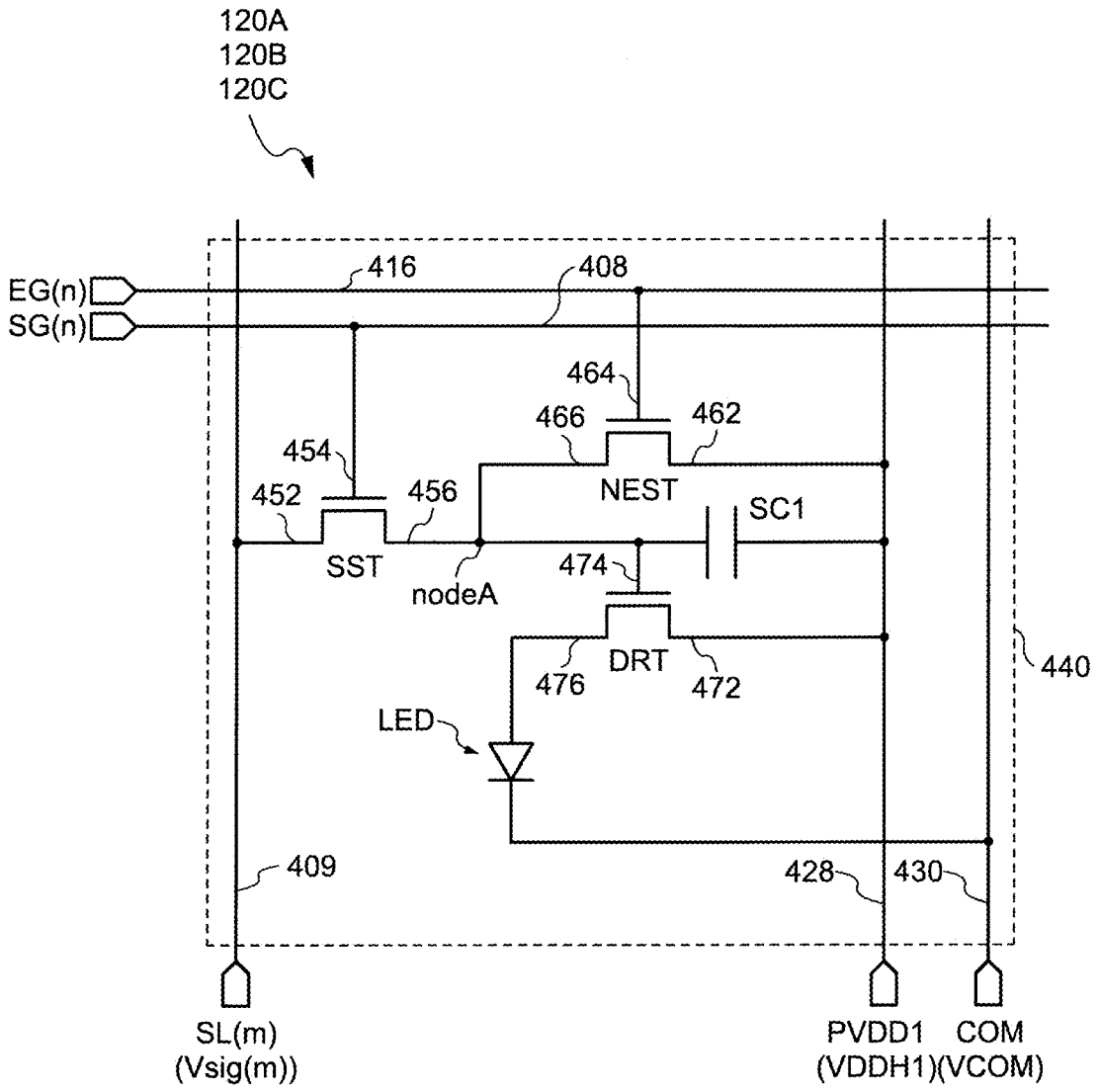
FIG. 4 is a circuit diagram showing a light-emitting element drive section of a sub-pixel according to an embodiment of the present invention.

FIG. 3 is a plan view showing a configuration of the pixel 102 according to an embodiment of the present invention. FIG. 4 is a circuit diagram showing the light-emitting element drive section of the sub-pixel 120A, the sub-pixel 120B, and the sub-pixel 120C according to an embodiment of the present invention. FIGS. 3 and 4 show the configuration of the pixels 102, the sub-pixel 120A, the sub-pixel 120B, and the sub-pixel 120C of the n-row and m-column shown in FIG. 2. The configuration of the pixel 102, the sub-pixel 120A, the sub-pixel 120B, and the sub-pixel 120C shown in FIGS. 3 and 4 is an example, and the configuration of the pixel 102, the sub-pixel 120A, the sub-pixel 120B, and the sub-pixel 120C is not limited to the configuration shown in FIGS. 3 and 4. The same or similar components as those in FIGS. 1 and 2 will not be described here.

As shown in FIG. 3, the pixel 102 has, for example, the sub-pixel 120A, the sub-pixel 120B, and the sub-pixel 120C.

The sub-pixel 120A has a light-emitting element RLED. The light-emitting element RLED is a red light-emitting diode. The sub-pixel 120B has a light-emitting element GLED. The light-emitting element GLED is a green light-emitting diode. The sub-pixel 120C has a light-emitting element BLED. The light-emitting element BLED is a blue light-emitting diode. The shapes of the light-emitting element RLED, the shape of the light-emitting element GLED, and the shape of the light-emitting element BLED are, for example, square.

In an embodiment of the present invention, although an example is shown in which one pixel 102 has three sub-pixels, the configuration of the pixel and the sub-pixel is not limited to the example shown here. For example, the pixel 102 may have more than four sub-pixels. Specifically, in addition to the three sub-pixels according to an embodiment of the present invention, a sub-pixel having a yellow light-emitting diode may be included. By having four sub-pixels, the display device can display video with more colors on a high-definition display section.

As shown in FIG. 4, the sub-pixel 120 has a light-emitting element drive section 440. The light-emitting element drive section 440 includes a drive transistor DRT, a select transistor SST (first switch), an erase transistor NEST (second switch), a storage capacity element SC1, and the light-emitting element LED. Each of these transistors has a first electrode (gate electrode), and a pair of electrodes consisting of a second electrode and a third electrode (source electrode, drain electrode). The storage capacity element SC1 has a pair of electrodes. The scanning line 408 is connected to the scan signal line drive circuit 110 (FIG. 2), the video line 409 is connected to the video signal line drive circuit 106 (FIG. 2), the erasing line 416 is connected to the erasing signal line drive circuit 108 (FIG. 2), the common power supply line COM is connected to the common power supply line 430, and the drive power supply line PVDD1 is connected to the video signal line drive circuit 106.

As a power supply driving the sub-pixel 120, the drive voltage VDDH1 is supplied from the drive power supply line PVDD1 and the common voltage VCOM is supplied from the common power supply line COM.

The select transistor SST has a function for supplying the gray-scale signal to a first electrode (gate electrode) 474 of the drive transistor DRT. The drive transistor DRT and the light-emitting element LED are provided between the drive power supply line PVDD1 and the common power supply line COM. The drive transistor DRT uses the gray-scale signal input to the first electrode (gate electrode) 474 to flow a current corresponding to the gray-scale signal through a second electrode 472 (source electrode 472) and a third electrode 476 (drain electrode 476) of the drive transistor DRT. Consequently, the drive transistor DRT uses the input gray-scale signal to supply a current corresponding to the gray-scale signal to the light-emitting element LED. This makes the light-emitting element LED emit light. The erase transistor NEST supplies the drive voltage VDDH1 to the first electrode (gate electrode) 474 of the drive transistor DRT, and the second electrode 472 of the drive transistor DRT (source electrode 472) or the like. Consequently, the erase transistor NEST has a function for turning off the drive transistor DRT, not passing a current through the light-emitting element LED, and making the light-emitting element LED non-light emitting. The light-emitting element LED has diode characteristics. The voltage supplied to the drive power supply line PVDD1 is not limited to the drive voltage VDDH1. The voltage supplied to the drive power supply line PVDD1, for example, may be the common voltage VCOM, may be the reference voltage VSS, and may be other constant voltages.

The storage capacity element SC1 has a function for maintaining a voltage input to the first electrode 474 (gate electrode 474) of the drive transistor DRT for the pixel 102 to emit light. That is, the storage capacity element SC1 has a function for holding a charge corresponding to the input gray-scale signal. The storage capacity element SC1 holds the charge corresponding to the input gray-scale signal so that the drive transistor DRT can flow a constant current from the second electrode 472 to the third electrode 476 of the drive transistor DRT. Consequently, since the drive transistor DRT flows a constant current through the light-emitting element LED, the light-emitting element LED can emit light at a constant emission intensity with suppressed variations in each sub-frame period.

A gate electrode 464 of the erase transistor NEST is electrically connected to the erasing line 416. The erasing line 416 is supplied with an erasing signal EG (n). The erase transistor NEST is controlled in a conductive state and a non-conductive state by the signal supplied to the erasing signal EG (n). When the signal supplied to the erasing signal EG (n) is at a low level (Low Level, L level), the erase transistor NEST is in a non-conductive state. When the signal supplied to the erasing signal EG (n) is at a high level (High Level, H level), the erase transistor NEST is in a conductive state. A source electrode 462 of the erase transistor NEST is electrically connected to the drive power supply line PVDD1. The drive power supply line PVDD1 is supplied with the drive voltage VDDH1. A drain electrode 466 of the erase transistor NEST is electrically connected to a nodal node A, the gate electrode 474 of the drive transistor DRT, a drain electrode 456 of the select transistor SST, and the first electrode of the storage capacity element SC1. The second electrode of the storage capacity element SC1 is electrically connected to the source electrode 472 of the drive transistor DRT, and the source electrode 462 of the erase transistor NEST.

The gate electrode of the select transistor SST is electrically connected to the scanning line 408. The scanning line 408 is supplied with the scan signal SG (n). The select transistor SST is controlled in a conductive state and a non-conductive state by the signal supplied to the scan signal SG (n). When the signal supplied to the scan signal SG (n) is at the L level, the select transistor SST is in a non-conductive state. When the signal supplied to the scan signal SG (n) is at the H level, the select transistor SST is in a conductive state. A source electrode 452 of the select transistor SST is electrically connected to the video line 409. The video line 409 is supplied with the gray-scale signal Vsig (m).

The drain electrode 476 of the drive transistor DRT is electrically connected to the first electrode of the light-emitting element LED. The second electrode of the light-emitting element LED is electrically connected to the common power supply line COM. The drive power supply line PVDD1 is a drive power supply line 428, and the common power supply line COM is the common power supply line 430. The first electrode of the light-emitting element LED is sometimes referred to as the anode, and the second electrode of the light-emitting element LED is sometimes referred to as the cathode.

In an embodiment of the present invention, the conductive state means that the source electrode and the drain electrode of the transistor are conductive, and the transistor is turned on (ON). In the present specification or the like, the non-conductive state means that the source electrode and the drain electrode of the transistor are non-conductive, and the transistor is turned off (OFF). In each transistor, the source electrode and the drain electrode may be replaced depending on the voltage of each electrode. It will be readily understood by a person skilled in the art that even when the transistor is in the off state, a slight current flows such as a leakage current.

<1-3. Driving Method of Light-Emitting Device 10>

Figure 5:
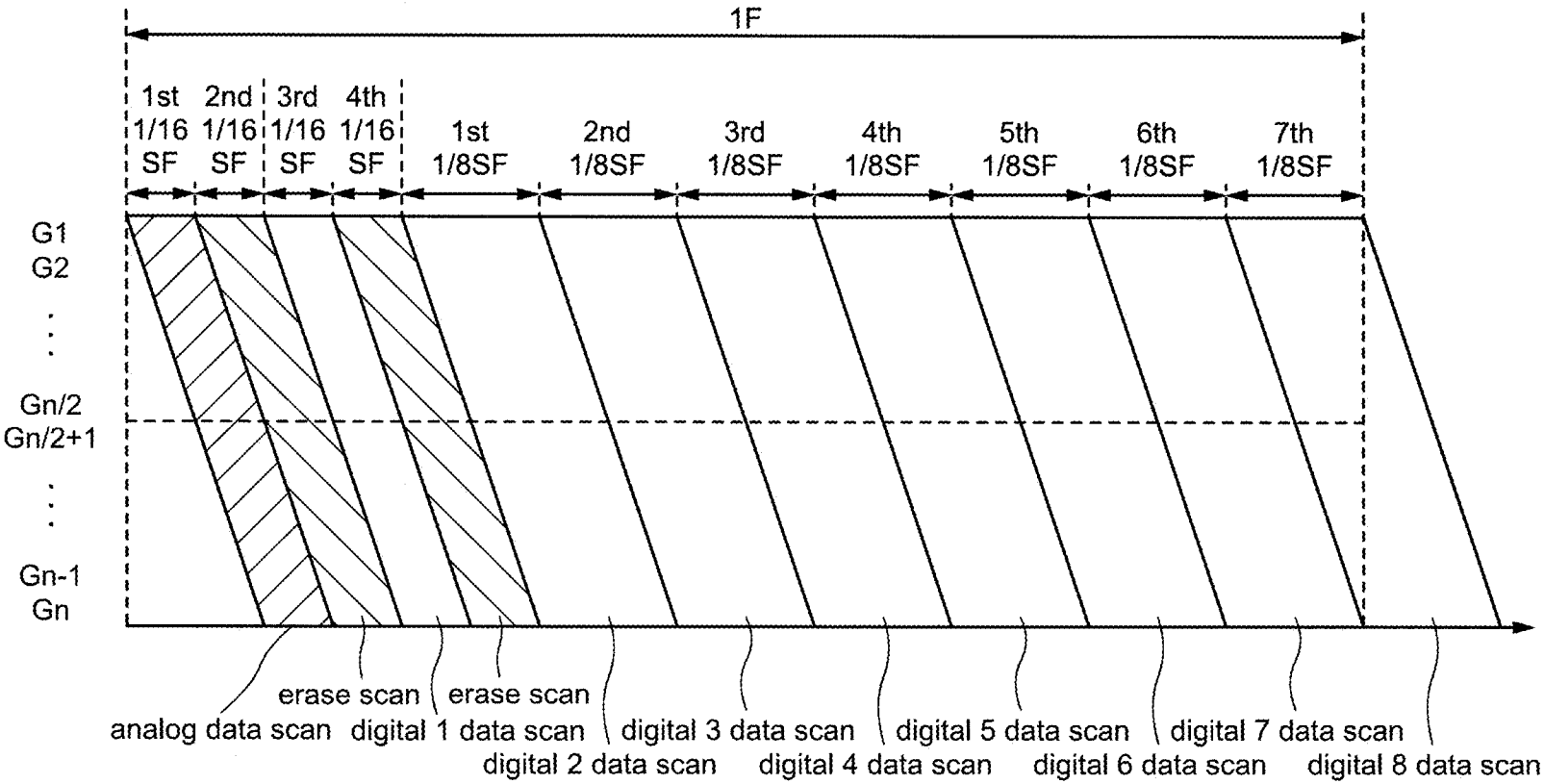
FIG. 5 is a timing chart for explaining a driving method of a light-emitting device according to an embodiment of the present invention.
Figure 10:
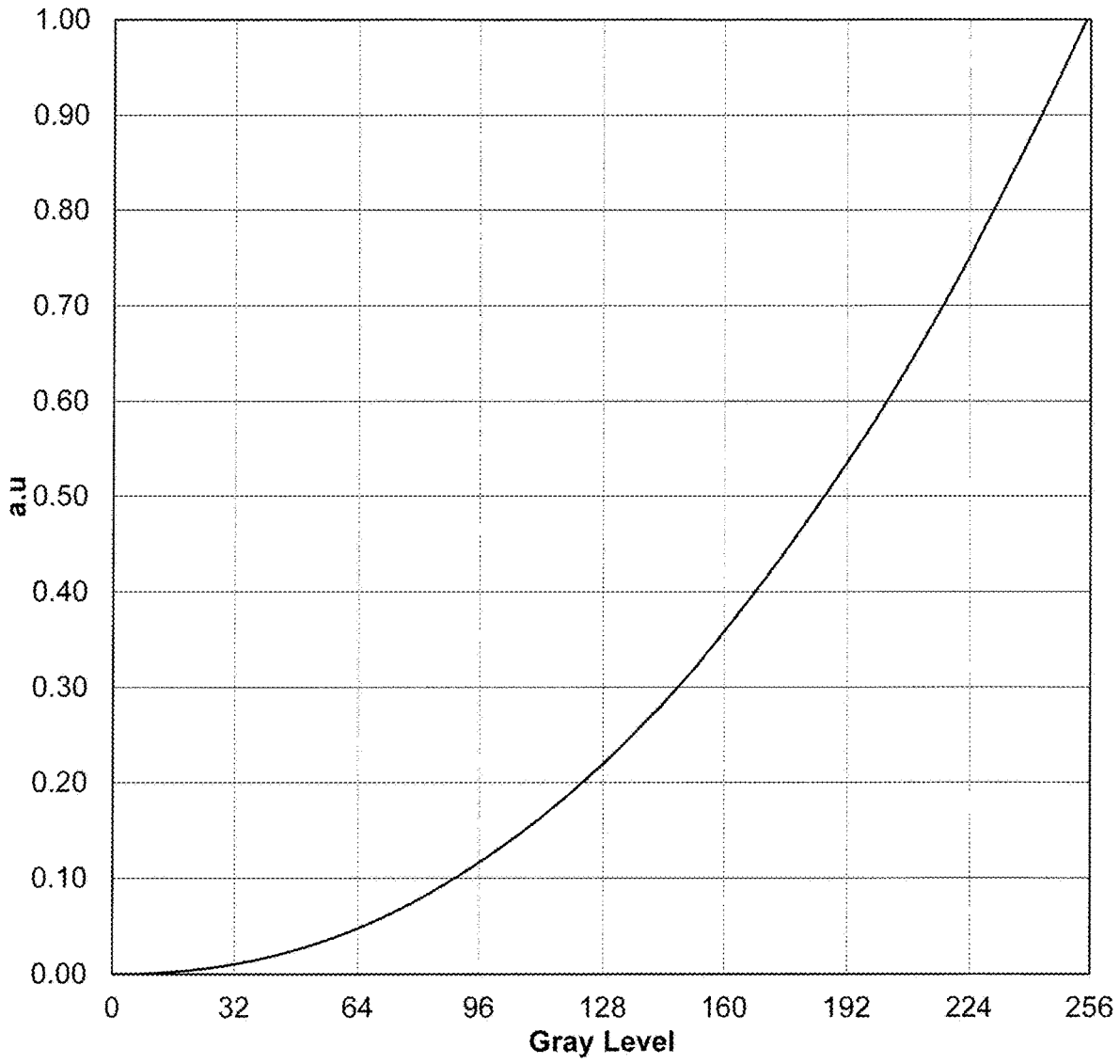
FIG. 10 is a diagram showing normalized values of luminance for each gray-scale according to an embodiment of the present invention.

FIG. 5 is a timing chart for explaining a driving method of the light-emitting device 10 according to an embodiment of the present invention. FIG. 6 is a diagram showing gray-scales (0 to 63 gray-scales) of pixels and data corresponding to each gray-scale according to an embodiment of the present invention. FIG. 7 is a diagram showing gray-scales (64 to 127 gray-scales) of pixels and data corresponding to each gray-scale according to an embodiment of the present invention. FIG. 8 is a diagram showing gray-scales (128 to 191 gray-scales) of pixels and data corresponding to each gray-scale according to an embodiment of the present invention. FIG. 9 is a diagram showing gray-scales (192 to 255 gray-scales) of pixels and data corresponding to each gray-scale according to an embodiment of the present invention. FIG. 10 is a diagram showing normalized values of luminance for each gray-scale according to an embodiment of the present invention. The driving method or the like of the light-emitting device 10 shown in FIGS. 5 to 10 is an example, and the driving method or the like of the light-emitting device 10 is not limited to the method or the like shown in FIGS. 5 to 10.

As shown in FIG. 5, in an embodiment of the present invention, one frame (1F) period is composed of 11 sub-frame (11SF) periods. 11SF is composed of four 1/16SF (first 1/16SF (1st1/16SF), second 1/16SF (2nd1/16SF), third 1/16SF (3rd1/16SF), fourth 1/16SF (4th1/16SF)) obtained by dividing the light emission period in the 1F period into 1/16, and seven 1/8SF (first 1/8SF (1st1/8SF), second 1/8SF (2nd1/8SF), third 1/8SF (3rd1/8SF), fourth 1/OJ (4th1/8SF), fifth 1/8SF (5th1/8SF), sixth 1/8SF (6th 8SF), and seventh 1/8SF (7th1/8SF)) obtained by dividing the light emission period in the 1F period into 1/8.

For example, in an embodiment of the present invention, a first scanning line G1 to an nth scanning line Gn are sequentially scanned in each SF. The pixel electrically connected to each scanning line receives the gray-scale signal, and the light-emitting element LED included in each pixel flows a current corresponding to the gray-scale signal. Consequently, the light-emitting element LED included in each pixel emits light with the emission intensity corresponding to the gray-scale signal.

As shown in FIG. 5, in the driving method of the light-emitting device 10 according to an embodiment of the present invention, in the first 1/16SF period, the scan signal line drive circuit 110 scans each scanning line and the video signal line drive circuit 106 supplies the gray-scale signal Vsig including analog data to pixels electrically connected to each scanning line. In the driving method of the light-emitting device 10 according to an embodiment of the present invention, the operation in the first 1/16SF period is a period for analog-controlling the luminance of the light-emitting element LED using the analog data. In the driving method of the light-emitting device 10 according to an embodiment of the present invention, the operation in the first 1/16SF period is referred to as, for example, an analog data scan. In an embodiment of the present invention, the period in which the analog data scan is performed (analog data scan period) is a period in which the analog gray-scale data is supplied to the pixels and is an analog gray-scale displaying period. In an embodiment of the present invention, the analog data scan may be referred to as an analog gray-scale data scan or an analog gray-scale display.

In the second 1/16SF period following the first 1/16SF period, the erasing signal line drive circuit 108 scans each erasing line to make the gate and source voltages of the drive transistor the drive voltage VDDH1, at the same time, the video signal line drive circuit 106 stops the rewrite drive for rewriting the gray-scale signal. Consequently, the erase transistor NEST (FIG. 4) turns off the drive transistor DRT (FIG. 4) and does not flow a current through the light-emitting element LED (FIG. 4), and the light-emitting element LED does not emit light. That is, in the second 1/16SF period, the display section 104 displays black. In the driving method of the light-emitting device 10 according to an embodiment of the present invention, the operation in the second 1/16SF period is referred to as, for example, an erase scan. In an embodiment of the present invention, the period (erasing period) during which the erase scan is performed is a period during which the analog gray-scale data or the first digital gray-scale data included in the gray-scale data is erased, and is a gray-scale data erasing period, an analog gray-scale data erasing period, and a first digital gray-scale data erasing period.

In the third 1/16SF period following the second 1/16SF period, the scan signal line drive circuit 110 scans each scanning line, and the video signal line drive circuit 106 supplies a binary gray-scale signal including the first control signal to the pixels electrically connected to each scanning line. In the driving method of the present light-emitting device 10 according to an embodiment of the present invention, the third 1/16SF period is a period for controlling the light emission or non-light emission in the 1/16SF period in the time division control method. The operation in the third 1/16SF period is referred to as, for example, a first digital data scan (1st digital data scan, digital 1 data scan, D1). In an embodiment of the present invention, the period during which the first digital data scan is performed is a period during which the first digital data is scanned and is a first digital data scan period or a first digital gray-scale data scan period. In an embodiment of the present invention, the first digital data scan may be referred to as a first digital gray-scale data scan or a first digital gray-scale display.

In the fourth 1/16SF period following the third 1/16SF period, the same scan as in the second 1/16SF period is performed, and therefore, detailed descriptions thereof are omitted here. In the driving method of the light-emitting device 10 according to an embodiment of the present invention, the operation of the fourth 1/16SF period is referred to as, for example, the erase scan.

For example, when the first digital data scan is performed in the second 1/16SF period following the first 1/16SF period, a period occurs in which the light emission or non-light emission in the first 1/16SF period and the light emission or non-light emission in the second 1/16SF period overlap. As a result, the light-emitting device cannot display an accurate image based on the gray-scale signal. The light-emitting device 10 according to an embodiment of the present invention may perform the erase scan in the second 1/16SF period following the first 1/16SF period, and then perform the first digital data scan after performing the erase scan. As a result, the light-emitting device 10 according to an embodiment of the present invention can suppress overlapping of the periods corresponding to the light emission or non-light emission and can display an accurate image based on the gray-scale signal.

In the first 1/8SF period following the fourth 1/16SF period, the scan signal line drive circuit 110 scans each scanning line, and the video signal line drive circuit 106 supplies a binary gray-scale signal including a second control signal to the pixels electrically connected to each scanning line. In the driving method of the light-emitting device 10 according to an embodiment of the present invention, the first 1/8SF period is a period for controlling the light emission or non-light emission in the 1/8SF period in the time division control method. The length of the first 1/8SF period is twice the length of the first 1/16SF period and the length of the third 1/16SF period. The operation in the first 1/8SF period is referred to as, for example, a second digital data scan (2nd digital data scan, digital 2 data scan, D2). In an embodiment of the present invention, the period during which the second digital data scan is performed is a period during which the second digital data is scanned and is a second digital data scan period, or a second digital gray-scale data scan period. In an embodiment of the present invention, the second digital data scan may be referred to as a second digital gray-scale data scan or a second digital gray-scale display.

In the second 1/8SF period following the first 1/8SF period, the same scan as in the first 1/8SF period is performed, and therefore, detailed descriptions thereof are omitted here. In the second 1/8SF period, the video signal line drive circuit 106 supplies a binary gray-scale signal including a third control signal to the pixels electrically connected to each scanning line. The operation in the second 1/8SF period is referred to as, for example, a third digital data scan (3rd digital data scan, digital 3 data scan, D3). In an embodiment of the present invention, the period during which the third digital data scan is performed is a period during which the third digital data is scanned and is a third digital data scan period or a third digital gray-scale data scan period. In an embodiment of the present invention, the third digital data scan may be referred to as the third digital gray-scale data scan or a third digital gray-scale display.

In the third 1/8SF period following the second 1/8SF period, the same scan as in the first 1/8SF period is performed, and therefore, detailed descriptions thereof are omitted here. In the third 1/8SF period, the video signal line drive circuit 106 supplies a binary gray-scale signal including a fourth control signal to the pixels electrically connected to each scanning line. The operation in the third 1/8SF period is referred to as, for example, a fourth digital data scan (4th digital data scan, digital 4data scan, D4). In an embodiment of the present invention, the period during which the fourth digital data scan is performed is a period during which the fourth digital data is scanned and is a fourth digital data scan period or a fourth digital gray-scale data scan period. In an embodiment of the present invention, the fourth digital data scan may be referred to as a fourth digital gray-scale data scan or a fourth digital gray-scale display.

In the fourth 1/8SF period following the third 1/8SF period, the same scan as in the first 1/8SF period is performed, and therefore, detailed descriptions thereof are omitted here. In a fourth 1/8SF period, the video signal line drive circuit 106 supplies a binary gray-scale signal including a fifth control signal to the pixels electrically connected to each scanning line. The operation in the fourth 1/8SF period is referred to as, for example, a fifth digital data scan (5th digital data scan, digital 5 data scan, D5). In an embodiment of the present invention, the period during which the fifth digital data scan is performed is a period during which the fifth digital data is scanned and is a fifth digital data scan period or a fifth digital gray-scale data scan period. In an embodiment of the present invention, the fifth digital data scan may be referred to as a fifth digital gray-scale data scan or a fifth digital gray-scale display.

In the fifth 1/8SF period following the fourth 1/8SF period, the same scan as in the first 1/8SF period is performed, and therefore, detailed descriptions thereof are omitted here. In the fifth 1/8SF period, the video signal line drive circuit 106 supplies a binary gray-scale signal including a sixth control signal to the pixels electrically connected to each scanning line. The operation in the fifth 1/8SF period is referred to as, for example, a sixth digital data scan (6th digital data scan, digital 6 data scan, D6). In an embodiment of the present invention, the period during which the sixth digital data scan is performed is the period during which the sixth digital data is scanned and is a sixth digital data scan period, or a sixth digital gray-scale data scan period. In an embodiment of the present invention, the sixth digital data scan may be referred to as a sixth digital gray-scale data scan or a sixth digital gray-scale display.

In the sixth 1/8SF period following the fifth 1/8SF period, the same scan as in the first 1/8SF period is performed, and therefore, detailed descriptions thereof are omitted here. In the sixth 1/8SF period, the video signal line drive circuit 106 supplies a binary gray-scale signal including a seventh control signal to the pixels electrically connected to each scanning line. The operation in the sixth 1/8SF period is referred to as, for example, a seventh digital data scan (7th digital data scan, digital 7 data scan, D7). In an embodiment, the period during which the seventh digital data scan is performed is a period during which the seventh digital data is scanned and is a seventh digital data scan period or a seventh digital gray-scale data scan period. In an embodiment of the present invention, the seventh digital data scan may be referred to as a seventh digital gray-scale data scan or a seventh digital gray-scale display.

In the seventh 1/8SF period following the sixth 1/8SF period, the same scan as in the first 1/8SF period is performed, and therefore, detailed descriptions thereof are omitted here. In the seventh 1/8SF period, the video signal line drive circuit 106 supplies the binary gray-scale signal containing the eighth control signal to the pixels electrically connected to each scanning line. The operation in the seventh 1/8SF period is referred to as, for example, an eighth digital data scan (8th digital data scan, digital 8 data scan, D7). In an embodiment of the present invention, the period during which the eighth digital data scan is performed is the period during which the eighth digital data is scanned and is an eighth digital data scan period, or an eighth digital gray-scale data scan period. In an embodiment of the present invention, the eighth digital data scan may be referred to as an eighth digital gray-scale data scan or an eighth digital gray-scale display.

FIGS. 6 to 9 are diagrams showing gray-scales (0 to 256 gray-scales) of pixels and data corresponding to the gray-scales in 11 columns and 256 rows. In the first column shown in FIGS. 6 to 9, the gray-scale level (Gray Level) of the gray-scale signals is indicated by 256 levels. The second column shows the normalized luminance when each gray-scale level shown in the first column is gamma corrected with a gamma value of 2.2. The normalized luminance shown in the second column is the luminance corrected according to a gamma curve having a gamma value of 2.2 shown in FIG. 10. Specifically, when the gray-scale level is divided into 1 to 255 steps, the normalized luminance does not increase in direct proportion to the gray-scale level but is luminance corrected along the gamma curve having a gamma value of 2.2 (FIG. 10). For example, the normalized luminance of the gray-scale level 127 becomes half the luminance of the total luminance at 0.5 if the gamma value is 1. In the present embodiment, the gamma value is 2.2, and the normalized luminance of the gray-scale level 127 after correction is 0.2158. That is, the normalized luminance after correction is 1/4 or less of the total luminance.

In the fourth column, light emission (indicated by the symbol "O") or non-light emission (indicated by the symbol "X") of the first control signal corresponding to the gray-scale levels shown in the first column is shown. The first control signal is one of the time division gray-scale signals in the first digital data scan (D1). The first digital data scan is the operation for controlling emission and non-emission of light in 1/16SF period and includes a level of 4 bits (16 steps).

In the fifth column, light emission (indicated by the symbol "O") or non-light emission (indicated by the symbol "X") of the second control signal corresponding to the gray-scale levels shown in the first column is shown. The second control signal is one of the time division gray-scale signals in the second digital data scan (D2).

In the sixth column, light emission (indicated by the symbol "O") or non-light emission (indicated by the symbol "X") of the third control signal corresponding to the gray-scale levels shown in the first column is shown. The third control signal is one of the time division gray-scale signals in the third digital data scan (D3).

In the seventh column, light emission (indicated by the symbol "O") or non-light emission (indicated by the symbol "X") of the fourth control signal corresponding to the gray-scale levels shown in the first column is shown. The fourth control signal is one of the time division gray-scale signals in the fourth digital data scan (D4).

In the eighth column, light emission (indicated by the symbol "O") or non-light emission (indicated by the symbol "X") of the fifth control signal corresponding to the gray-scale levels shown in the first column are shown. The fifth control signal is one of the time division gray-scale signals in the fifth digital data scan (D5).

In the ninth column, light emission (indicated by the symbol "O") or non-light emission (indicated by the symbol "X") of the sixth control signal corresponding to the gray-scale levels shown in the first column is shown. The sixth control signal is one of the time division gray-scale signals in the sixth digital data scan (D6).

In the tenth column, light emission (indicated by the symbol "O") or non-light emission (indicated by the symbol "X") of the seventh control signal corresponding to the gray-scale levels shown in the first column is shown. The seventh control signal is one of the time division gray-scale signals in the seventh digital data scan (D7).

In the eleventh column, light emission (indicated by the symbol "O") or non-light emission (indicated by the symbol "X") of the eighth control signal corresponding to the gray-scale levels shown in the first column is shown. The eighth control signal is one of the time division gray-scale signals in the eighth digital data scan (D8).

Each of the second digital data scan to the eighth digital data scan is the operation for controlling the emission or non-emission of light in 1/8SF periods and includes the level of 1 bit (2 steps).

In the third column, the levels of the gray-scale signals including analog data (Analog) corresponding to the gray-scale levels shown in the first column are shown. The analogue data (Analog) includes several gray-scales to several tens of gray-scales or several gray-scales to hundreds of gray-scales, such as the data of 8 gray-scales and 256 gray-scales (256 steps). For example, the timing control circuit 30 generates a voltage corresponding to the analog gray-scale shown in the table (shown FIGS. 6 to 9) in the analog data scan and supplies the generated voltage to a pixel circuit. In the explanation using FIG. 6, although the analogue data (Analog) is the gray-scale signal based on the gamma value of 2.2, it may also be linear data of 256 gray-scales (=gamma value of 1.0).

In an embodiment of the present invention, the analog data scan is performed at 1/16SF, the first digital data scan (D1) is performed at 1/16SF, and the second to seventh digital data scans (D7) are performed at seven times of 1/8SF. The analog data scan may represent an 8bits gray-scale level, and the first to seventh digital data scans may represent a 4 bits gray-scale level. As a result, the light-emitting device 10 according to an embodiment of the present invention can display a gray-scale of a total of 12 bits (8 bits+4 bits).

The light-emitting device 10 according to an embodiment of the present invention, calculates and selects one gray-scale level for at least one pixel electrically connected to one scanning line in one frame with reference to the timing control circuit 30 and the storage device 20. As a result, for example, when a gray-scale level of 211 steps is selected for at least one pixel electrically connected to the first scanning line G1, in the analog data scan in 1/16SF, the gray-scale signal corresponding to 0.547 is input to the at least one pixel, in the first digital data scan (D1) in 1/16SF, the first control signal corresponding to the non-light emission (indicated by the symbol "X") is input to the at least one pixel, in the second digital data scan (D2) in 1/8SF, the second control signal corresponding to the light emission (indicated by the symbol "O") is input to the at least one pixel, in the third digital data scan (D3) in 1/8SF, the third control signal corresponding to the light emission (indicated by the symbol "O") is input to the pixel electrically connected to the first scanning line G1, in the fourth digital data scan (D4) in 1/8SF, the fourth control signal corresponding to the light emission (indicated by the symbol "O") is input to the at least one pixel, in the fifth digital data scan (D5) in 1/8SF, the fifth control signal corresponding to the light emission (indicated by the symbol "O") is input to the at least one pixel, in the sixth digital data scan in 1/8SF (D6), the sixth control signal corresponding to the light emission (indicated by the symbol "O") is input to the at least one pixel, in the seventh digital data scan in 1/8SF (D7), and the seventh control signal corresponding to the non-light emission (indicated by the symbol "X") is input to the at least one pixel. As a consequence, the light-emitting element LED of at least one pixel electrically connected to the first scanning line G1 will emit at a gray-scale level (0.6592) of 211 steps when viewed throughout a frame. Alternatively, the user recognizes (visually recognizes) that the pixel emits light at the gray-scale level (0.6592) of 211 steps over the one frame.

In the light-emitting device 10 and the driving method of the light-emitting device 10 according to an embodiment of the present invention, in one 1/16SF period of the 1F period, the analog data scanning can be performed, and the light emission or non-light emission of the light-emitting element LED of the pixels electrically connected to each scanning line can be analog-controlled using the analog data. Consequently, the light-emitting device 10 and the driving method of the light-emitting device 10 according to an embodiment of the present invention can control the low gray-scale required for minute voltage or current control using the analog data. For example, the current flown through the light-emitting element LED can be increased 16 times. Therefore, by using the light-emitting device 10 and the driving method of the light-emitting device 10 according to an embodiment of the present invention, it is possible to smoothly display a low gray-scale and display a stable image on the display section.

In the light-emitting device 10 and the driving method of the light-emitting device 10 according to an embodiment of the present invention, the first digital data scan to the eighth digital data scan are performed, and the light emission or non-light emission of the light-emitting element LED of the pixels electrically connected to each scanning line can be digital-controlled using the time division control method. That is, in the light-emitting device 10 and the driving method of the light-emitting device 10 according to an embodiment of the present invention, it is possible to use both the analog control and the digital control (the time division control method). As a result, the light-emitting device 10 and the driving method of the light-emitting device 10 according to an embodiment of the present invention can display a high gray-scale of 12 bits after suppressing the number of scans. Therefore, by using the light-emitting device 10 and the driving method of the light-emitting device 10 according to an embodiment of the present invention, it is possible to suppress deterioration of the image quality of the light-emitting device 10 and display an image in which the number of gray-scales is increased on the display section of the light-emitting device 10.

2. Second Embodiment

Figure 11:
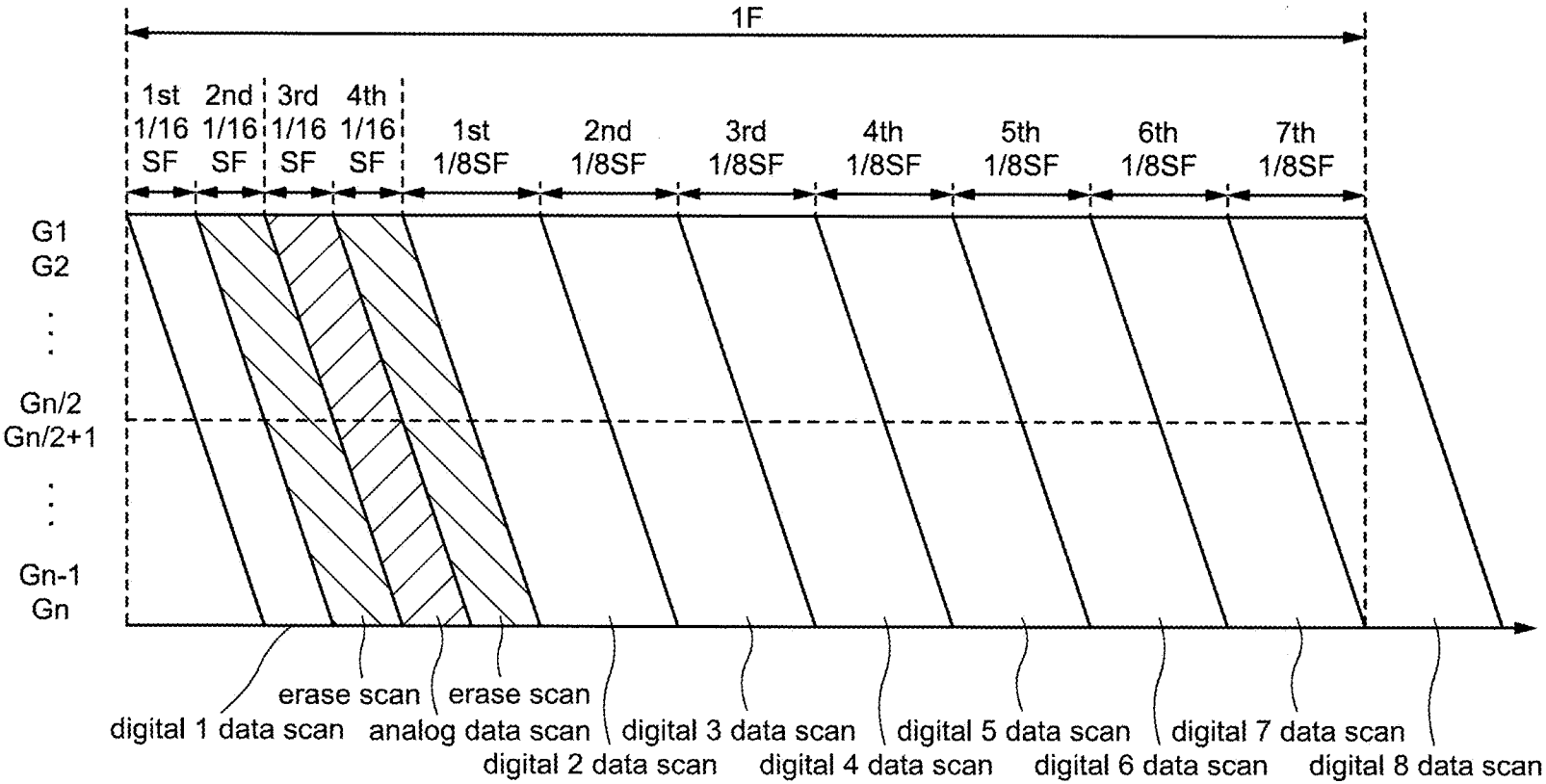
FIG. 11 is a timing chart for explaining a driving method of a light-emitting device according to an embodiment of the present invention.
Figure 12:
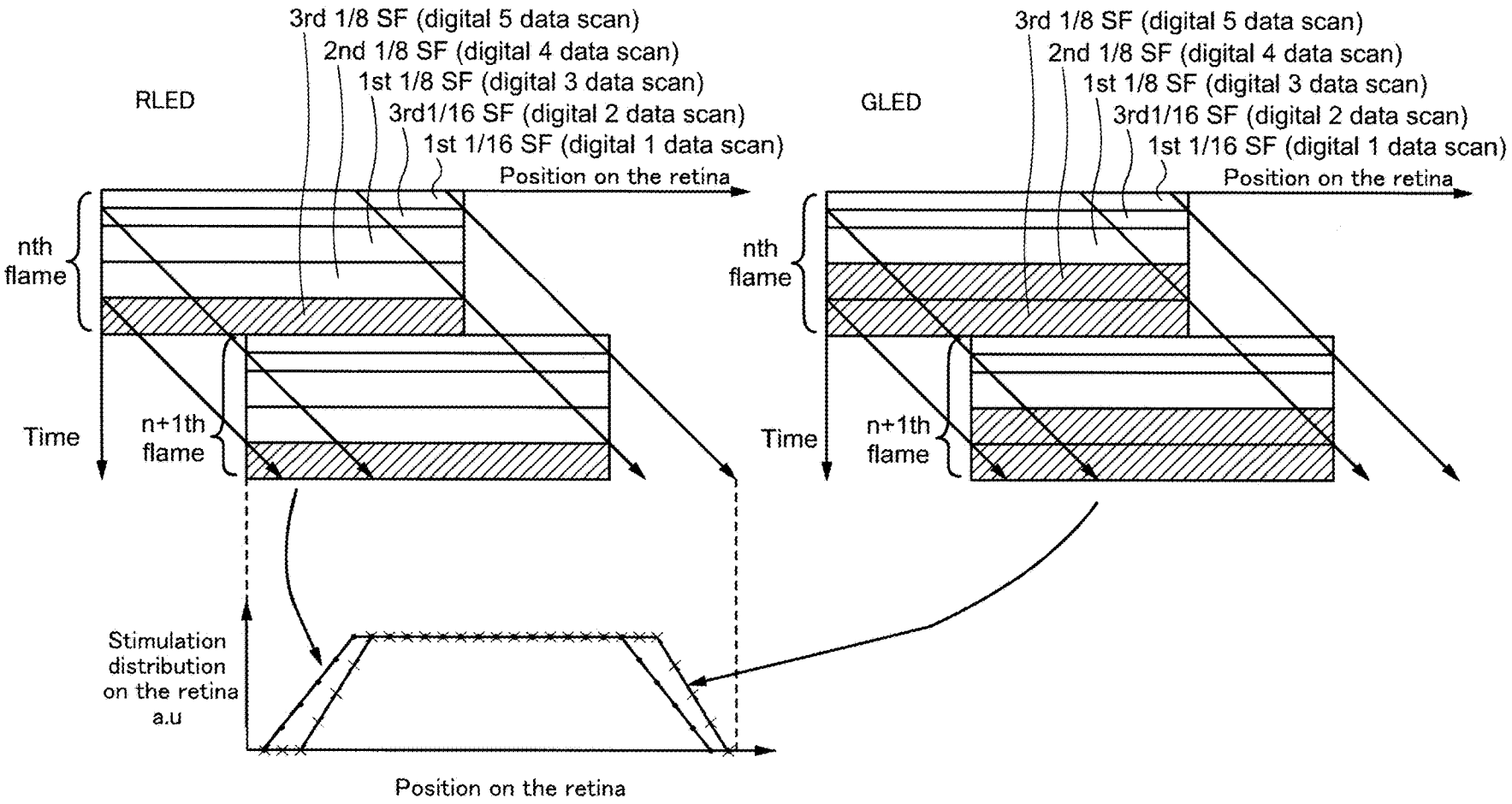
FIG. 12 is a diagram for explaining a locus of luminescence on a retina when a plurality of pixels is made to emit light or not to emit light.
Figure 13:
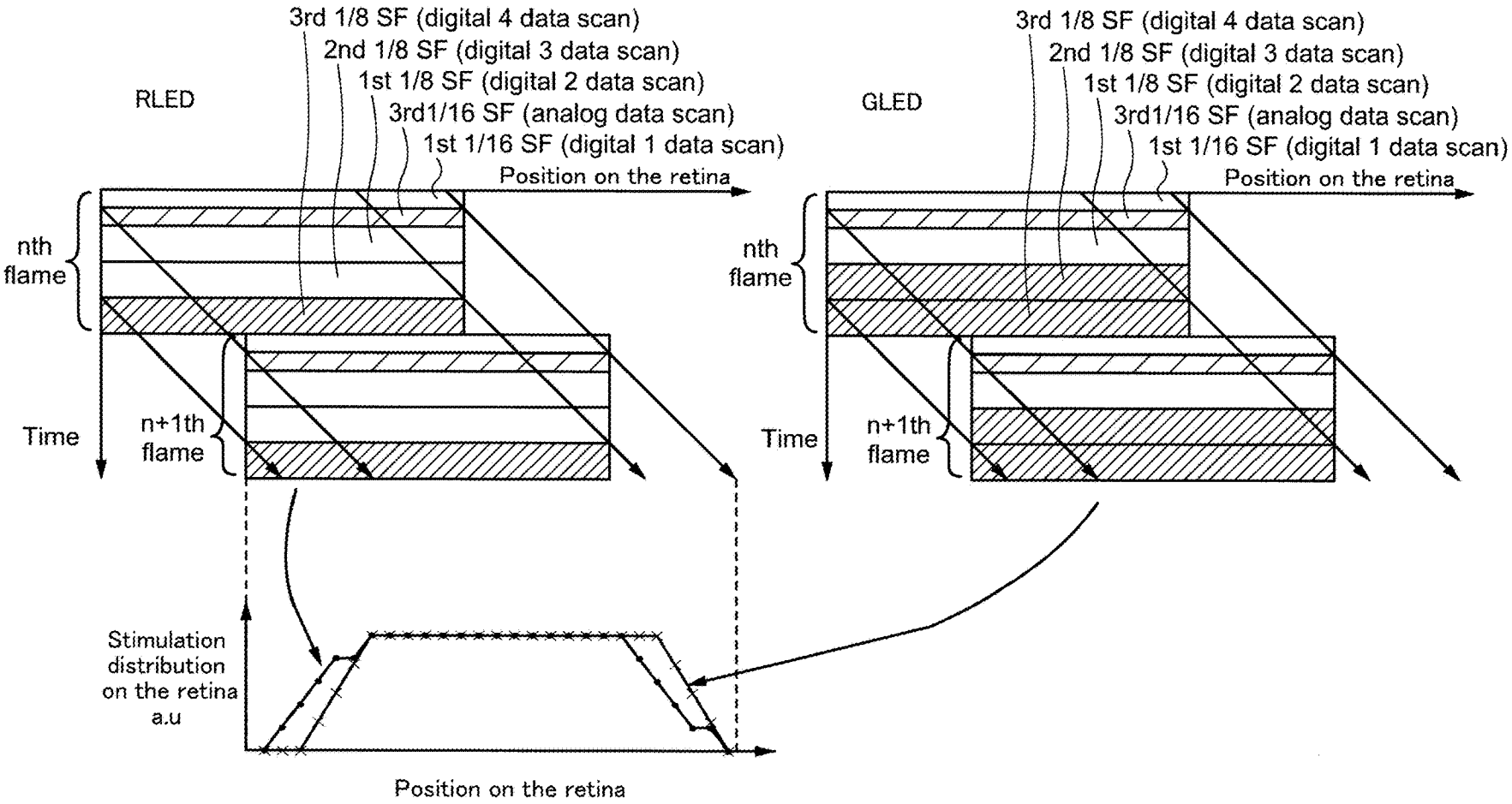
FIG. 13 is a diagram for explaining a locus of luminescence on a retina when a plurality of pixels is made to emit light or not to emit light according to an embodiment of the present invention.

FIG. 11 is a timing chart for explaining the driving method of the light-emitting device 10 according to an embodiment of the present invention. FIG. 12 is a comparative example of FIG. 13 and is a diagram for explaining a locus of luminescence on a retina when a plurality of pixels is made to emit or not to emit light without executing the driving method according to an embodiment of the present invention. FIG. 13 is a diagram for explaining a locus of luminescence on a retina when a plurality of pixels is made to emit light or not to emit light by executing the driving method according to an embodiment of the present invention. The driving method or the like shown in FIGS. 11 to 13 is an example, and the driving method or the like of the light-emitting device 10 is not limited to the method or the like shown in FIGS. 11 to 13. Description of the same or similar components as those of the first embodiment is omitted here.

The driving method shown in FIG. 11 is different from the driving method shown in FIG. 5 in the point that the scan signal line drive circuit 110 scans each scanning line in the first 1/16SF period, the video signal line drive circuit 106 supplies the gray-scale signal including the first control signal to the pixels electrically connected to each scanning line in the first 1/16SF period, the scan signal line drive circuit 110 scans each scanning line in the third 1/16SF period, and the video signal line drive circuit 106 supplies the gray-scale signal including the analog data to the pixels electrically connected to each scanning line in the third 1/16SF period. That is, the operation in the first 1/16SF period is referred to as the first digital data scan (1st digital data scan, digital 1 data scan, D1), and the operation in the third 1/16SF period is referred to as the analog data scan. In the driving method shown in FIG. 11, configurations other than the configuration described above is the same as or similar to that of the first embodiment, and therefore, the description thereof is omitted here.

FIG. 12 is a diagram showing a locus of luminescence on a retina of a human viewing an image when the driving method of the light-emitting device 10 according to the second embodiment is not performed, as a comparative example of FIG. 13. FIG. 13 is a diagram showing a locus of luminescence on a retina of a human viewing an image when the driving method of the light-emitting device 10 according to the second embodiment is performed. In the diagrams shown on the left side of FIGS. 12 and 13, the relation between time (Time) and the position of the image on the retina of the human viewing the image associated with the light emission of the light-emitting element RLED is shown. In the diagrams shown on the right side of FIGS. 12 and 13, the relation between time (Time) and the position of the image on the retina of the human viewing the image associated with the light emission of the light-emitting element GLED is shown. In the diagrams shown on the lower side of FIGS. 12 and 13, the relation between the position of the image on the retina of the human viewing the image associated with the light emission of the light-emitting element RLED and the normalized stimulus distribution on the retina, and the relation between the position of the image on the retina of the human viewing the image associated with the light emission of the light-emitting element GLED and the normalized stimulus distribution on the retina are superimposed.

In the diagrams shown on the left and right sides of FIG. 12, the vertical axis represents time (Time), and the horizontal axis represents the position of the image on the retina of the human viewing the image, indicating that a picture (line) displayed on the display section has moved in the nth frame and in the n+1st frame following the nth frame. When the driving method of the light-emitting device 10 according to the second embodiment is not performed, the analog data scan is not performed, for example, the analog data scan in the third 1/16SF period shown in FIG. 11 is the second digital data scan (2nd digital data scan, digital 2 data scan, D2), and the digital data scan in the first to sixth 1/8SF periods is the third to eighth digital data scans. In the diagram shown on the left side of FIG. 12, for example, in the nth frame, in the first digital data scan (1st digital data scan, digital 1 data scan, D1) in the first 1/16SF period and the second digital data scan (2nd digital data scan, digital 2 data scan, D2) in the third 1/16SF period, in the third digital data scan (3rd digital data scan, digital 3 data scan, D3) in the first 1/8SF period, and in the fourth digital data scan (4th digital data scan, digital 4 data scan, D4) in the second 1/8SF period, the light-emitting element RLED of the pixels electrically connected to one scanning line emits light, and in the fifth digital data scan (5th digital data scan, digital 5 data scan, D5) in the third 1/8SF period, the light-emitting element RLED of the pixels electrically connected to one scanning line does not emit light. That is, in the nth frame, the light-emitting element RLED of the pixels electrically connected to one scanning line emits light at a level of 6 out of the 4 bits (16 steps). Similarly, even in the n+1st frame, the light-emitting element RLED of the pixels electrically connected to one scanning line emits light at a level of 6 out of the 4 bits (16 steps).

In the diagram shown on the right side of FIG. 12, in the nth frame, in the first digital data scan (1st digital data scan, digital 1 data scan, D1) in the first 1/16SF period, in the second digital data scan (2nd digital data scan, digital 2 data scan, D2) in the third 1/16SF period, and in the third digital data scan (3rd digital data scan, digital 3 data scan, D3) in the first 1/8SF period, the light-emitting element GLED of the pixels electrically connected to one scanning line emits light, and in the fourth digital data scan (4th digital data scan, digital 4 data scan, D4) in the second 1/8SF period and in the fifth digital data scan (5th digital data scan, digital 5 data scan, D5) in the third 1/8SF period, the light-emitting element GLED of the pixels electrically connected to one scanning line does not emit light. That is, in the nth frame, the light-emitting element GLED of the pixels electrically connected to one scanning line emits light at a level of 4 out of the 4 bits (16 steps). Similarly, even in the n+1st frame, the light-emitting element GLED of the pixels electrically connected to one scanning line emits light at a level of 4 out of the 4 bits (16 steps).

In the diagram shown on the lower side of FIG. 12, the horizontal axis is the position of the image on the retina of the human viewing the image associated with the light emission of the light-emitting element RLED or the light-emitting element GLED, and the vertical axis is the normalized stimulus distributions on the retina. The relation between the position of the image on the retina of the human viewing the image associated with the light emission of the light-emitting element RLED and the normalized stimulus distribution on the retina indicates the distribution based on the oblique arrows in the diagram shown on the left side of FIG. 12. The relation between the position of the image on the retina of the human viewing the image associated with the light emission of the light-emitting element GLED and the normalized stimulus distribution on the retina indicates the distribution based on the oblique arrows in the diagram shown on the right side of FIG. 12. In the diagram shown on the lower side of FIG. 12, the relation between the position of the image on the retina of the human viewing the image associated with the light emission of the light-emitting element RLED and the normalized stimulation distribution on the retina and the relation between the position of the image on the retina of the human viewing the image associated with the light emission of the light-emitting element GLED and the normalized stimulation distribution on the retina are superimposed. In the center of the image shown on the lower side of FIG. 12, the red color based on the light emission of the light-emitting element RLED (red light-emitting diode) and the green color based on the light emission of the light-emitting element GLED (green light-emitting diode) are superimposed, and the desired color (e.g., yellow) is found. In the left contour of the image shown on the lower side of FIG. 12, the red color based on the light emission of the light-emitting element RLED (red light-emitting diode) is noticeably found, and in the right contour of the image shown on the lower side of FIG. 12, the green color based on the light emission of the light-emitting element GLED (green light-emitting diode) is noticeably found. Such a phenomenon is called, for example, a false contour.

On the other hand, FIG. 13 also shows that the image displayed on the display section has moved in the nth frame and the n+1st frame following the nth frame, similar to FIG. 12. In the diagram shown on the left side of FIG. 13, in the nth frame, in the first digital data scan (1st digital data scan, digital 1 data scan, D1) in the first 1/16SF period, the light-emitting element RLED of the pixels electrically connected to one scanning line emits light, in the analog data scan in the third 1/16SF period, the light emission of the light-emitting element RLED of the pixels electrically connected to one scanning line is controlled using the analog data, in the second digital data scan (2nd digital data scan, digital 2 data scan, D2) in the first 1/8SF period and in the third digital data scan (3rd digital data scan, digital 3 data scan, D3) in the second 1/8SF period, the light-emitting element RLED of the pixels electrically connected to one scanning line emits light, and in the fourth digital data scan (4th digital data scan, digital 4 data scan, D4) in the third 1/8SF period, the light-emitting element RLED of the pixels electrically connected to one scanning line does not emit light. That is, in the nth frame, the light-emitting element RLED of the pixels electrically connected to one scanning line emits light at a level of 6 out of the 4 bits (16 steps). Similarly, even in the n+1st frame, the light-emitting element RLED of the pixels electrically connected to one scanning line emits light at a level of 6 out of the 4 bits (16 steps).

In the diagram shown on the right side of FIG. 13, in the nth frame, in the first digital data scan (1st digital data scan, digital 1 data scan, D1) in the first 1/16SF period, the light-emitting element GLED of the pixels electrically connected to one scanning line emits light, in the analog data scan (analog data scan) in the second 1/16SF period, the light emission of the light-emitting element GLED of the pixels electrically connected to one scanning line is controlled using the analog data, in the second digital data scan (2nd digital data scan, digital 2 data scan, D2) in the first 1/8SF period, the light-emitting element GLED of the pixels electrically connected to one scanning line emits light, and in the third digital data scan (3rd digital data scan, digital 3 data scan, D3) in the second 1/8SF period and in the fourth digital data scan (4th digital data scan, digital 4 data scan, D4) in the third 1/8SF period, the light-emitting element GLED of the pixels electrically connected to one scanning line does not emit light. That is, in the nth frame, the light-emitting element GLED of the pixels electrically connected to one scanning line emits light at a level of 4 out of the 4 bits (16 steps). Similarly, even in the n+1st frame, the light-emitting element GLED of the pixels electrically connected to one scanning line emits light at a level of 4 out of the 4 bits (16 steps).

When implementing the driving method of the light-emitting device 10 according to the second embodiment, as compared with the diagram shown on the lower side of FIG. 13, with the diagram shown on the lower side of FIG. 12, the false contour shown on the lower side of FIG. 13 is alleviated. Therefore, in the driving method of the light-emitting device 10 according to an embodiment of the present invention, the false contour can be alleviated by shifting the sub-frame for performing the analog data scan to the center of the sub-frame with respect to the position of the image on the retina of the human viewing the image associated with the light emission of the light-emitting element LED. As a result, by using the light-emitting device 10 and the driving method of the light-emitting device 10 according to an embodiment of the present invention, it is possible to suppress the deterioration of the image quality of the light-emitting device 10.

3. Third Embodiment

<3-1. Overall Configuration of Light-Emitting Device 10A>

Figure 14:
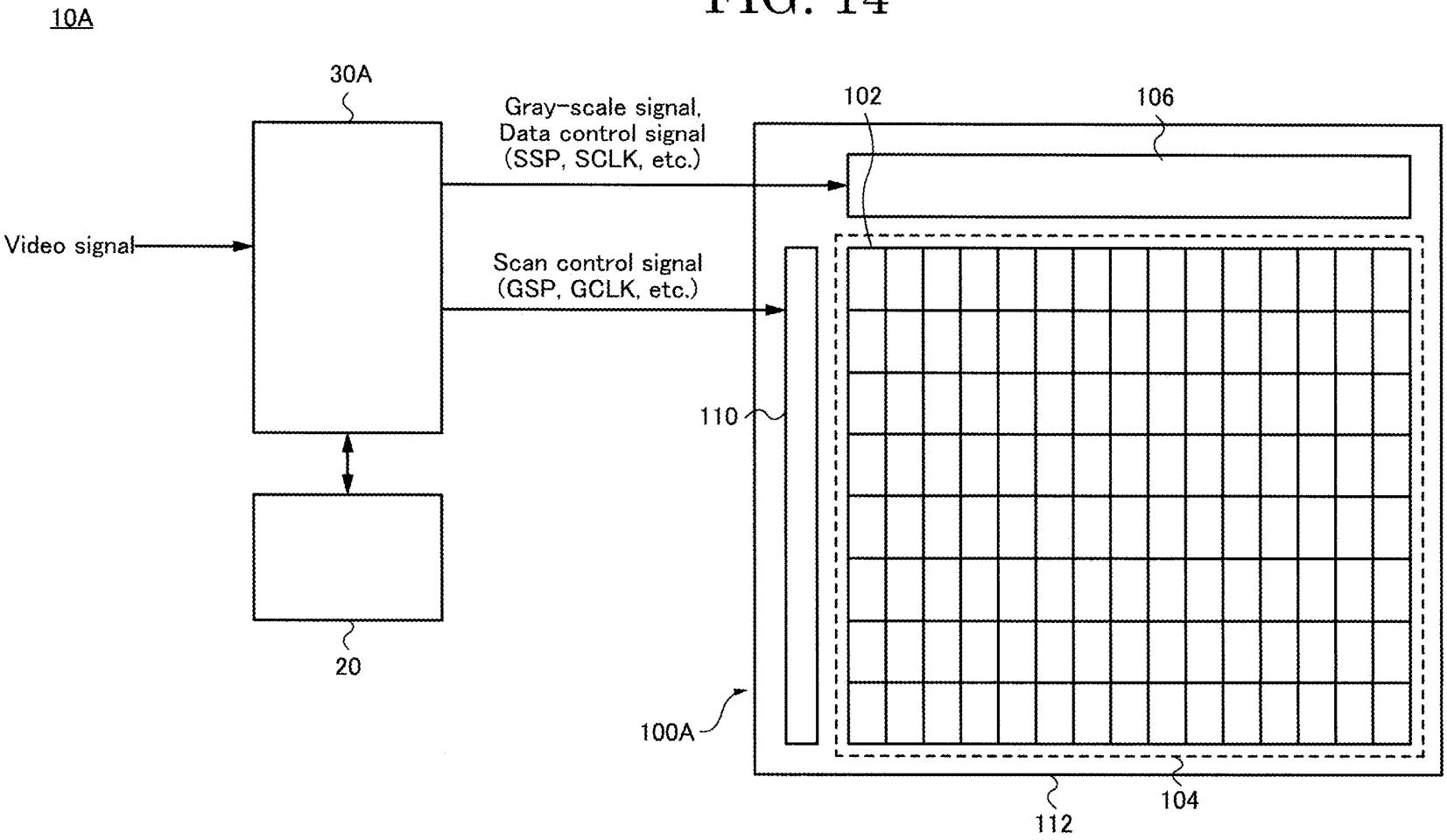
FIG. 14 is a schematic plan view showing a configuration of a light-emitting device according to an embodiment of the present invention.
Figure 15:
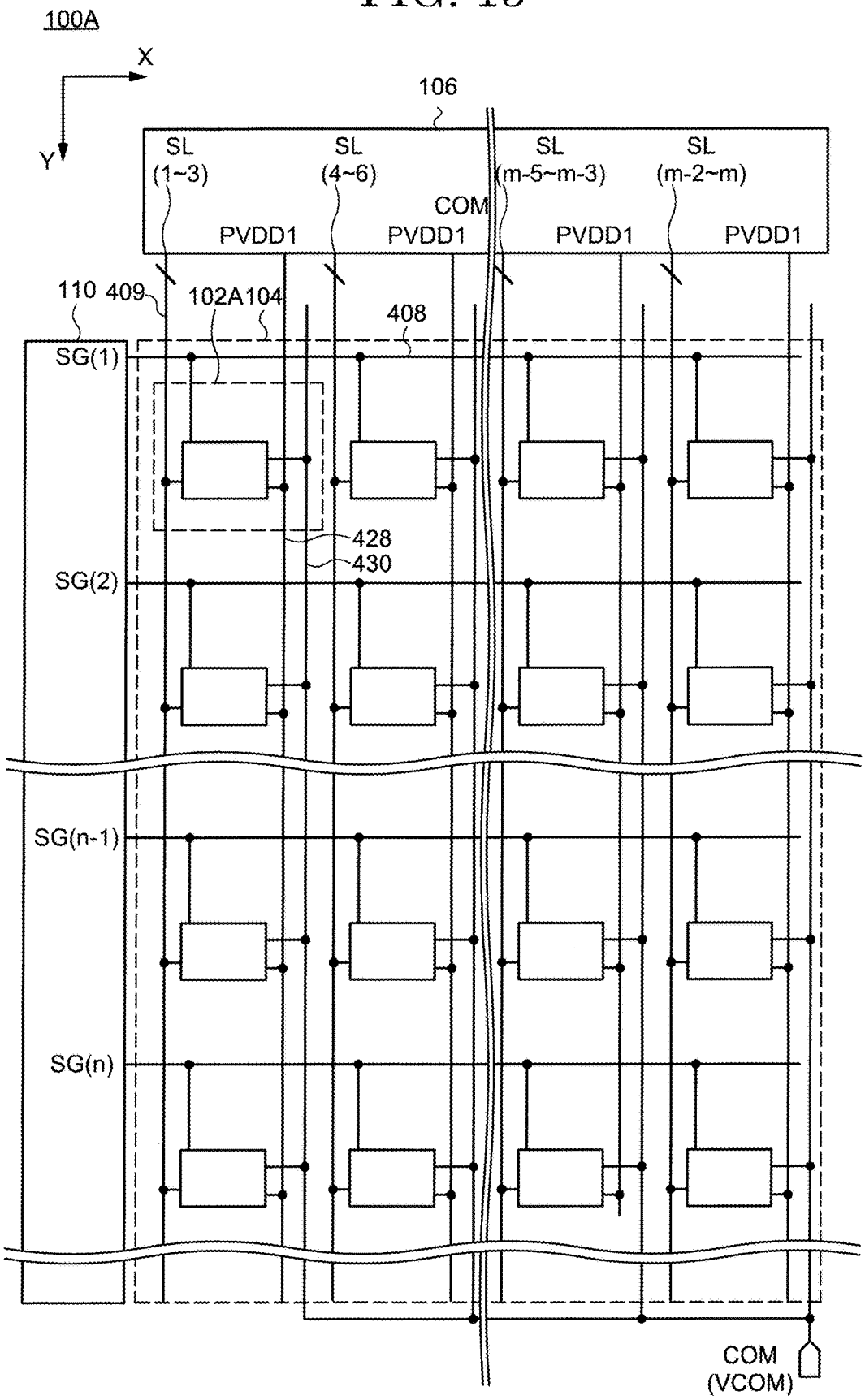
FIG. 15 is a schematic plan view showing a display panel included in a light-emitting device according to an embodiment of the present invention.

FIG. 14 and FIG. 15 are schematic plan views showing a configuration of a light-emitting device 10A according to an embodiment of the present invention. The configuration of the light-emitting device 10A shown in FIG. 14 and FIG. 15 is an example, and descriptions of the configuration of the light-emitting device 10A are omitted here for the same or similar configuration as the first embodiment or the second embodiment which is not limited to the configuration shown in FIG. 14 and FIG. 15.

The configuration of the light-emitting device 10A shown in FIGS. 14 and 15 is different from that of the light-emitting device 10 shown in FIGS. 1 and 2 in that it does not include a configuration related to the erasing signal line drive circuit 108 and in the configuration of a timing control circuit 30A. Since the configuration of the light-emitting device 10A shown in FIGS. 14 and 15 is the same as the configuration of the light-emitting device 10 shown in FIGS. 1 and 2 except for the configuration described above, descriptions thereof are omitted here.

As shown in FIGS. 14 and 15, the light-emitting device 10A has the storage device 20, the timing control circuit 30A, and a display panel 100A. The display panel 100A has a pixel 102A, the display section 104, the video signal line drive circuit 106, the scan signal line drive circuit 110, and the substrate 112. The display section 104, the video signal line drive circuit 106, and the scan signal line drive circuit 110 are provided on the top surface of the substrate 112. The storage device 20 and the timing control circuit 30A may be provided on the top surface of the substrate 112. The display section 104 has a plurality of pixels 102A for displaying an image on the light-emitting device 10A. Each of the plurality of pixels 102A has a plurality of sub-pixels 120D, a plurality of sub-pixels 120E, and a plurality of sub-pixels 120F.

The timing control circuit 30A outputs, for example, a video signal for each frame to the storage device 20. The timing control circuit 30A reads the gray-scale signal corresponding to the video signal of each pixel for each frame period stored in the storage device 20 from the storage device 20 and supplies the gray-scale signal, and the data control signal to the video signal line drive circuit 106. The timing control circuit 30A generates the scan control signal for controlling the scanning line (FIG. 15) for each sub-frame period and supplies the scan control signal to the scan signal line drive circuit 110.

The data control signal includes, for example, the start pulse SSP and the clock signal SCLK which control the timing of supplying data to the pixels in sequence. The scan control signal includes, for example, the start pulse GSP and the clock signal GCLK.

The scan signal line drive circuit 110 and the video signal line drive circuit 106 have the function for displaying an image on the display section 104 by driving the transistor (FIG. 16) included in the pixel 102A and making the LED (FIG. 16) emit light or not to emit light using the respective signals and power supply voltages supplied from the timing control circuit 30A. In an embodiment of the present invention, the timing control circuit 30A, the scan signal line drive circuit 110, and the video signal line drive circuit 106 may be collectively referred to as the control section, and the scan signal line drive circuit 110, and the video signal line drive circuit 106 may be collectively referred to as the control section.

<3-2. Configuration of Pixel 102A>

Figure 16:
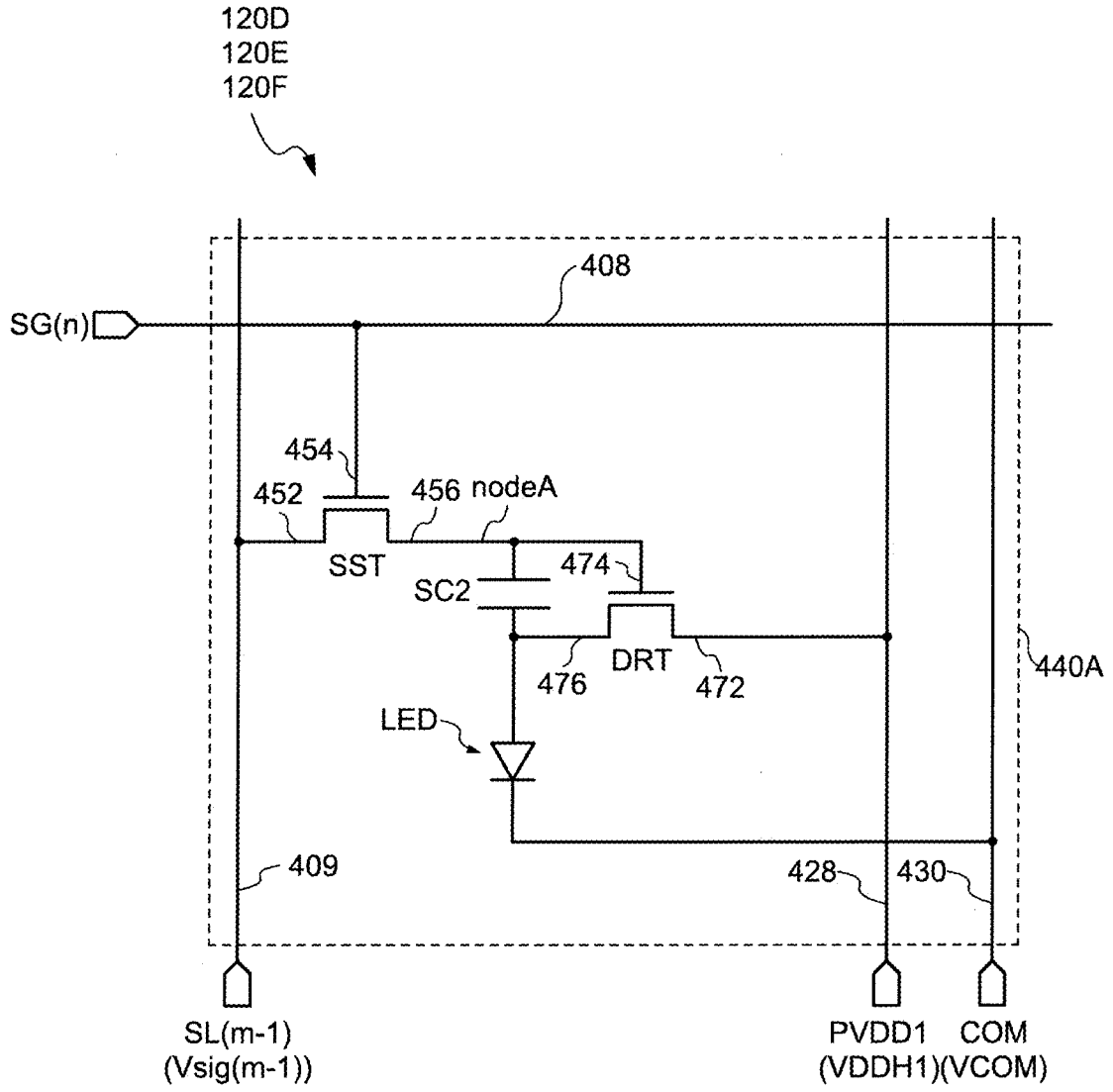
FIG. 16 is a schematic plan view showing a light-emitting element drive section of a sub-pixel according to an embodiment of the present invention.

FIG. 16 is a circuit diagram showing a light-emitting element drive section 440A of the sub-pixel (120D), the sub-pixel (120E), and the sub-pixel 120F according to an embodiment of the present invention. The sub-pixel 120D, the sub-pixel 120E, and the sub-pixel 120F correspond to the sub-pixel 120A, the sub-pixel 120B, and the sub-pixel 120C in the first embodiment, respectively.

The configurations of the sub-pixel 120D, the sub-pixel 120E, and the sub-pixel 120F shown in FIG. 16 are examples, and the configurations of the sub-pixel 120D, the sub-pixel 120E, and the sub-pixel 120F are not limited to the configurations shown in FIG. 16. Description of the same or similar components as those in FIGS. 1 to 15 will be omitted.

As shown in FIG. 16, the sub-pixel 120D, the sub-pixel 120E, and the sub-pixel 120F have the light-emitting element drive section 440A. The light-emitting element drive section 440A includes the drive transistor DRT, the select transistor SST (first switch), a storage capacity element (capacity element) SC2, and the light-emitting element LED. Each of these transistors has the first electrode (gate electrode), and a pair of electrodes consisting of the second electrode and the third electrode (source electrode, drain electrode). The storage capacity element SC2 has a pair of electrodes.

As a power supply for driving the sub-pixel 120, the drive voltage VDDH1 is supplied from the drive power supply line PVDD1 and the common voltage VCOM is supplied from the common power supply line COM.

The drive transistor DRT has the function for flowing a current through the light-emitting element LED and making the light-emitting element LED emit light using the input gray-scale signal. The select transistor SST has the function for supplying the gray-scale signal to the drive transistor DRT. The light-emitting element LED has diode characteristics.

The storage capacity element SC2 has the function for maintaining a voltage input to the first electrode 474 (gate electrode 474) of the drive transistor DRT for the pixel 102A emits light. That is, the storage capacity element SC2 has the function for holding charges corresponding to the input gray-scale signals. The storage capacity element SC2 holds the charge corresponding to the input gray-scale signal so that the drive transistor DRT can flow a constant current from the second electrode 472 to the third electrode 476 of the drive transistor DRT. Consequently, since the drive transistor DRT flows a constant current through the light-emitting element LED, the light-emitting element LED can emit light at a constant emission intensity with suppressed variations in each sub-frame period.

The gate electrode 454 of the select transistor SST is electrically connected to the scanning line 408. The scanning line 408 is supplied with the scan signal SG (n). The select transistor SST is controlled in a conductive state and a non-conductive state by the signal supplied to the scan signal SG (n). When the signal supplied to the scan signal SG (n) is at the L level, the select transistor SST is in a non-conductive state. When the signal supplied to the scan signal SG (n) is at the H level, the select transistor SST is in a conductive state. The source electrode 452 of the select transistor SST is electrically connected to the video line 409. The video line 409 is supplied with the gray-scale-signal Vsig (m). The drain electrode 456 of the select transistor SST is electrically connected to the first electrode and the node A of the storage capacity element SC2, and the gate electrode 474 of the drive transistor DRT.

The drain electrode 476 of the drive transistor DRT is electrically connected to the second electrode of the storage capacity element SC2 and the first electrode of the light-emitting element LED. The source electrode 472 of the drive transistor DRT is electrically connected to the drive power supply line PVDD1. The second electrode of the light-emitting element LED is electrically connected to the common power supply line COM. The drive power supply line PVDD1 is the drive power supply line 428, and the common power supply line COM is the common power supply line 430.

The configuration of the sub-pixel 120D, the sub-pixel 120E, and the sub-pixel 120F shown in FIG. 16 is different from the configuration of the sub-pixel shown in FIG. 4 in that they do not include the storage capacity element SC1 but are related to the storage capacity element SC1 and are related to the storage capacity element SC2. In the configurations of the sub-pixel 120D, the sub-pixel 120E, and the sub-pixel 120F shown in FIG. 16, the configurations other than the above are the same as those of sub-pixel shown in FIG. 4, as long as they do not conflict with each other, and therefore, descriptions thereof are omitted here.

<3-3. Driving Method of Light-Emitting Device 10A>

Figure 17:
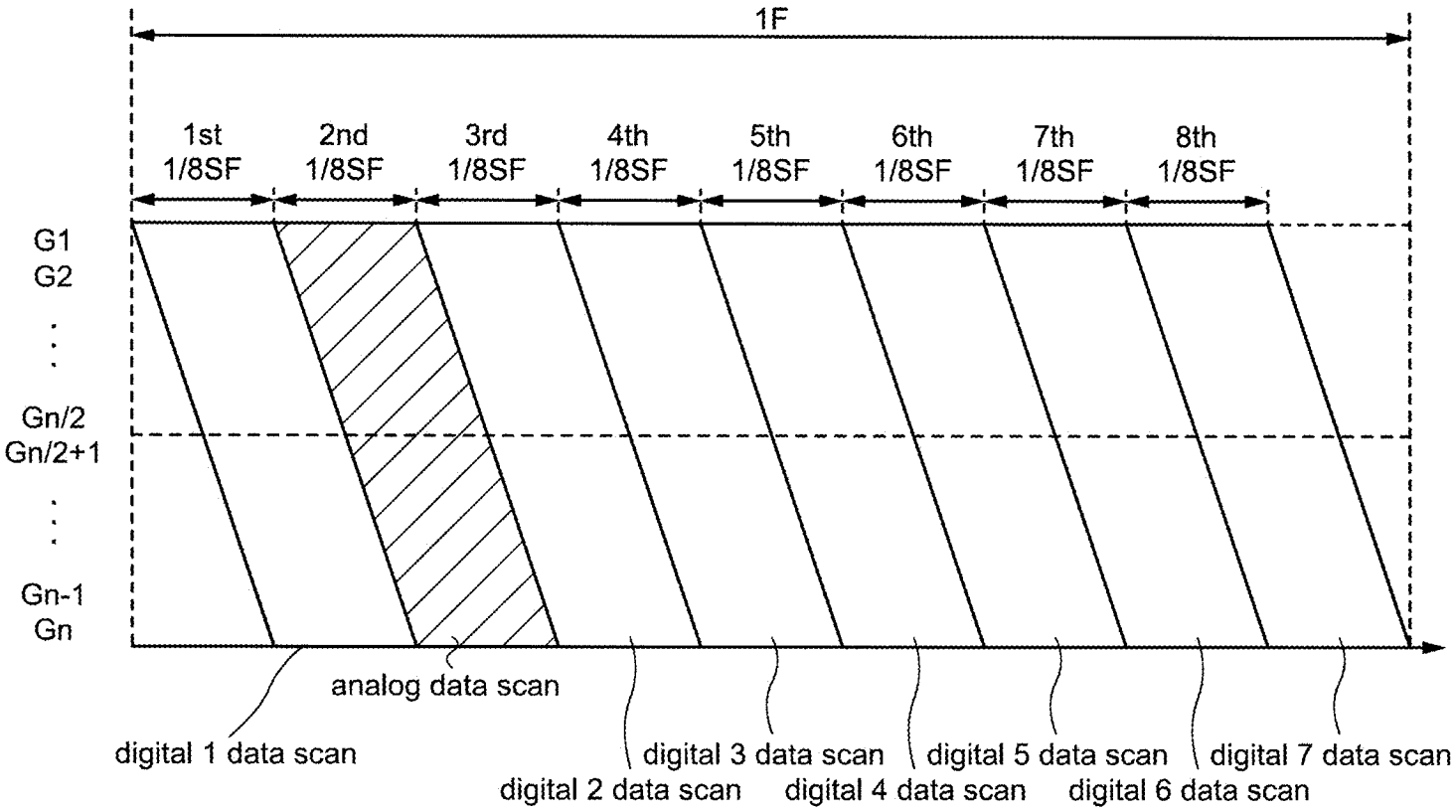
FIG. 17 is a timing chart for explaining a driving method of a light-emitting device according to an embodiment of the present invention.

FIG. 17 is a timing chart for explaining a driving method of the light-emitting device 10A according to an embodiment of the present invention. The driving method of the light-emitting device 10A shown in FIG. 17 is an example, and the driving method of the light-emitting device 10A is not limited to the method shown in FIG. 17. Description of the same or similar components as those in FIGS. 1 to 16 is omitted here.

As shown in FIG. 17, in an embodiment of the present invention, one frame (1F) period is composed of eight sub-frame (8SF) periods. 8SF is composed of eight 1/8SF (first 1/8SF (1st1/8SF), second 1/8SF (2nd1/8SF), third 1/8SF (3rd1/8SF), fourth 1/8SF (4th1/8SF), fifth 1/8SF (5th1/8SF), sixth 1/8SF (6th1/8SF), seventh 1/8SF (7th1/8SF), and eighth 1/8SF (8th1/8SF)) obtained by dividing the emission period of the 1F period into 1/8.

For example, in an embodiment of the present invention, the first scanning line G1 to the nth scanning line Gn are sequentially scanned in each SF. The pixels electrically connected to each scanning line receives the gray-scale signal, and the light-emitting element LED included in each pixel flows a current corresponding to the gray-scale signal. Consequently, the light-emitting element LED included in each pixel emits light with the emission intensity corresponding to the gray-scale signal. If the gray-scale signal corresponds to, for example, the reference voltage VSS or the common voltage VCOM, no current flows through the light-emitting element LED included in each pixel, and the light-emitting element LED does not emit light.

In the first 1/8SF period, the scan signal line drive circuit 110 scans each scanning line and the video signal line drive circuit 106 supplies the gray-scale signal including the first control signal to the pixels electrically connected to each scanning line. In the driving method of the light-emitting device 10 according to an embodiment of the present invention, the first 1/8SF period is a period for controlling the light emission or non-light emission in the 1/8SF period in the time division control method. The operation in the first 1/8SF period is referred to as, for example, the first digital data scan (1st digital data scan, digital 1 data scan, D1).

In the second 1/8 period following the first 1/8SF period, the scan signal line drive circuit 110 scans each scanning line and the video signal line drive circuit 106 supplies the gray-scale signal including analog data to the pixels electrically connected to each scanning line. In the driving method of the light-emitting device 10 according to an embodiment of the present invention, the operation in the first 1/16SF period is a period for analog-controlling the emission or non-emission of the light-emitting element LED of the pixels electrically connected to each scanning line using the analog data. In the driving method of the light-emitting device 10 according to an embodiment of the present invention, the operation in the second 1/8SF period is referred to as, for example, the analog data scan.

In the third 1/8SF period following the second 1/8SF period, the scan signal line drive circuit 110 scans each scanning line, and the video signal line drive circuit 106 supplies the gray-scale signals including the second control signal to the pixels electrically connected to each scanning line. In the driving method of the present light-emitting device 10 according to an embodiment of the present invention, the third 1/8SF period is a period for controlling the light emission or non-light emission in the 1/8SF period in the time division control method. The operation in the third 1/16SF period is referred to as, for example, the second digital data scan (1st digital data scan, digital 2 data scan, D2).

In the fourth 1/8SF period following the third 1/8SF period, the same scan as in the third 1/8SF period is performed, and therefore, detailed descriptions thereof are omitted here. In the fourth 1/8SF period, the gray-scale signal including the third control signal is supplied to the pixels electrically connected to each scanning line. In the driving method of the light-emitting device 10 according to an embodiment of the present invention, the fourth 1/8SF period is a period for controlling the light emission or non-light emission in the 1/8SF period in the time division control method. The operation in the fourth 1/8SF period is referred to as, for example, the third digital data scan (3rd digital data scan, digital 3 data scan, D3).

In the fifth 1/8SF period following the fourth 1/8SF period, the same scan as in the third 1/8SF period is performed, and therefore, detailed descriptions thereof are omitted here. In the fifth 1/8SF period, the video signal line drive circuit 106 supplies the gray-scale signal including the fourth control signal to the pixels electrically connected to each scanning line. The operation in the fifth 1/8SF period is referred to as, for example, the fourth digital data scan (4th digital data scan, digital 4 data scan, D4).

In the sixth 1/8SF period following the fifth 1/8SF period, the same scan as in the third 1/8SF period is performed, and therefore, detailed descriptions thereof are omitted here. In the sixth 1/8SF period, the video signal line drive circuit 106 supplies the gray-scale signal including the fifth control signal to the pixels electrically connected to each scanning line. The operation in the sixth 1/8SF period is referred to as, for example, the fifth digital data scan (5th digital data scan, digital 5 data scan, D5).

In the seventh 1/8SF period following the sixth 1/8SF period, the same scan as in the third 1/8SF period is performed, and therefore, detailed descriptions thereof are omitted here. In the seventh 1/8SF period, the video signal line drive circuit 106 supplies the gray-scale signal including the fourth control signal to the pixels electrically connected to each scanning line. The operation in the seventh 1/8SF period is referred to as, for example, the sixth digital data scan (6th digital data scan, digital 6 data scan, D6).

In the light-emitting device 10A and the driving method of the light-emitting device 10A according to an embodiment of the present invention, the 1F period is divided into eight 1/8SF periods, and in one 1/8SF period, the analog data scanning is performed, and the emission or non-emission of the light-emitting element LED of the pixels electrically connected to each scanning line can be analog-controlled using the analog data. Consequently, the light-emitting device 10A and the driving method of the light-emitting device 10A according to an embodiment of the present invention can control the low gray-scale that requires minute voltage or current control using the analog data, and it is possible to smoothly display the low gray-scale and display a stable image on the display section.

In the light-emitting device 10A and the driving method of the light-emitting device 10A according to an embodiment of the present invention, similar to the light-emitting device 10A and the driving method of the light-emitting device 10 according to an embodiment of the present invention, the analogue control and digital control (the time division control method) can be used in combination. As a result, even in the light-emitting device 10A and the driving method of the light-emitting device 10A according to an embodiment of the present invention, the same effects as those of the light-emitting device 10 and the driving method of the light-emitting device 10 according to an embodiment of the present invention can be obtained.

4. Fourth Embodiment

<4-1. Overall Configuration of Light-Emitting Device 10B>

Figure 18:
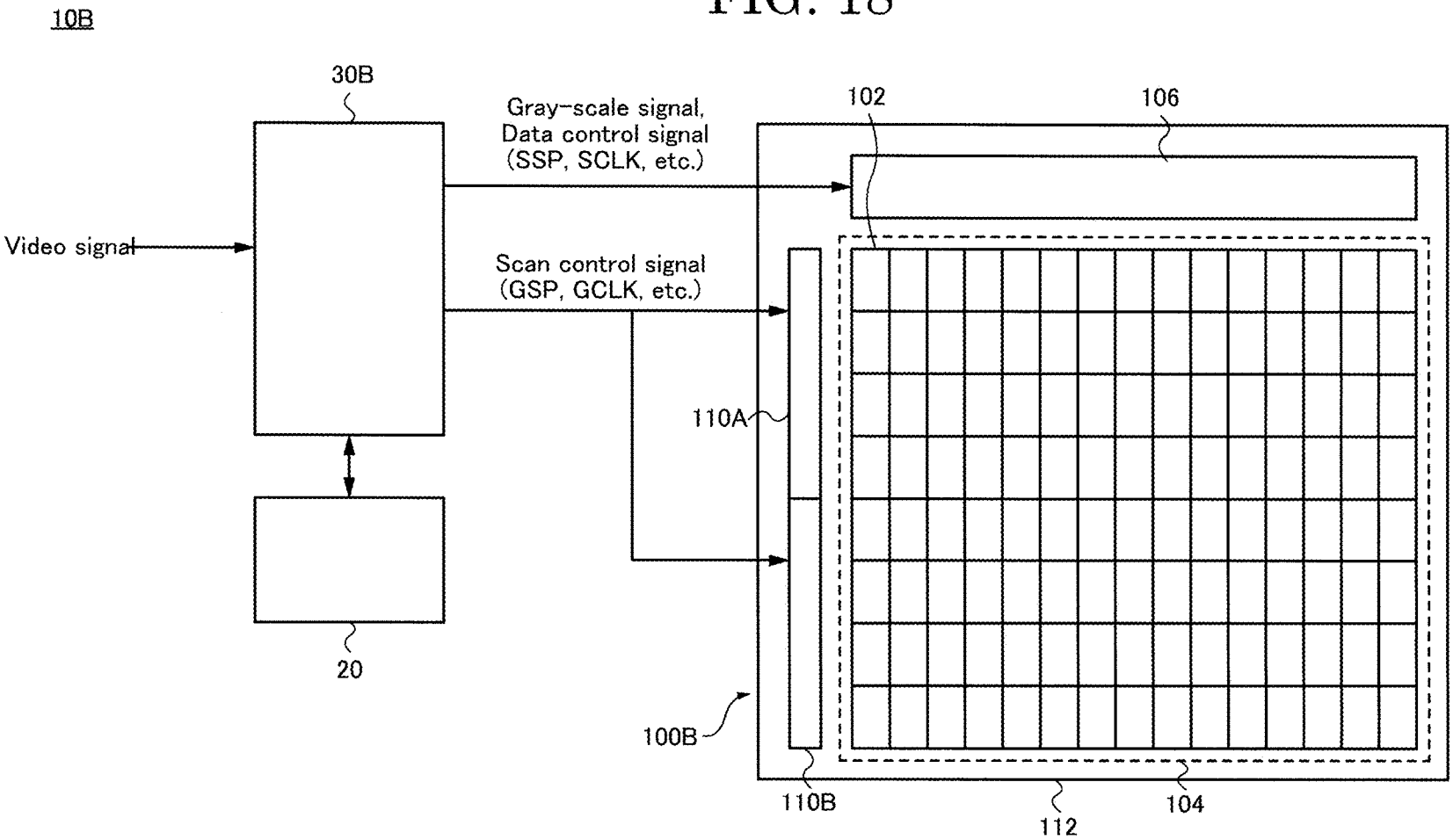
FIG. 18 is a schematic plan view showing a configuration of a light-emitting device according to an embodiment of the present invention.
Figure 19:
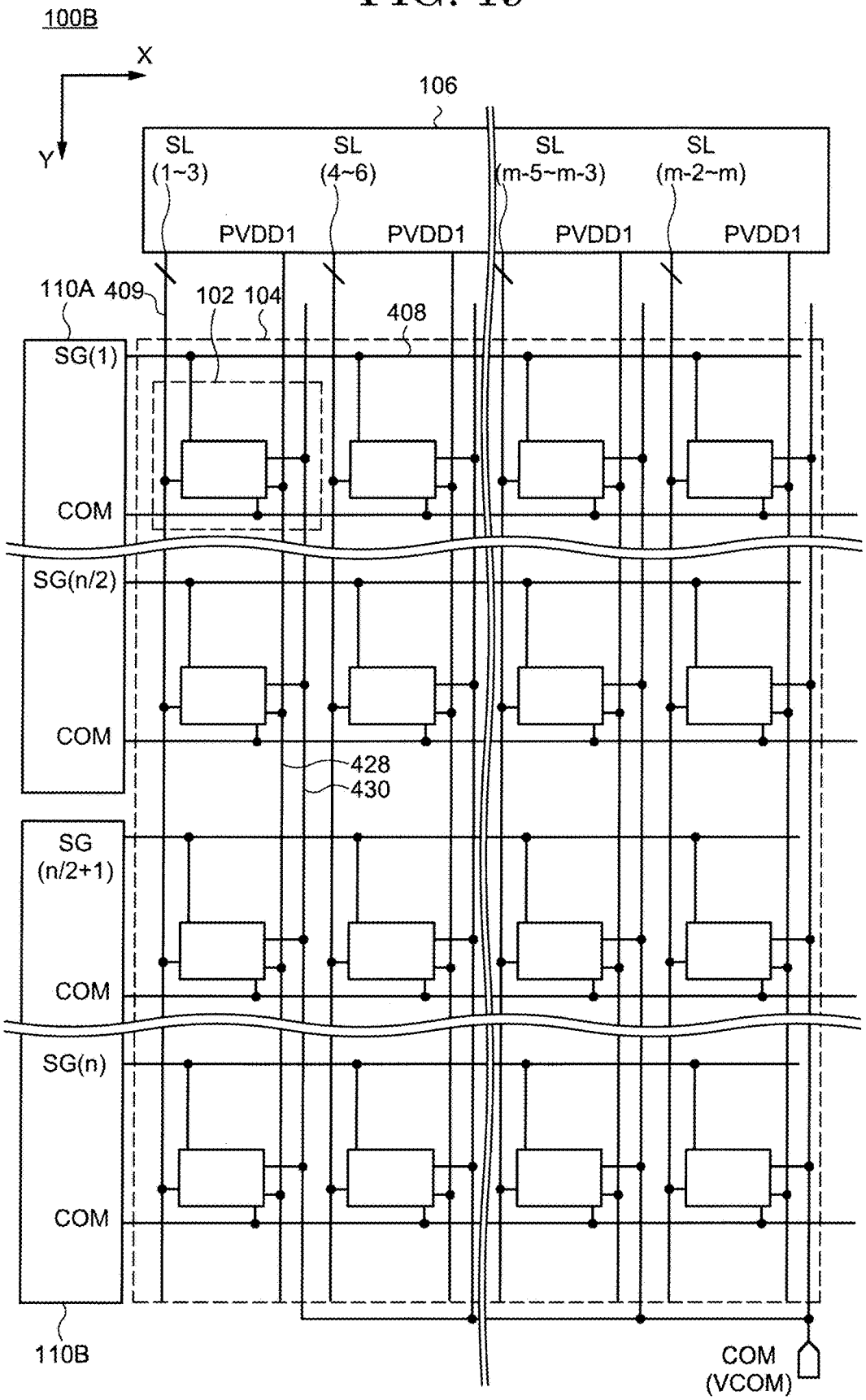
FIG. 19 is a schematic plan view showing a display panel included in a light-emitting device according to an embodiment of the present invention.

FIG. 18 and FIG. 19 are schematic plan views showing a configuration of a light-emitting device 10B according to an embodiment of the present invention. The configuration of the light-emitting device 10B shown in FIGS. 18 and 19 is an example, and the configuration of the light-emitting device 10B is not limited to the configuration shown in FIGS. 18 and 19. Description of the same or similar components as those of the first to third embodiments is omitted here.

The configuration of the light-emitting device 10B shown in FIGS. 18 and 19 is different from the configuration of the light-emitting device 10A shown in FIGS. 14 and 15 in the point that the scan signal line drive circuit 110 is divided into a first scan signal line drive circuit 110A and a second scan signal line drive circuit 110B and the configuration of a timing control circuit 30B. Since the configuration of the light-emitting device 10B shown in FIGS. 18 and 19 is the same as the configuration of the light-emitting device 10A shown in FIGS. 14 and 15 except for the configuration described above, descriptions thereof are omitted here.

As shown in FIGS. 18 and 19, the light-emitting device 10B has the storage device 20, the timing control circuit 30B, and a display panel 100B. The display panel 100B has the pixel 102A, the display section 104, the video signal line drive circuit 106, the first scan signal line drive circuit 110A, the second scan signal line drive circuit 110B, and the substrate 112. The display section 104, the video signal line drive circuit 106, the first scan signal line drive circuit 110A, and the second scan signal line drive circuit 110B are provided on the top surface of the substrate 112. The storage device 20 and the timing control circuit 30B may be provided on the top surface of the substrate 112. The display section 104 has the plurality of pixels 102A for displaying an image on the light-emitting device 10B. Each of the plurality of pixels 102A has the plurality of sub-pixels 120D, the plurality of sub-pixels 120E, and the plurality of sub-pixels 120F. Since the configurations of the plurality of sub-pixels 120D, the plurality of sub-pixels 120E, and the plurality of sub-pixels 120F are the same as those shown in the third embodiment, their descriptions are omitted here.

The timing control circuit 30B outputs, for example, a video signal for each frame to the storage device 20. The timing control circuit 30B reads the gray-scale signal corresponding to the video signal of each pixel for each frame period stored in the storage device 20 from the storage device 20 and supplies the gray-scale signal and the data control signal to the video signal line drive circuit 106. The timing control circuit 30A generates the scan control signal for controlling the scanning line (FIG. 19) for each subframe period and supplies the scan control signal to the first scan signal line drive circuit 110A and the second scan signal line drive circuit 110B.

The data control signal includes, for example, the start pulse SSP and the clock signal SCLK which control the timing of supplying data to the pixels in sequence. The scan control signal includes, for example, the start pulse GSP, the clock signal GCLK, a gate enable signal GENA, and a gate enable signal GENB.

The first scan signal line drive circuit 110A, the second scan signal line drive circuit 110B, and the video signal line drive circuit 106 have the function for displaying an image on the display section 104 by driving the transistor (FIG. 16) included in the pixel 102A and making the LED emit light or not to emit light using the respective signals and power supply voltages supplied from the timing control circuit 30B. In an embodiment of the present invention, the timing control circuit 30B, the first scan signal line drive circuit 110A, the second scan signal line drive circuit 110B, and the video signal line drive circuit 106 may be collectively referred to as the control section, and the first scan signal line drive circuit 110A, the second scan signal line drive circuit 110B, and the video signal line drive circuit 106 may be collectively referred to as the control section.

As shown in FIG. 19, the first scan signal line drive circuit 110A electrically connects the first scanning line G1 to the (n/2)th scanning line n/2, and the second scan signal line drive circuit 110B electrically connects the (n/2)+1st scanning line (n/2)+1 to the nth scanning line n.

<4-2. Driving Method of Light-Emitting Device 10B>

Figure 20:
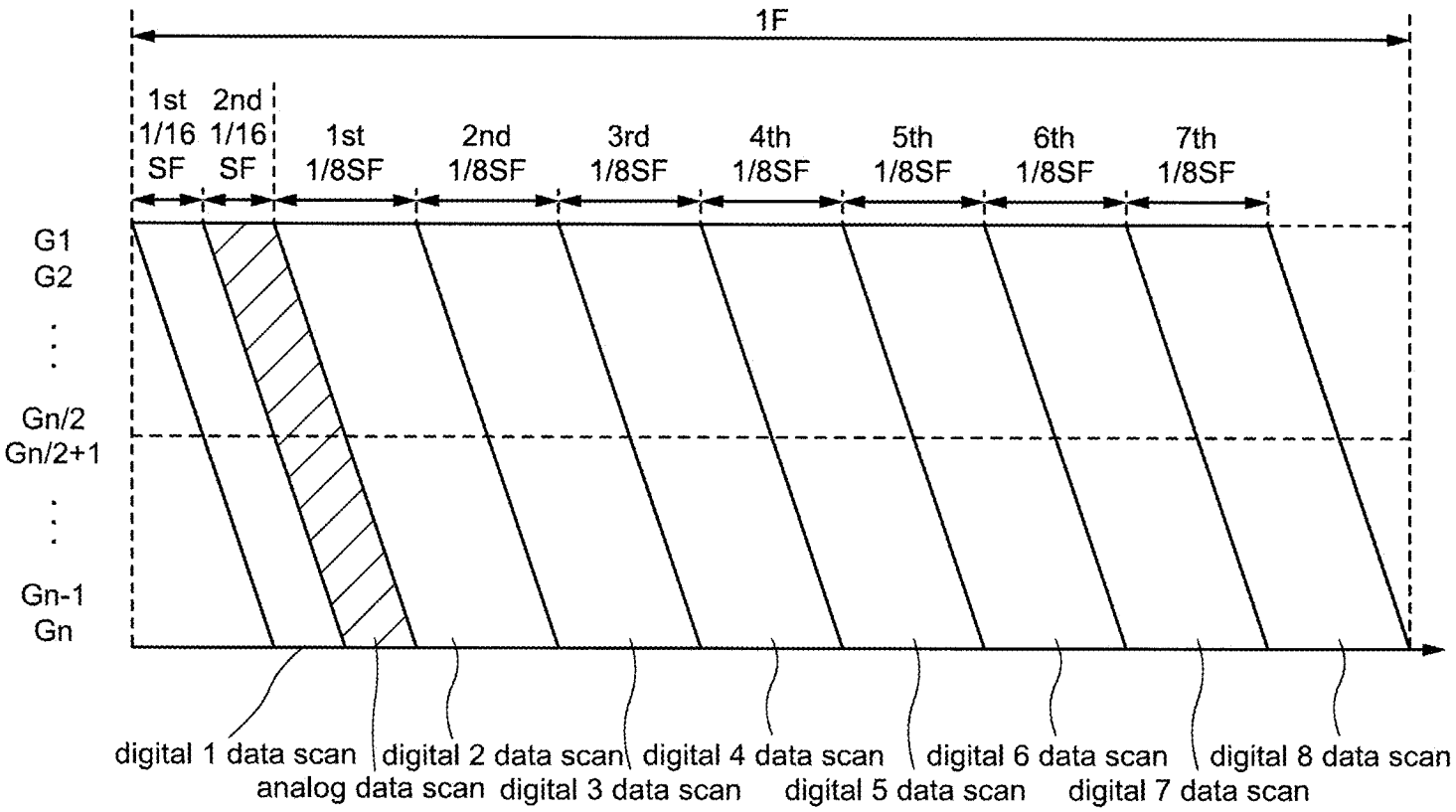
FIG. 20 is a timing chart for explaining a driving method of a light-emitting device according to an embodiment of the present invention.
Figure 21:
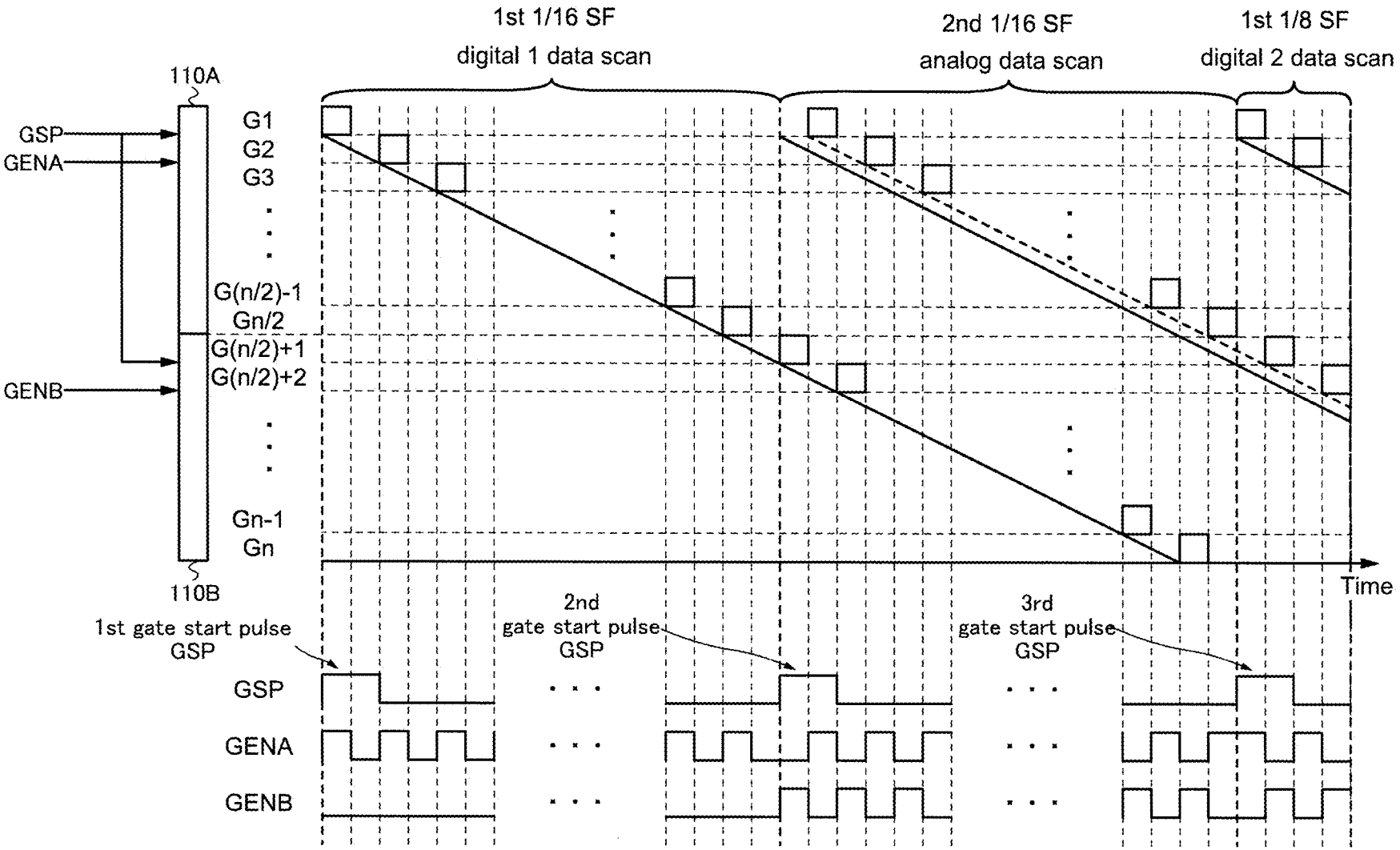
FIG. 21 is a timing chart for explaining a driving method of a light-emitting device according to an embodiment of the present invention.

FIGS. 20 and 21 are timing charts for explaining the driving method of the light-emitting device 10B according to an embodiment of the present invention. The driving method of the light-emitting device 10B shown in FIGS. 20 and 21 is an example, and the driving method of the light-emitting device 10B is not limited to the method shown in FIGS. 20 and 21. Description of the same or similar components as those of FIGS. 1 to 19 will be omitted.

As shown in FIG. 20, in an embodiment of the present invention, one frame (1F) period is composed of nine sub-frame (9SF) periods. 9SF is composed of two 1/16SF (first 1/16SF (1st1/16SF), second 1/16SF (2nd1/16SF)) obtained by dividing the light emission period in the 1F period into 1/16, and seven 1/8SF (first 1/8SF (1st1/8SF), second 1/8SF (2nd1/8SF), third 1/8SF (3rd1/8SF), fourth 1/8SF (4th1/8SF), fifth 1/8SF (5th1/8SF), sixth 1/OJ (6th 8SF), and seventh 1/8SF (7th1/8SF)) obtained by dividing the light emission period in the 1F period into 1/8.

For example, in an embodiment of the present invention, the scanning of the first scanning line G1 in the first 1/16SF to the (n/2)th scanning line n/2 is performed, and the scanning of the (n/2)+1st scanning line (n/2)+1 in the first 1/16SF to the nth scanning line n and the scanning of the first scanning line G1 in the second 1/16SF to the (n/2)th scanning line n/2 are performed alternately. The pixel electrically connected to each scanning line receives the gray-scale signal, and the light-emitting element LED included in each pixel flows a current corresponding to the gray-scale signal. Consequently, the light-emitting element LED included in each pixel emits light with the emission intensity corresponding to the gray-scale signal. If the gray-scale signal corresponds to, for example, the reference voltage VSS or the common voltage VCOM, the light-emitting element LED included in each pixel does not flow a current and the light-emitting element LED does not emit light.

As shown in FIG. 20, in the driving method of the light-emitting device 10B according to an embodiment of the present invention, in the first 1/16SF period, the first scan signal line drive circuit 110A and the second scan signal line drive circuit 110B scan each scanning line, and the video signal line drive circuit 106 supplies the gray-scale signal including the first control signal to the pixels electrically connected to each video signal line drive circuit. In the driving method of the light-emitting device 10 according to an embodiment of the present invention, the first 1/16SF period is a period for controlling the light emission or non-light emission in the 1/16SF period in the time division control method. The operation in the first 1/16SF period is referred to as, for example, the first digital data scan (1st digital data scan, digital 1 data scan, D1).

In the second 1/16SF period following the first 1/16SF period, the first scan signal line drive circuit 110A and the second scan signal line drive circuit 110B scan each scanning line, and the video signal line drive circuit 106 supplies the gray-scale signal including the analogue data to the pixels electrically connected to each scanning line. In the driving method of the light-emitting device 10B according to an embodiment of the present invention, the operation in the second 1/16SF period is a period for analog-controlling the light emission or non-light emission of the light-emitting element LED of the pixels electrically connected to each scanning line using analog data. In the driving method of the light-emitting device 10B according to an embodiment of the present invention, the operation in the second 1/16SF period is referred to as, for example, the analog data scan.

For example, when the analog data scan is performed in the second 1/16SF period following the first 1/16SF period, a period occurs in which the light emission or non-light emission in the first 1/16SF period and the light emission or non-light emission in the second 1/16SF period overlap. As a result, the light-emitting device cannot display an accurate image based on the gray-scale signal. In the light-emitting device 10B according to an embodiment of the present invention, in the first 1/16SF period and the second 1/16SF period following the first 1/16SF period, the scanning of the first scanning line G1 in the first 1/16SF to the n/2nd scanning line n/2 is performed, and the scanning of the (n/2)+1st scanning line (n/2)+1 in the first 1/16SF to the nth scanning line n and the scanning of the first scanning line G1 in the second 1/16SF to the n/2nd scanning line n/2 are alternately performed. That is, in the driving method of the light-emitting device 10B according to an embodiment of the present invention, the first digital data scan and the analog data scan are alternately executed by alternately scanning the different scanning lines. As a result, in the driving method of the light-emitting device 10B according to an embodiment of the present invention, it is possible to suppress overlapping of periods corresponding to light emission or non-light emission without using the erasing signal line drive circuit 108, and the erase scan. Consequently, by using the driving method of the light-emitting device 10B according to an embodiment of the present invention, it is possible to display an accurate image based on the gray-scale signal.

In the first 1/8SF period following the second 1/16SF period, the first scan signal line drive circuit 110A and the second scan signal line drive circuit 110B scan each scanning line, and the video signal line drive circuit 106 supplies the gray-scale signal including the second control signal to the pixels electrically connected to each scanning line. In the driving method of the light-emitting device 10 according to an embodiment of the present invention, the first 1/8SF period is a period for controlling the light emission or non-light emission in the 1/8SF period in the time division control method. The operation in the first 1/8SF period is referred to as, for example, the second digital data scan (2nd digital data scan, digital 2 data scan, D2).

In the second 1/8SF period following the first 1/8SF period, the same scan as in the first 1/8SF period is performed, and therefore, detailed descriptions thereof are omitted here. In the second 1/8SF period, the video signal line drive circuit 106 supplies the gray-scale signal including the third control signal to the pixels electrically connected to each scanning line. In the driving method of the present light-emitting device 10 according to an embodiment of the present invention, the third 1/8SF period is a period for controlling the light emission or non-light emission in the 1/8SF period in the time division control method. The operation in the second 1/16SF period is referred to as, for example, the third digital data scan (3rd digital data scan, digital 3 data scan, D3).

In the third 1/8SF period following the second 1/8SF period, the same scan as in the first 1/8SF period is performed, and therefore, detailed descriptions thereof are omitted here. In the third 1/8SF period, the video signal line drive circuit 106 supplies the gray-scale signal including the fourth control signal to the pixels electrically connected to each scanning line. In the driving method of the present light-emitting device 10 according to an embodiment of the present invention, the third 1/8SF period is a period for controlling the light emission or non-light emission in the 1/8SF period in the time division control method. The operation in the third 1/8SF period is referred to as, for example, the fourth digital data scan (4th digital data scan, digital 4 data scan, D4).

In the fourth 1/8SF period following the third 1/8SF period, the same scan as in the first 1/8SF period is performed, and therefore, detailed descriptions thereof are omitted here. In the fourth 1/8SF period, the video signal line drive circuit 106 supplies the gray-scale signal including the fifth control signal to the pixels electrically connected to each scanning line. In the driving method of the present light-emitting device 10 according to an embodiment of the present invention, the fourth 1/8SF period is a period for controlling the light emission or non-light emission in the 1/8SF period in the time division control method. The operation in the fourth 1/8SF period is referred to as, for example, the fifth digital data scan (5th digital data scan, digital 5 data scan, D5).

In the fifth 1/8SF period following the fourth 1/8SF period, the same scan as in the first 1/8SF period is performed, and therefore, detailed descriptions thereof are omitted here. In the fifth 1/8SF period, the video signal line drive circuit 106 supplies the gray-scale signal including the sixth control signal to the pixels electrically connected to each scanning line. In the driving method of the present light-emitting device 10 according to an embodiment of the present invention, the fifth 1/8SF period is a period for controlling the light emission or non-light emission in the 1/8SF period in the time division control method. The operation in the fifth 1/8SF period is referred to as, for example, the sixth digital data scan (sixth digital data scan, digital 6 data scan, D6).

In the sixth 1/8SF period following the fifth 1/8SF period, the same scan as in the first 1/8SF period is performed, and therefore, detailed descriptions thereof are omitted here. In the sixth 1/8SF period, the video signal line drive circuit 106 supplies the gray-scale signal including the seventh control signal to the pixels electrically connected to each scanning line. In the driving method of the present light-emitting device 10 according to an embodiment of the present invention, the sixth 1/8SF period is a period for controlling the light emission or non-light emission in the 1/8SF period in the time division control method. The operation in the sixth 1/8SF period is referred to as, for example, the seventh digital data scan (seventh digital data scan, digital 7 data scan, D7).

In the seventh 1/8SF period following the sixth 1/8SF period, the same scan as in the first 1/8SF period is performed, and therefore, detailed descriptions thereof are omitted here. In the seventh 1/8SF period, the video signal line drive circuit 106 supplies the gray-scale signal including the eighth control signal to the pixels electrically connected to each scanning line. In the driving method of the present light-emitting device 10 according to an embodiment of the present invention, the seventh 1/8SF period is a period for controlling the light emission or non-light emission in the 1/8SF period in the time division control method. The operation in the seventh 1/8SF period is referred to as, for example, the eighth digital data scan (eighth digital data scan, digital 8 data scan, D8). In an embodiment of the present invention, the period during which the eighth digital data scan is performed is the period during which the eighth digital data is scanned, the eighth digital data scan period, or the eighth digital gray-scale data scan period. In an embodiment of the present invention, the eighth digital data scan may be referred to as the eighth digital gray-scale data scan or the eighth digital gray-scale display.

As shown in FIG. 21, in the driving method of the light-emitting device 10B according to an embodiment of the present invention, the first scan signal line drive circuit 110A and the second scan signal line drive circuit 110B input the common start pulse GSP. The first scan signal line drive circuit 110A inputs the gate enable signal GENA. The second scan signal line drive circuit 110B inputs the gate enable signal GENB. The start pulse GSP has a first start pulse 210, a second start pulse 211, and a third start pulse 212.

The light-emitting device 10B according to an embodiment of the present invention performs the scanning of the first scanning line G1 in the first 1/16SF to n/2−1st scanning line n/2−1 by using the first start pulse 210 and the gate enable signal GENA. The light-emitting device 10B according to an embodiment of the present invention alternately performs the scanning of the (n/2)+1st scanning line (n/2)+1 in the first 1/16SF to the nth scanning line n and the scanning of the first scanning line G1 in the second 1/16SF to the n/2nd scanning line n/2 using the second start pulse 211, the gate enable signal GENA, and the gate enable signal GENB.

When the first start pulse 210 rises, the gate enable signal GENA repeatedly outputs a low level (Low Level, L level) and a high level (High Level, H level) at half the pulse width of the first start pulse 210. When the second start pulse 211 rises, the gate enable signal GENA outputs an inverted signal with respect to the gate enable signal GENB. The gate enable signal GENB maintains a low level until the second start pulse 211 rises, and when the second start pulse 211 rises, the gate enable signal GENB outputs a low level and a high level at half the pulse width of the second start pulse 211. The pulse width of the first start pulse 210 is the same width as the pulse width of the second start pulse 211.

For example, the second start pulse 211 and the gate enable signal GENB may be used to select the (n/2)+1st scanning line (n/2)+1 in the first 1/16SF, and then it is possible to supply the gray-scale signal based on the first control signal to the pixels to be electrically connected to the scanning line (n/2)+1. Subsequently, the second start pulse 211 and the gate enable signal GENA may be used to select the first scanning line G1 in the second 1/16SF and it is possible to supply the gray-scale signal based on the analog data to the pixels to be electrically connected to the scanning line G1. Next, since the start pulse is shifted, it is possible to select the (n/2)+2nd scanning line (n/2+2) in the first 1/16SF and supply the gray-scale signal based on the first control signal to the pixels to be electrically connected to the scanning line (n/2)+2, and to select the second scanning line G2 in the second 1/16SF and supply the gray-scale signal based on the analog data to the pixel to be electrically connected to the scanning line G2. Next, by performing the scanning, it is possible to suppress overlapping of periods corresponding to the light emission or non-light emission. By adjusting the timing of the second start pulse 211, and the gate enable signals GENA and GENB, the scanning of the (n/2)+1st scanning line (n/2)+1 in the first 1/16SF to the nth scanning line n and the scanning of the first scanning line G1 in the second 1/16SF to the nth scanning line n are performed simultaneously and can be adapted to the above-described light-emitting device 10B.

<4-3. Gray-Scale when Light-Emitting Device 10B is Made to Emit Light or Not to Emit Light>

FIGS. 22A to 25D are diagrams showing the gray-scales when the light-emitting device 10B according to an embodiment of the present invention is made to emit light or not to emit light. The configuration of the gray-scale when the light-emitting device 10B shown in FIGS. 22A to 25D is made to emit light or not to emit light is an example, and the configuration of the gray-scale is not limited to the configuration shown in FIGS. 22A to 25D. Description of the same or similar components as those of the first to third embodiments is omitted here.

As shown in FIGS. 22A to 25D, the gray-scale level has a level of 4 bits (16 steps). Normally, the gray-scale level of the gray-scale signal including the analog data has a level of 8 bits (256 steps), but here, since the gray-scale level of the gray-scale signal including the analog data is one step of the 4 bits (16 steps), it is impossible to represent the entire gray-scale only by the analog data. In the present embodiment, 256 gray-scales are realized by combining one step of the analog gray-scale and the remaining 15 steps of the time division gray-scale.

Figure 22A:
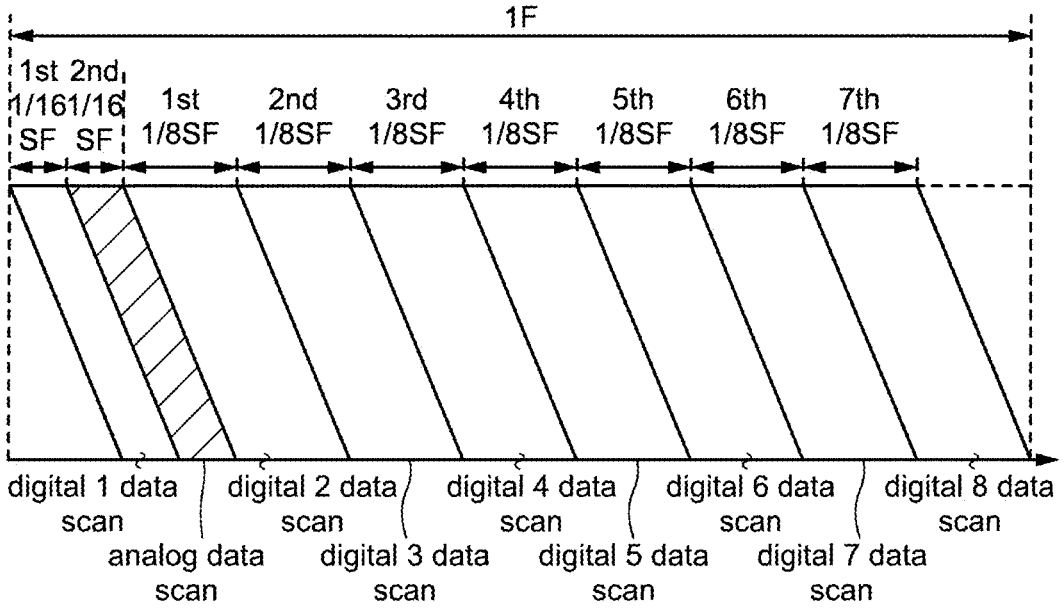
FIG. 22A is a diagram showing a gray-scale (1/16) when a light-emitting device according to an embodiment of the present invention is made to emit light or not to emit light.

FIG. 22A shows the first step (first level) of the 16 steps. More specifically, in the first level, in the analog data scan period in the second 1/16SF period, the pixels emit light based on the analog data. Here, the first step of the 4 bits (16 steps) is 1/16.

Figure 22B:
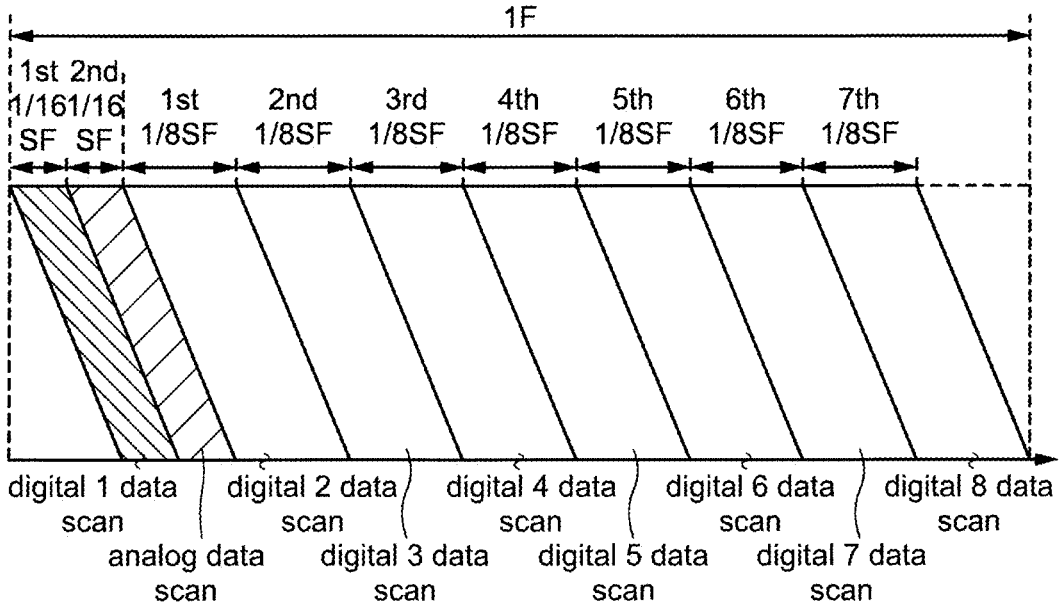
FIG. 22B is a diagram showing a gray-scale (2/16) when a light-emitting device according to an embodiment of the present invention is made to emit light or not to emit light.

FIG. 22B shows the second step (second level) of the 16 steps. More specifically, in the second level, in the analog data scan period in the second 1/16SF period, the pixel emits light based on the analog data, and, in the first digital data scan period in the first 1/16SF period, the pixel emits light based on the digital signal. The second step of the 4 bits (16 steps) is 2/16.

Figure 22C:
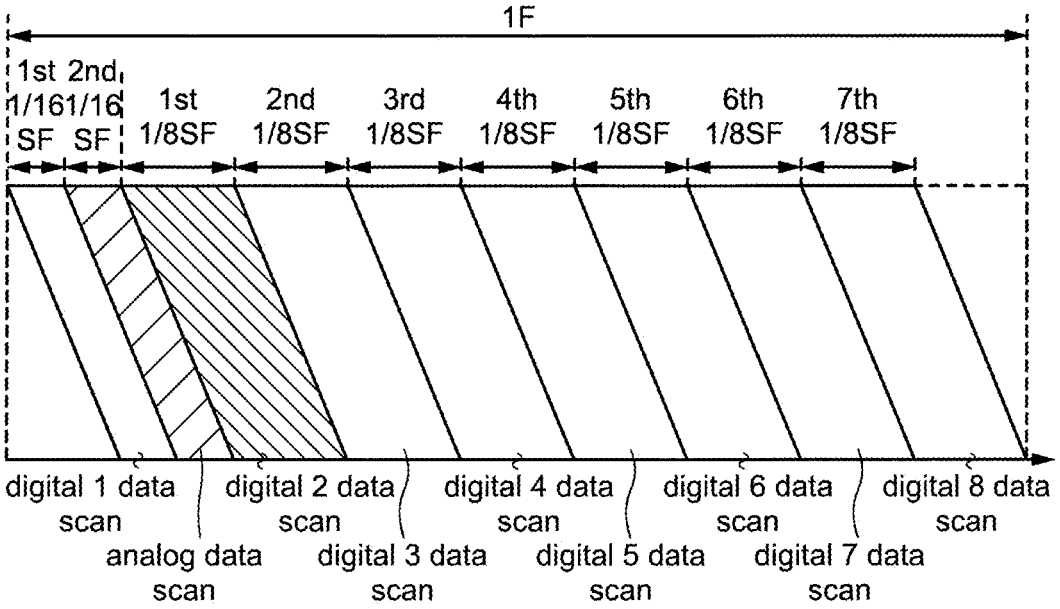
FIG. 22C is a diagram showing a gray-scale (3/16) when a light-emitting device according to an embodiment of the present invention is made to emit light or not to emit light.
Figure 22D:
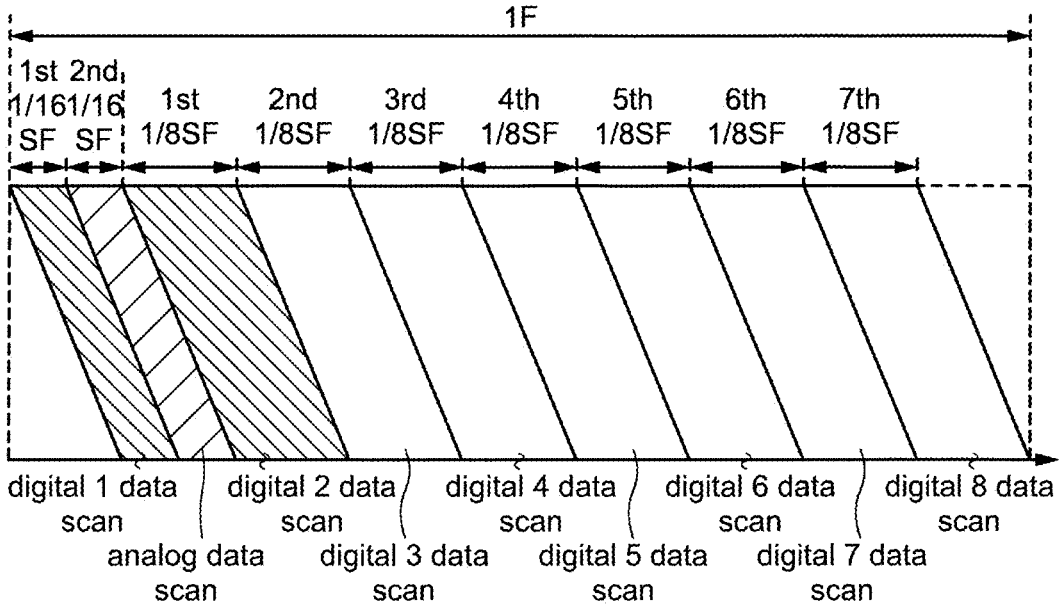
FIG. 22D is a diagram showing a gray-scale (4/16) when a light-emitting device according to an embodiment of the present invention is made to emit light or not to emit light.

As shown in FIG. 22C and FIG. 22D, by further combining the second digital data scan in the first 1/8SF period in a light-emitting mode of the FIG. 22B, the light emission of the third step (third level) and the fourth step (fourth level) of the 4 bits (16 steps) is realized.

FIG. 22C shows the third step (third level) of the 16 steps. More specifically, in the third level, in the analog data scan period in the second 1/16SF period, the pixel emits light based on the analog data, in the first digital data scan period in the first 1/16SF period, the pixel does not emit light based on digital signal, and, in the second digital data scan period in the first 1/8SF period, the pixel emits light based on the digital signal. The third step of the 4 bits (16 steps) is 3/16.

FIG. 22D shows the fourth step (fourth level) of the 16 steps. More specifically, in the fourth level, in the analog data scan period in the second 1/16SF period, the pixel emits light based on the analog data, in the first digital data scan period in the first 1/16SF period, the pixel emits light based on the digital signal, and, in the second digital data scan period in the first 1/8SF period, the pixel emits light based on the digital signal. The fourth step of the 4 bits (16 steps) is 4/16.

Figure 23A:
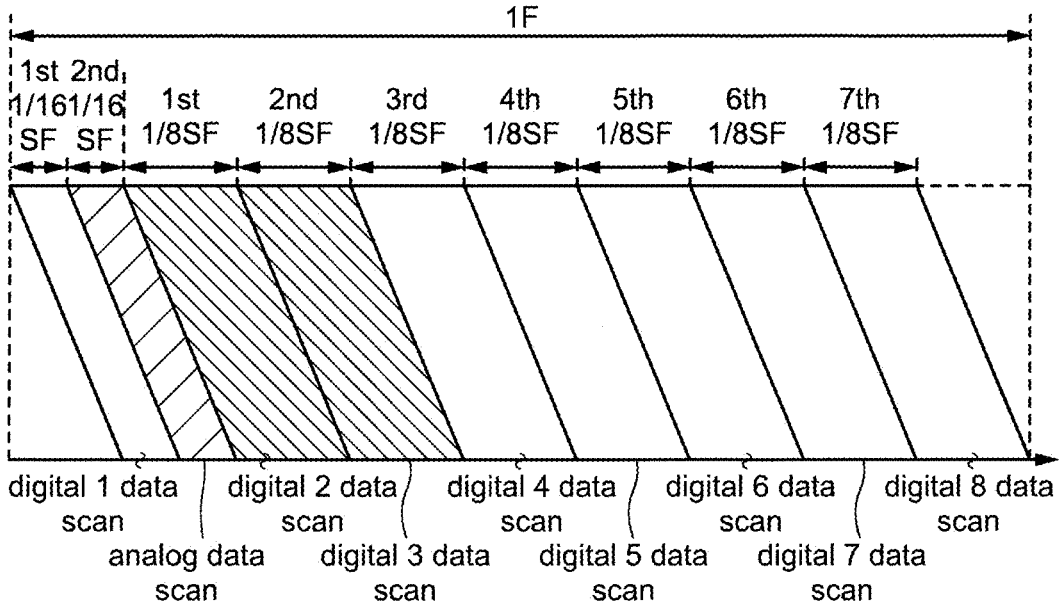
FIG. 23A is a diagram showing a gray-scale (5/16) when a light-emitting device according to an embodiment of the present invention is made to emit light or not to emit light.
Figure 23B:
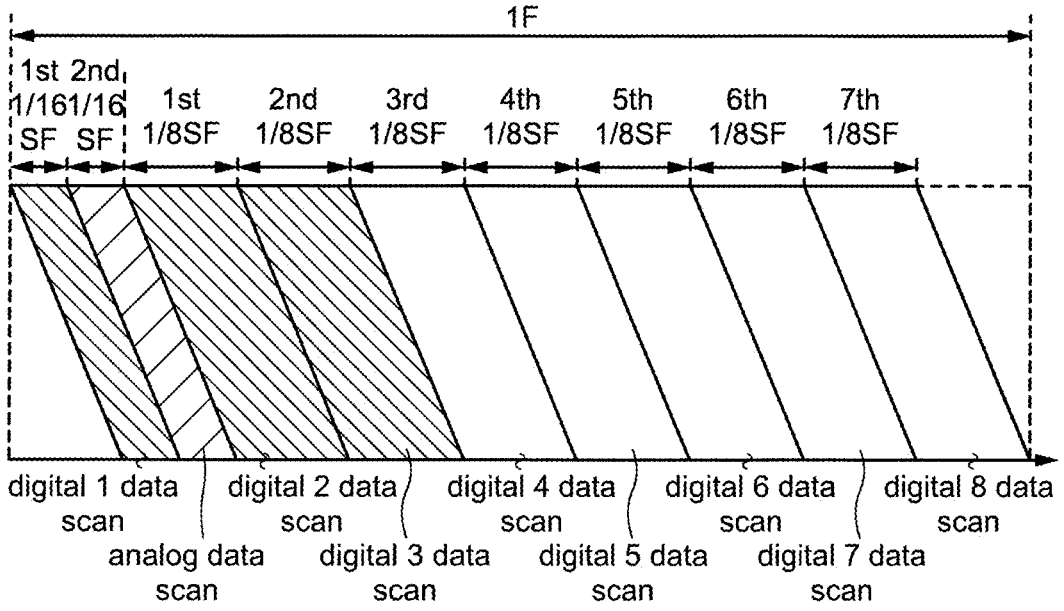
FIG. 23B is a diagram showing a gray-scale (6/16) when a light-emitting device according to an embodiment of the present invention is made to emit light or not to emit light.

As shown in FIG. 23A and FIG. 23B, by further combining the third digital data scan in the second 1/8SF period in a light-emitting mode of the FIG. 22D, the light emission of the fifth step and the sixth step of the of the 4 bits (16 steps) is realized.

FIG. 23A shows the fifth step (fifth level) of the above 16 steps. More specifically, in the fifth level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, and, in the third digital data scan period in the second 1/8SF period, the pixel emits light based on digital signal. The fifth step of the 4 bits (16 steps) is 5/16.

FIG. 23B shows the sixth step (sixth level) of the above 16 steps. More specifically, in the sixth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, and, in the third digital data scan period in the second 1/8SF period, the pixel emits light based on digital signal. The sixth step of the 4 bits (16 steps) is 6/16.

Figure 23C:
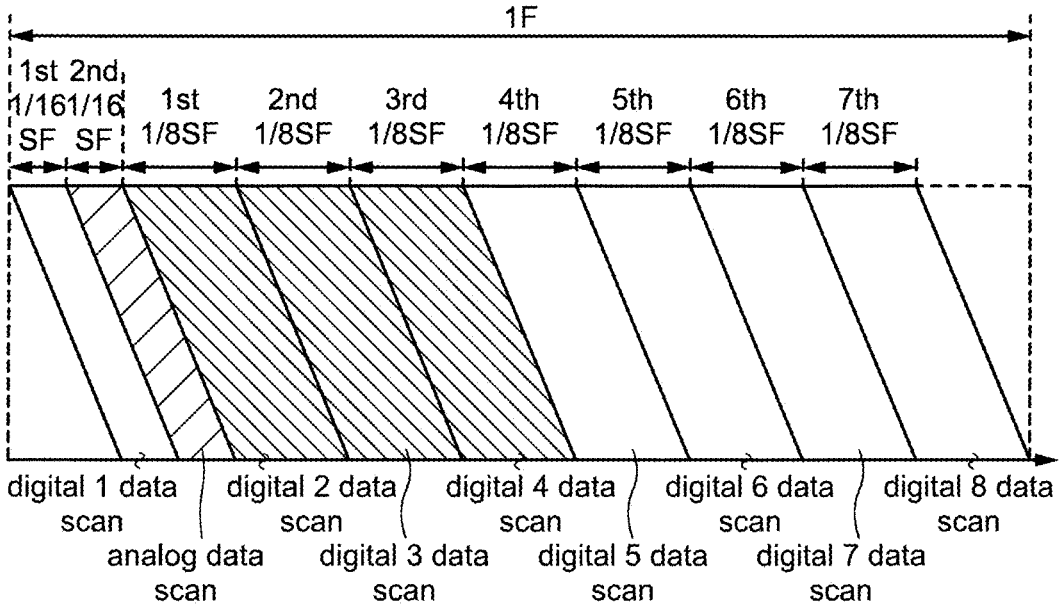
FIG. 23C is a diagram showing a gray-scale (7/16) when a light-emitting device according to an embodiment of the present invention is made to emit light or not to emit light.
Figure 23D:
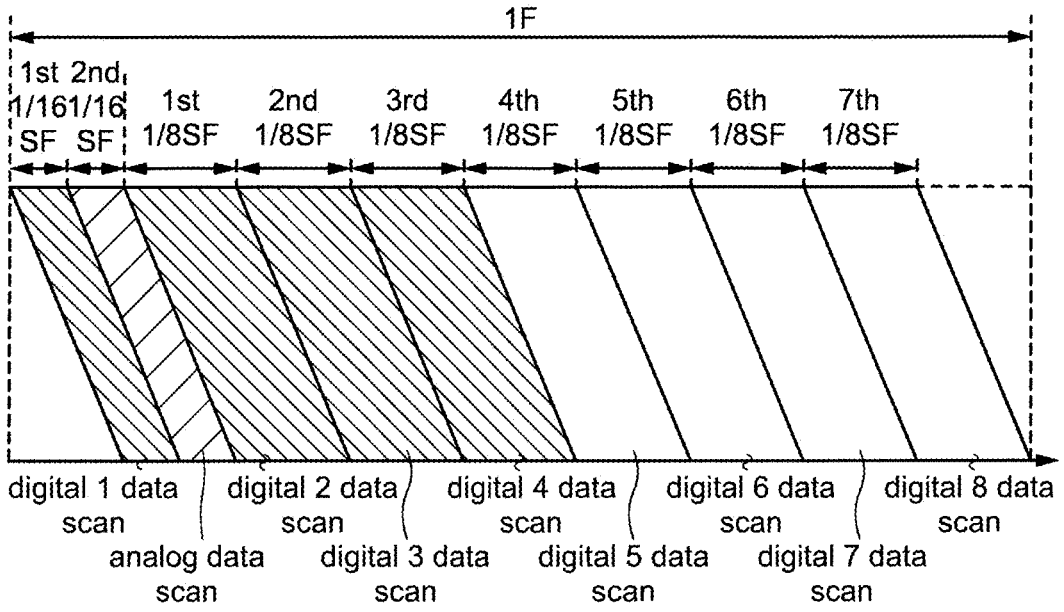
FIG. 23D is a diagram showing a gray-scale (8/16) when a light-emitting device according to an embodiment of the present invention is made to emit light or not to emit light.

As shown in FIG. 23C and FIG. 23D, by further combining the fourth digital data scan in the third 1/8SF period in a light emission mode of FIG. 23B, the light emission of the seventh step and the eighth step of the 4 bits (16 steps) is realized.

FIG. 23C shows the seventh step (seventh level) of the above 16 steps. More specifically, in the seventh level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, in the third digital data scan period in the second 1/8SF period, the pixel emits light based on the digital signal, and, in the fourth digital data scan period in the third 1/8SF period, the pixel emits light based on the digital signal. The seventh step of the 4 bits (16 steps) is 7/16.

FIG. 23D shows the eighth step (eighth level) of the above 16 steps. More specifically, in the eighth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, in the third digital data scan period in the second 1/8SF period, the pixel emits light based on the digital signal, and, the fourth digital data scan in the second 1/8SF period emits light. The eighth step of the 4 bits (16 steps) is 8/16.

Similar to FIGS. 22A to 23D, FIG. 24A shows the ninth step (ninth level) of the 16 steps. More specifically, in the ninth level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the third 1/8SF period, the pixel emits light based on the digital signal, in the fifth digital data scan period in the fourth 1/8SF period, the pixel emits light based on the digital signal. The ninth step of the 4 bits (16 steps) is 9/16.

Figure 24A:
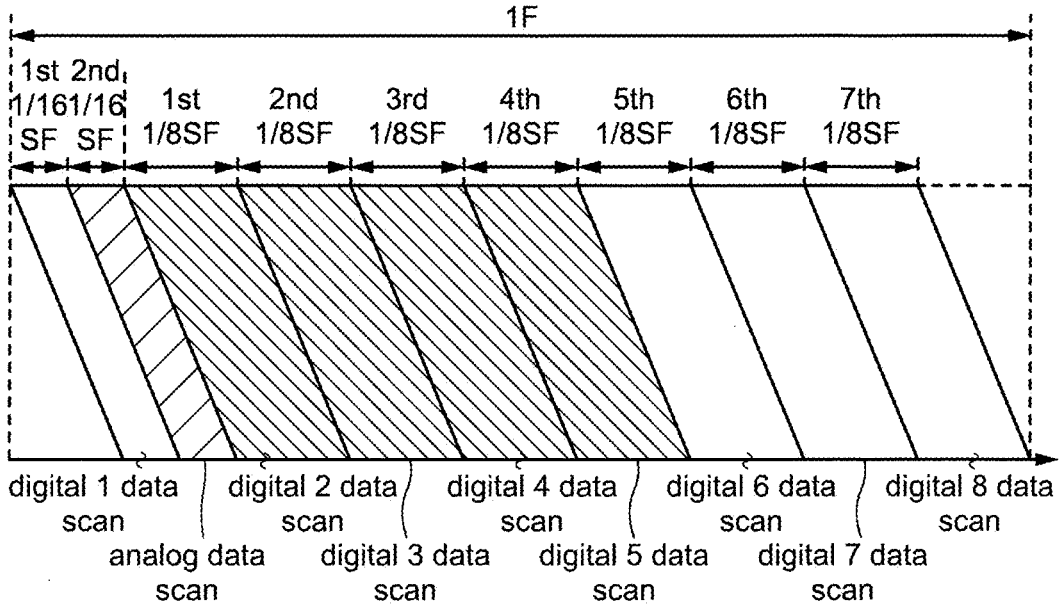
FIG. 24A is a diagram showing a gray-scale (9/16) when a light-emitting device according to an embodiment of the present invention is made to emit light or not to emit light.
Figure 24B:
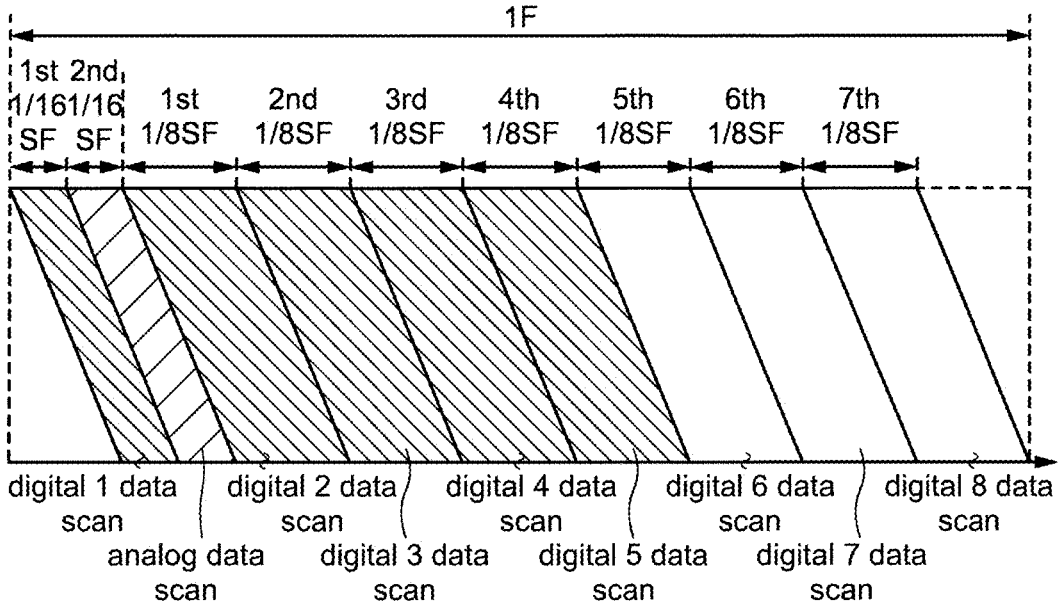
FIG. 24B is a diagram showing a gray-scale (10/16) when a light-emitting device according to an embodiment of the present invention is made to emit light or not to emit light.
Figure 24C:
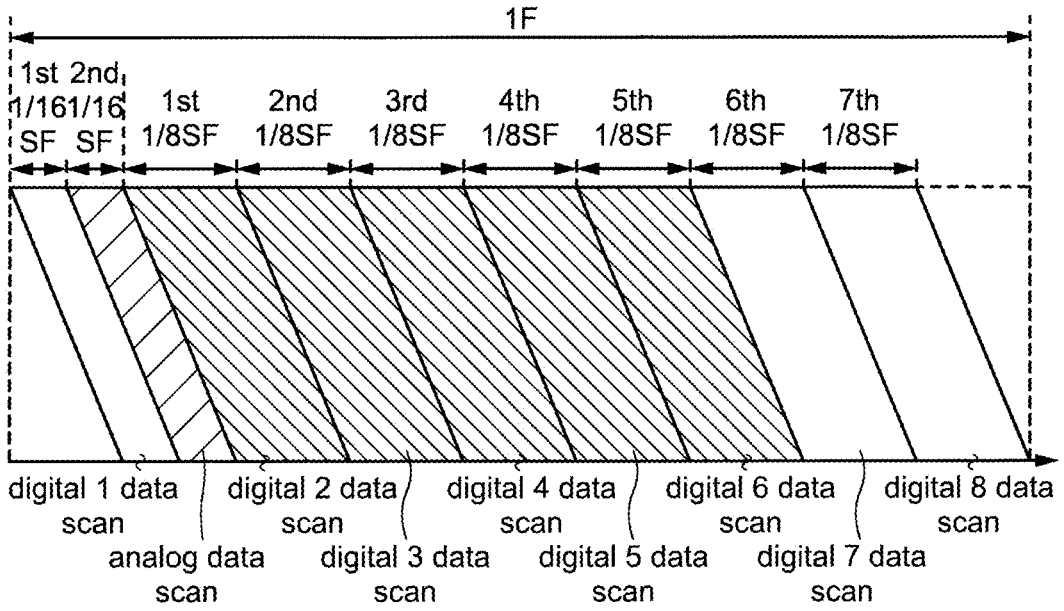
FIG. 24C is a diagram showing a gray-scale (11/16) when a light-emitting device according to an embodiment of the present invention is made to emit light or not to emit light.

FIG. 24B shows the tenth step (tenth level) of the 16 steps. More specifically, in the tenth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the second 1/8SF period, the pixel emits light based on the digital signal, in the fifth digital data scan period in the fourth 1/8SF period, the pixel emits light based on the digital signal. The tenth step of the 4 bits (16 steps) is 10/16.

Similar to FIGS. 22A to 23D, FIG. 24C shows the eleventh step (eleventh level) of the 16 steps. More specifically, in the eleventh level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the third 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal. The eleventh step of the 4 bits (16 steps) is 11/16.

Figure 24D:
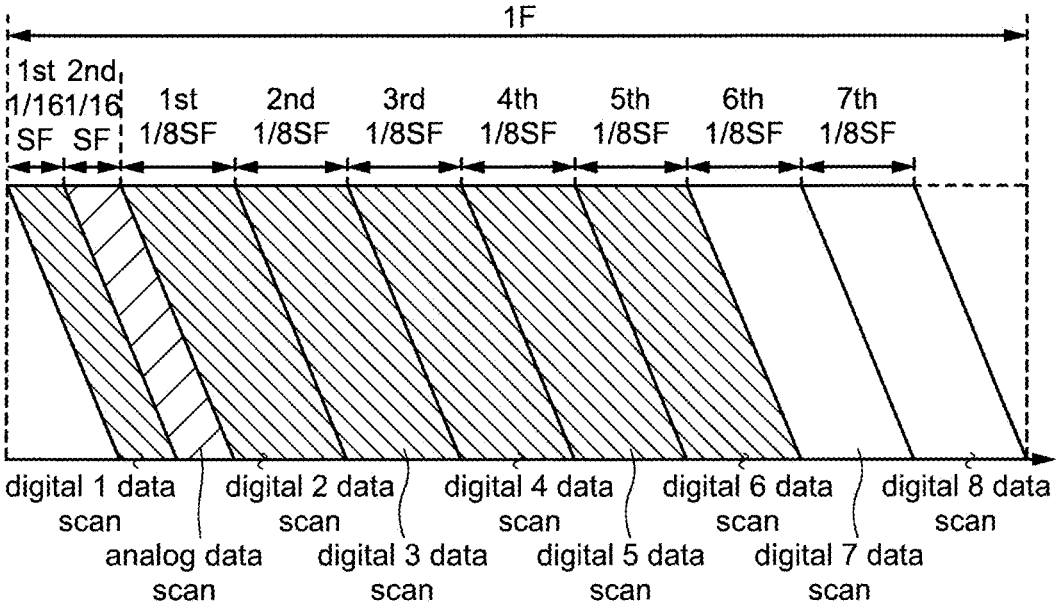
FIG. 24D is a diagram showing a gray-scale (12/16) when a light-emitting device according to an embodiment of the present invention is made to emit light or not to emit light.

FIG. 24D shows the twelfth step (twelfth level) of the 16 steps. More specifically, in the twelfth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the third 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal. The twelfth step of the 4 bits (16 steps) is 12/16.

Similar to FIGS. 22A to 23D, FIG. 25A shows the thirteenth step (thirteenth level) of the 16 steps. More specifically, in the thirteenth level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the third 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal, in the seventh digital data scan period in the sixth 1/8SF period, the pixel emits light based on the digital signal. The thirteenth step of the 4 bits (16 steps) is 13/16.

Figure 25A:
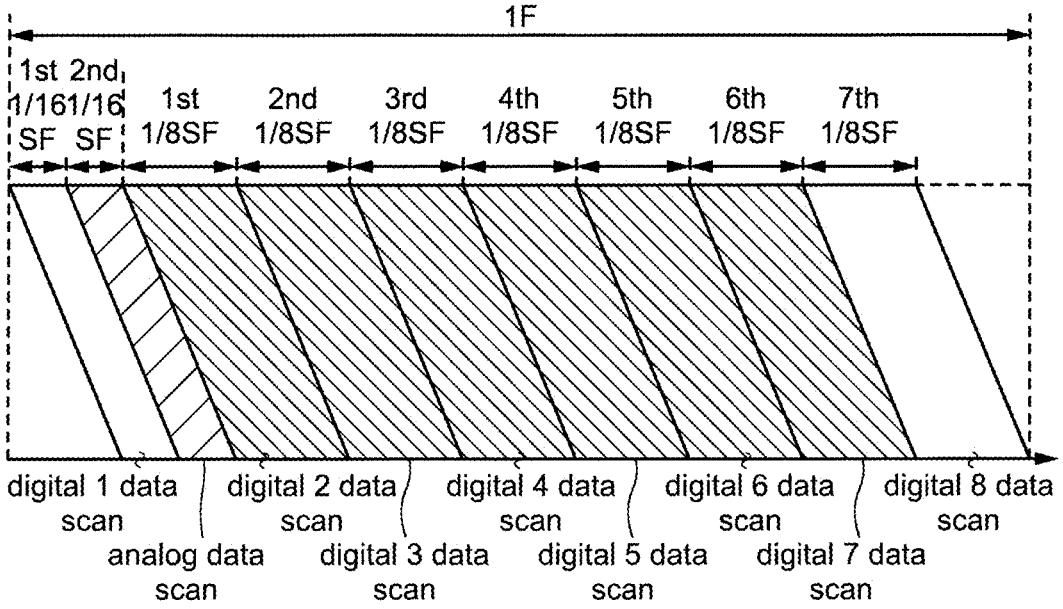
FIG. 25A is a diagram showing a gray-scale (13/16) when a light-emitting device according to an embodiment of the present invention is made to emit light or not to emit light.
Figure 25B:
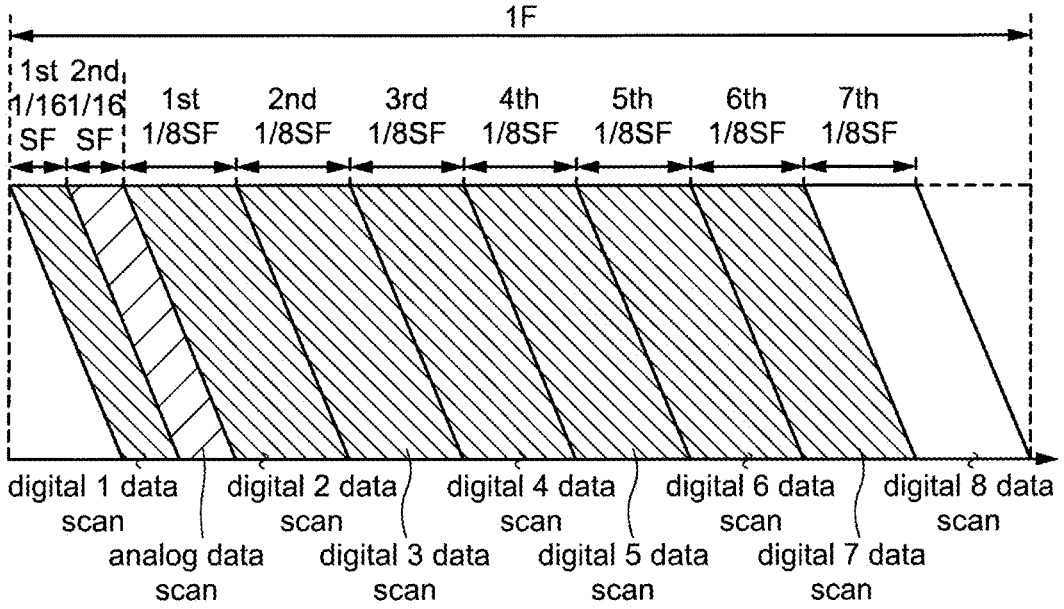
FIG. 25B is a diagram showing a gray-scale (14/16) when a light-emitting device according to an embodiment of the present invention is made to emit light or not to emit light.
Figure 25C:
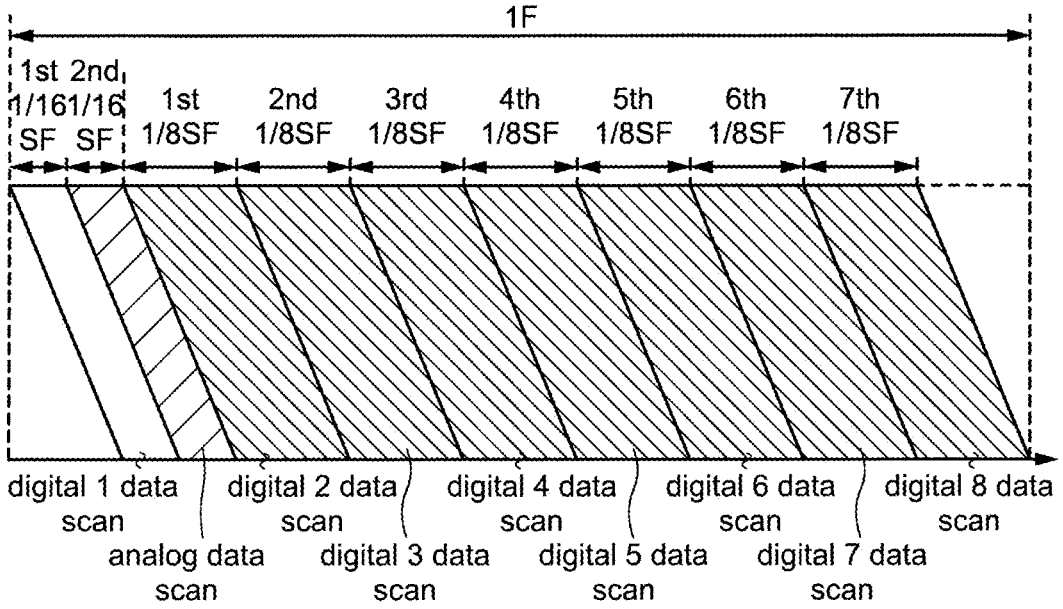
FIG. 25C is a diagram showing a gray-scale (15/16) when a light-emitting device according to an embodiment of the present invention is made to emit light or not to emit light.

FIG. 25B shows the fourteenth step (fourteenth level) of the 16 steps. More specifically, in the fourteenth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the second 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal, in the seventh digital data scan period in the sixth 1/8SF period, the pixel emits light based on the digital signal. The fourteenth step of the 4 bits (16 steps) is 14/16.

Similar to FIGS. 22A to 23D, FIG. 25B shows the fifteenth step (fifteenth level) of the 16 steps. More specifically, in the fifteenth level, in the analog data scan period in the second 1/16SF period, the pixel emits light based on the analog data, in the first digital data scan period in the first 1/16SF period, the pixel does not emit light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the third 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal, in the seventh digital data scan period in the sixth 1/8SF period, the pixel emits light based on the digital signal, in the eighth digital data scan period in the seventh 1/8SF, the pixel emits light based on the digital signal. The fifteenth step of the 4 bits (16 steps) is 15/16.

Figure 25D:
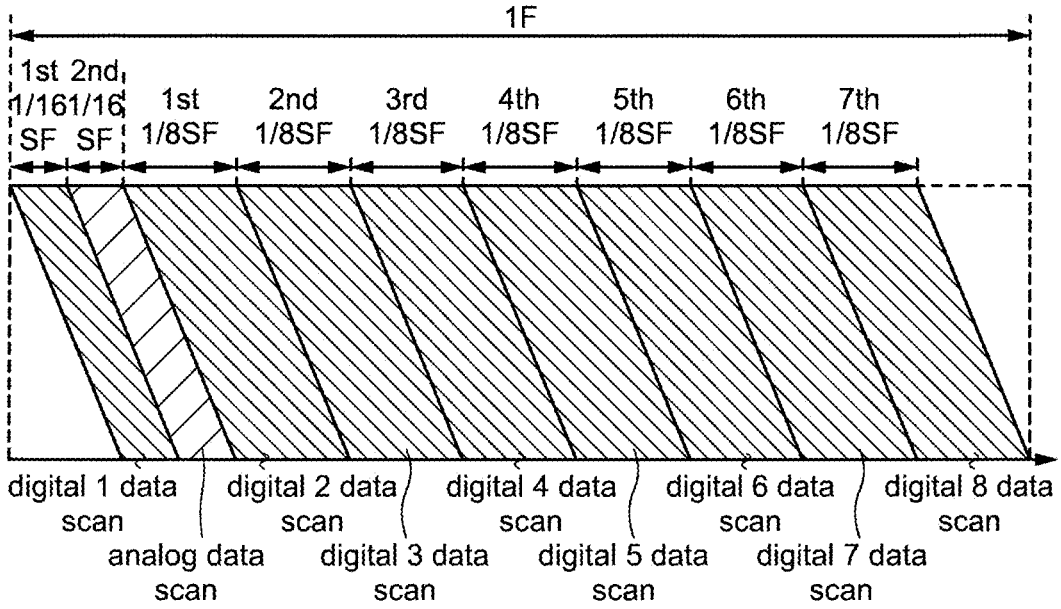
FIG. 25D is a diagram showing a gray-scale (16/16) when a light-emitting device according to an embodiment of the present invention is made to emit light or not to emit light.

FIG. 25D shows the sixteenth step (sixteenth level) of the 16 steps. More specifically, in the sixteenth level, in the analog data scan period in the second 1/16SF period, the pixel emits light based on the analog data, in the first digital data scan period in the first 1/16SF period, the pixel emits light based on the digital signal, in the second digital data scan period in the first 1/8SF period, the pixel emits light based on the digital signal, in the third digital data scan period in the second 1/8SF period, the pixel emits light based on the digital signal, in the fourth digital data scan period in the second 1/8SF period, the pixel emits light based on the digital signal, in the fifth digital data scan period in the fourth 1/8SF period, the pixel emits light based on the digital signal, in the sixth digital data scan period in the fifth 1/8SF period, the pixel emits light based on the digital signal, in the seventh digital data scan period in the sixth 1/8SF period, the pixel emits light based on the digital signal, in the eighth digital data scan period in the seventh 1/8SF, the pixel emits light based on the digital signal. The sixteenth step of the 4 bits (16 steps) is 16/16.

As described above, 16 steps of gray-scale can be scanned, and an image can be displayed on the display section 104 by using the light-emitting device 10B and the driving method of the light-emitting device 10B according to an embodiment of the present invention.

5. Fifth Embodiment

Figure 26:
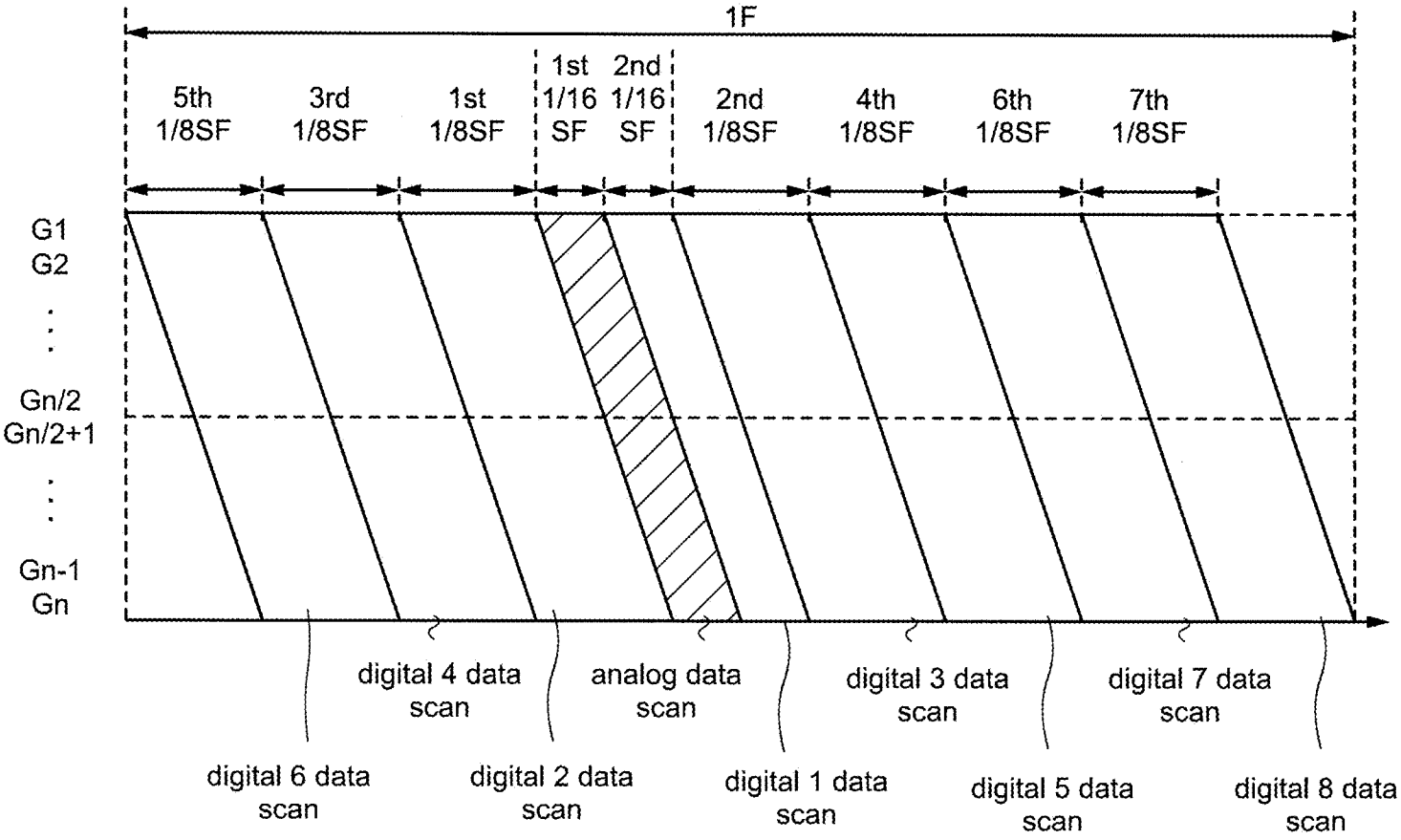
FIG. 26 is a timing chart for explaining a driving method of a light-emitting device according to an embodiment of the present invention.

FIG. 26 is a timing chart for explaining a driving method of the light-emitting device 10B according to an embodiment of the present invention. FIGS. 27A to 30D are diagrams showing gray-scales when the light-emitting device 10B according to an embodiment of the present invention is made to emit light or not to emit light. FIGS. 31 to 34 are diagrams showing gray-scales of the pixels according to an embodiment of the present invention and data corresponding to each gray-scale. The driving method or the like of the light-emitting device 10B shown in FIGS. 26 to 34 are examples, and the driving method or the like of the light-emitting device 10B are not limited to the configurations shown in FIGS. 26 to 34. Description of the same or similar components as those of the first to fourth embodiments is omitted here.

Since the configuration of the light-emitting device 10B according to an embodiment of the present invention can be the same as that of the fourth embodiment, the explanation thereof is omitted here.

Comparing the configurations of the light emitting device and the driving method of the same according to the embodiment of the present invention shown in FIGS. 26 to 30D with the configurations of the light emitting device and the driving method of the same according to the embodiment of the present invention shown in FIGS. 20 and 22 to 25, the order in which the analog data scan period and the first to seventh digital data scan periods within 1F period is different.

More specifically, as shown in FIGS. 26, and 27A to 30D, the analog data scan is performed in the center or approximate center sub-frame within the 1F period, the first digital data scan (1st digital data scan, digital 1 data scan, D1) is performed in the sub-frame to the right of the center with respect to the analog data scan, the second digital data scan (2nd digital data scan, digital 2 data scan, D2) is performed in the sub-frame to the left of the center with respect to the analog data scan, the third digital data scan (3rd digital data scan, digital 3 data scan, D3) to the sixth digital data scan (6th digital data scan, digital 6 data scan, D6) are performed alternately, such as the sub-frame further to the right of the center with respect to the analog data scan and the sub-frame further to the left of the center with respect to the analog data scan, and the seventh digital data scan (7th digital data scan, digital 7 data scan, D7) is adjacent to the sub-frame performing the sixth digital data scan (6th digital data scan, digital 6 data scan, D6) and the seventh digital data scan is performed in the sub-frame further to the left of the center.

Figure 27A:
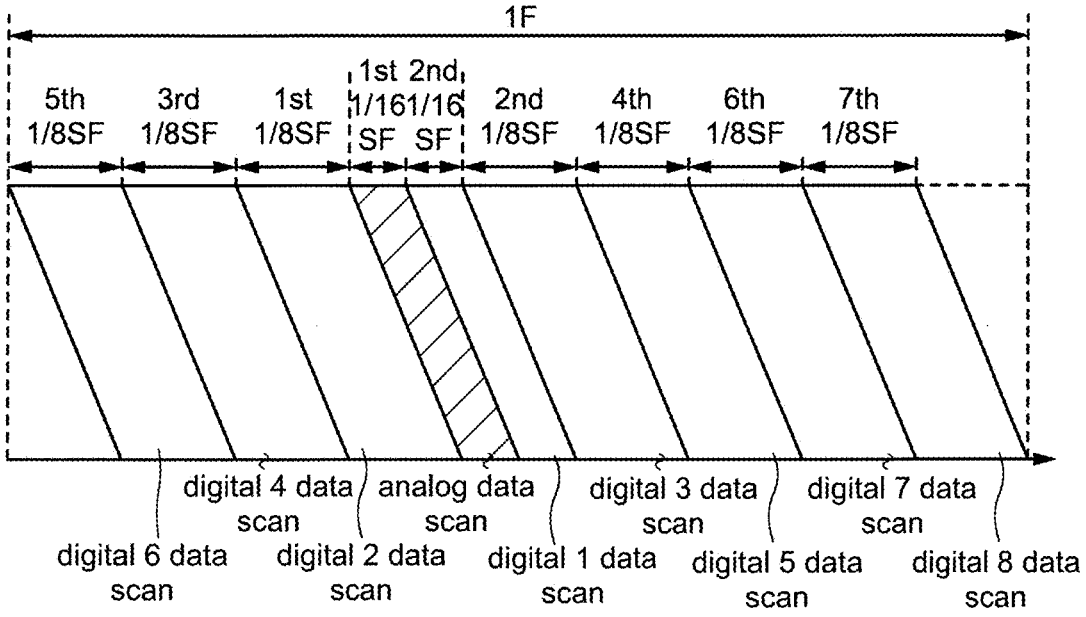
FIG. 27A is a diagram showing a gray-scale (1/16) when a light-emitting device according to an embodiment of the present invention is made to emit light or not to emit light.

More specifically, as shown in FIG. 27A, the analog data scan period in the first 1/16SF period is provided in the center or approximate center sub-frame period within the 1F period. The first step (first level) of 16 steps is shown in FIG. 27A, similar to the first level configuration shown in FIG. 22A. In the first level, in the analog data scan period in the first 1/16SF period, the pixels emit light based on the analog data. The first step of the 4 bits (16 steps) is 1/16.

Figure 27B:
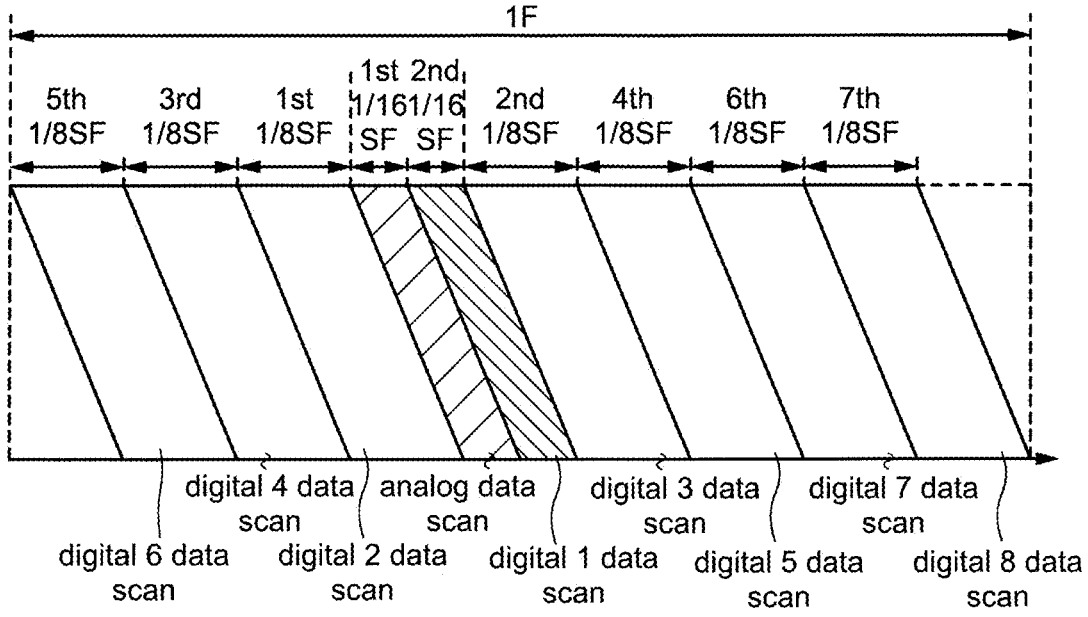
FIG. 27B is a diagram showing a gray-scale (2/16) when a light-emitting device according to an embodiment of the present invention is made to emit light or not to emit light.

As shown in FIG. 27B, the first digital data scan (1st digital data scan, digital 1 data scan, D1) period in the second 1/16SF period is provided in the sub-frame period left of the center or approximate center with respect to the analog data scan period. The second step (second level) of 16 steps is shown in FIG. 27B, similar to the configuration of the second level shown in FIG. 22B. In the second level, in the analog data scan period in the first 1/16SF period, the pixels emit light based on the analog data, and, in the first digital data scan period in the second 1/16SF period, the pixels emit light based on the digital signal. The second step of the 4 bits (16 steps) is 2/16.

Figure 27C:
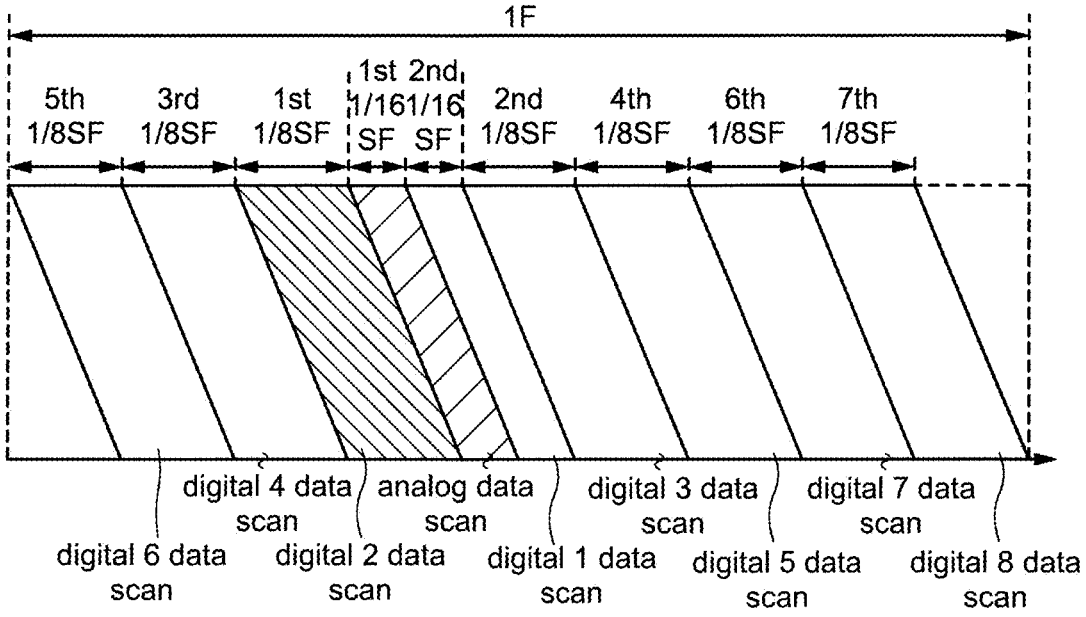
FIG. 27C is a diagram showing a gray-scale (3/16) when a light-emitting device according to an embodiment of the present invention is made to emit light or not to emit light.
Figure 27D:
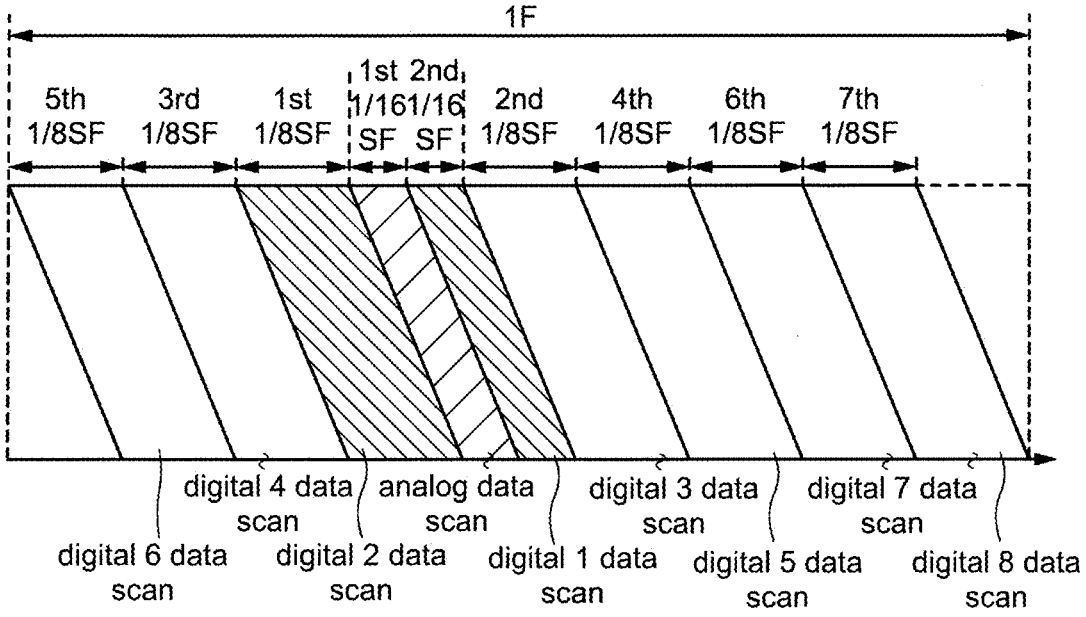
FIG. 27D is a diagram showing a gray-scale (4/16) when a light-emitting device according to an embodiment of the present invention is made to emit light or not to emit light.

As shown in FIGS. 27C and 27D, the second digital data scan (2nd digital data scan, digital 2 data scan, D2) period in the first 1/8SF period is provided in the sub-frame period left of the center or approximate center with respect to the analog data scan period. The third step of 16 steps (third level, 3/16) is shown in FIG. 27C, similar to the configuration of the third level shown in FIG. 22C. The fourth step of 16 steps (fourth level, 4/16) is shown in FIG. 27D, similar to the configuration of the fourth level shown in FIG. 22D.

Figure 28A:
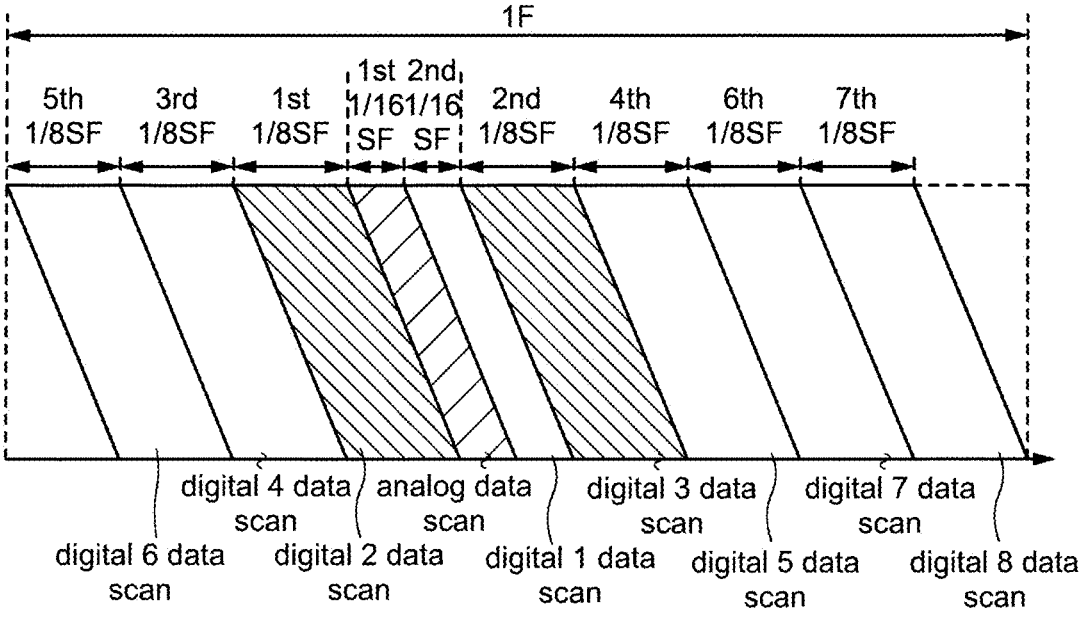
FIG. 28A is a diagram showing a gray-scale (5/16) when a light-emitting device according to an embodiment of the present invention is made to emit light or not to emit light.
Figure 28B:
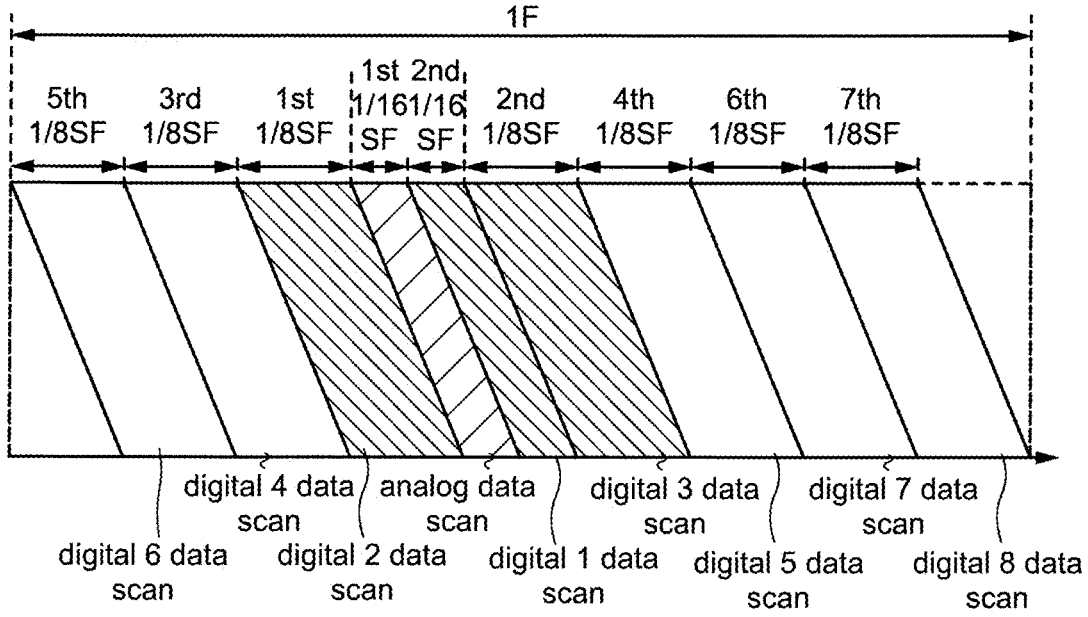
FIG. 28B is a diagram showing a gray-scale (6/16) when a light-emitting device according to an embodiment of the present invention is made to emit light or not to emit light.

As shown in FIGS. 28A and 28B, the third digital data scan period (3rd digital data scan, digital 3 data scan, D3) in the second 1/8SF period is provided in a sub-frame period on the side opposite to the side where the analog data scan period is provided with respect to the first digital data scan period. The fifth step of 16 steps (fifth level, 5/16) is shown in FIG. 28A, similar to the configuration of the fifth level shown in FIG. 23A. The sixth step of 16 steps (sixth level, 6/16) is shown in FIG. 28B, similar to the configuration of the sixth level shown in FIG. 23B.

Figure 28C:
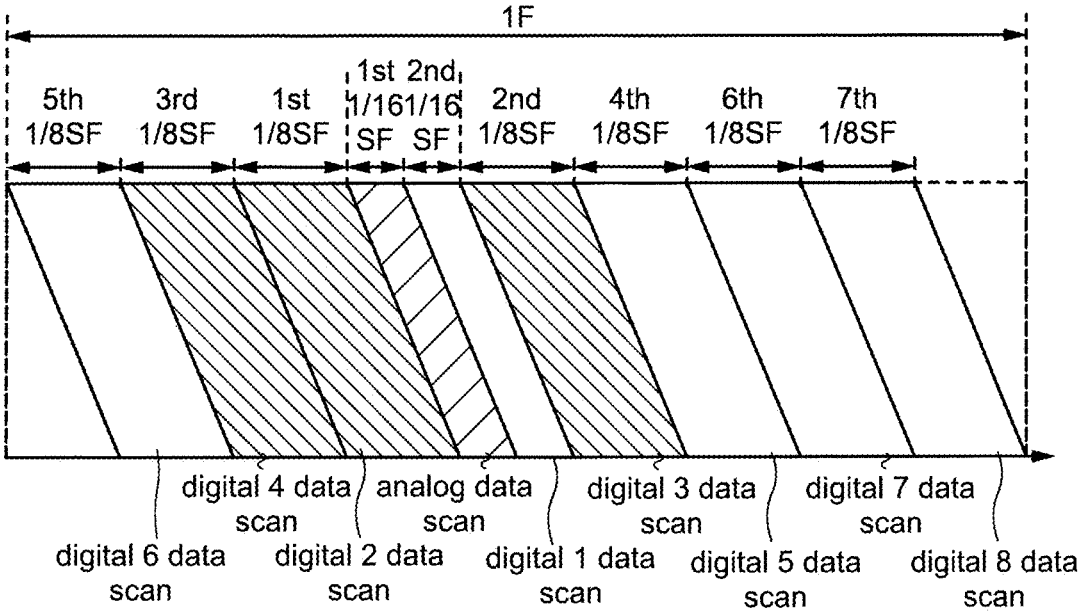
FIG. 28C is a diagram showing a gray-scale (7/16) when a light-emitting device according to an embodiment of the present invention is made to emit light or not to emit light.
Figure 28D:
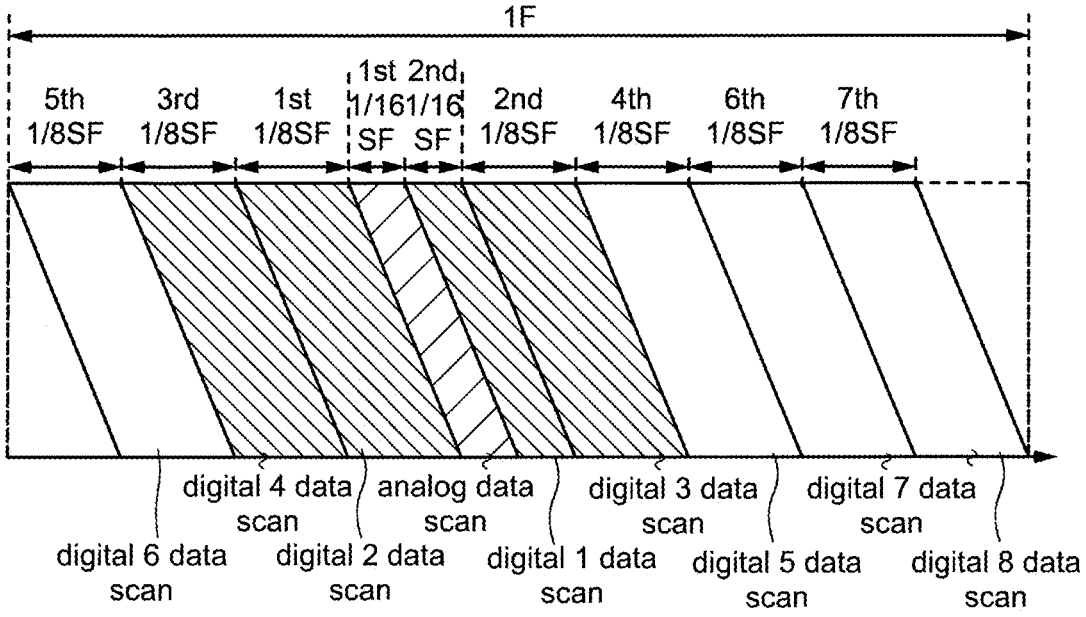
FIG. 28D is a diagram showing a gray-scale (8/16) when a light-emitting device according to an embodiment of the present invention is made to emit light or not to emit light.

As shown in FIGS. 28C and 28D, the fourth digital data scan period (4th digital data scan, digital 4 data scan, D4) in the fourth 1/8SF period is provided in a sub-frame period on the side opposite to the side where the analog data scan period is provided with respect to the second digital data scan period. The seventh step of 16 steps (fifth level, 7/16) is shown in FIG. 28C, similar to the configuration of the seventh level shown in FIG. 23C. The eighth step of 16 steps (eighth level, 8/16) is shown in FIG. 28D, similar to the configuration of the eighth level shown in FIG. 23D.

Figure 29A:
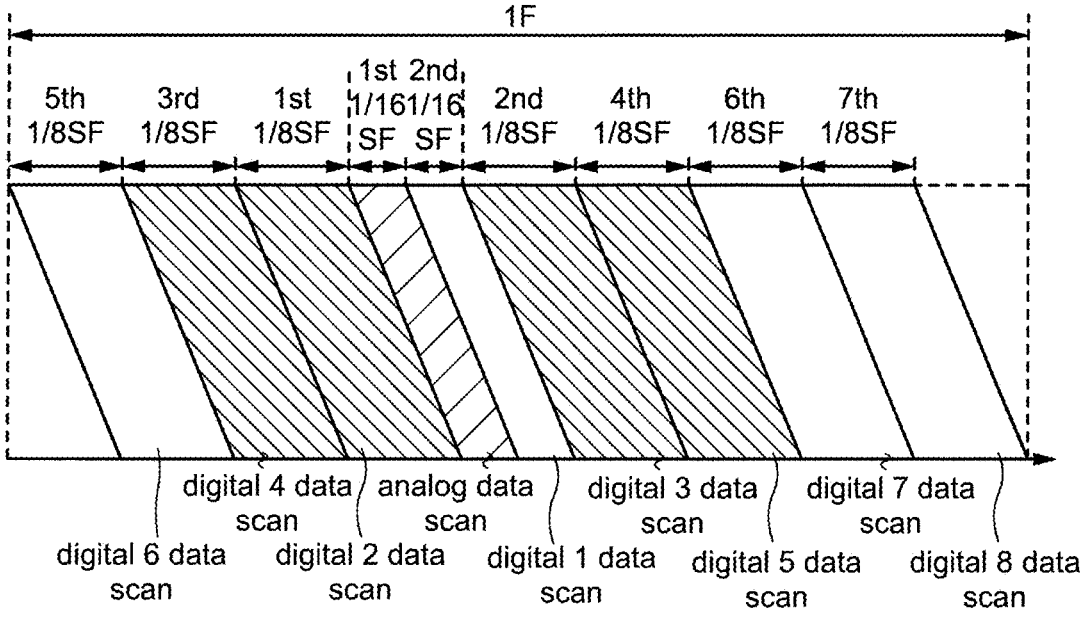
FIG. 29A is a diagram showing a gray-scale (9/16) when a light-emitting device according to an embodiment of the present invention is made to emit light or not to emit light.
Figure 29B:
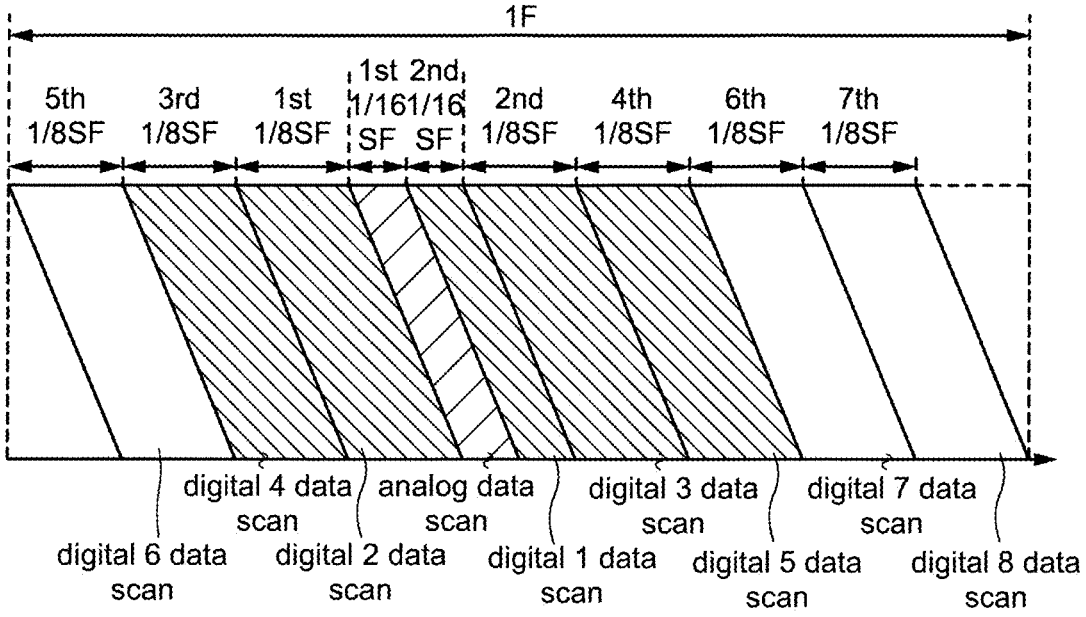
FIG. 29B is a diagram showing a gray-scale (10/16) when a light-emitting device according to an embodiment of the present invention is made to emit light or not to emit light.

As shown in FIGS. 29A and 29B, the fifth digital data scan period (5th digital data scan, digital 5 data scan, D5) in the fourth 1/8SF period is provided in a sub-frame period on the side opposite to the side where the analog data scan period is provided with respect to the first digital data scan period. The ninth step of 16 steps (ninth level, 9/16) is shown in FIG. 29A, similar to the configuration of the ninth level shown in FIG. 24A. The tenth step of 16 steps (tenth level, 10/16) is shown in FIG. 29B, similar to the configuration of the tenth level shown in FIG. 24B.

Figure 29C:
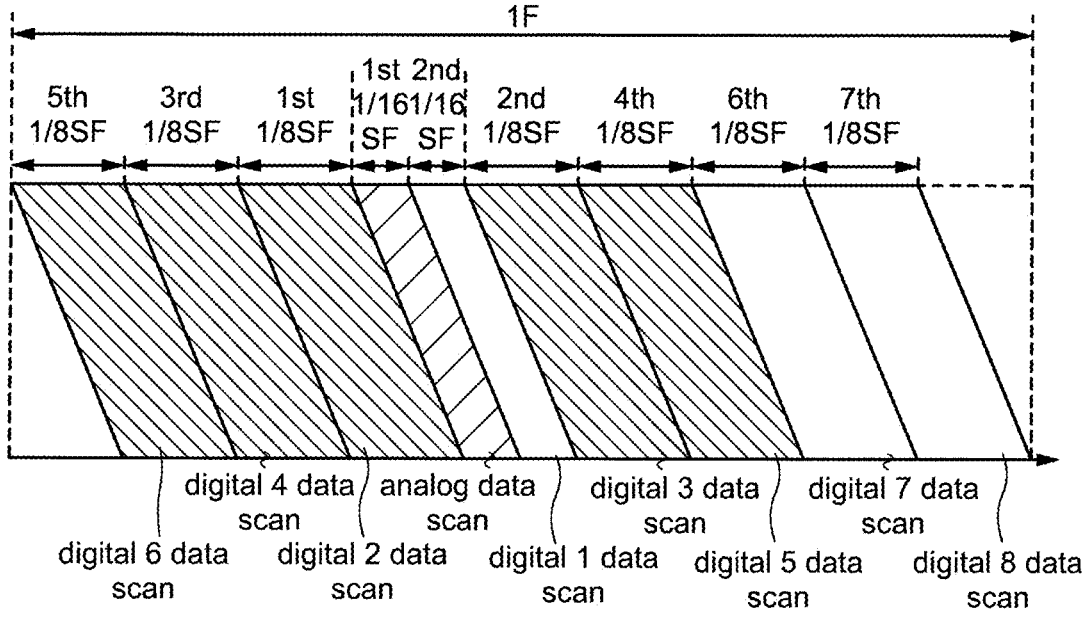
FIG. 29C is a diagram showing a gray-scale (11/16) when a light-emitting device according to an embodiment of the present invention is made to emit light or not to emit light.
Figure 29D:
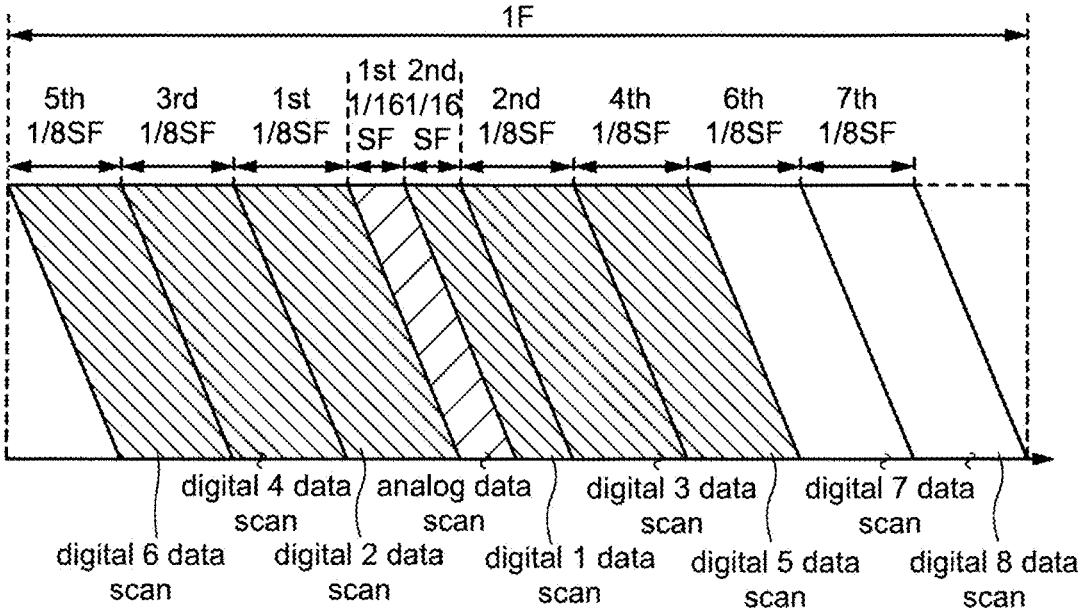
FIG. 29D is a diagram showing a gray-scale (12/16) when a light-emitting device according to an embodiment of the present invention is made to emit light or not to emit light.

As shown in FIGS. 29C and 29D, the fifth digital data scan period (6th digital data scan, digital 6 data scan, D6) in the fifth 1/8SF period is provided in a sub-frame period on the side opposite to the side where the analog data scan period is provided with respect to the fourth digital data scan period. The eleventh step of 16 steps (eleventh level, 11/16) is shown in FIG. 29C, similar to the configuration of the eleventh level shown in FIG. 24C. The twelfth step of 16 steps (twelfth level, 12/16) is shown in FIG. 29D, similar to the configuration of the sixteenth step shown in FIG. 24D.

Figure 30A:
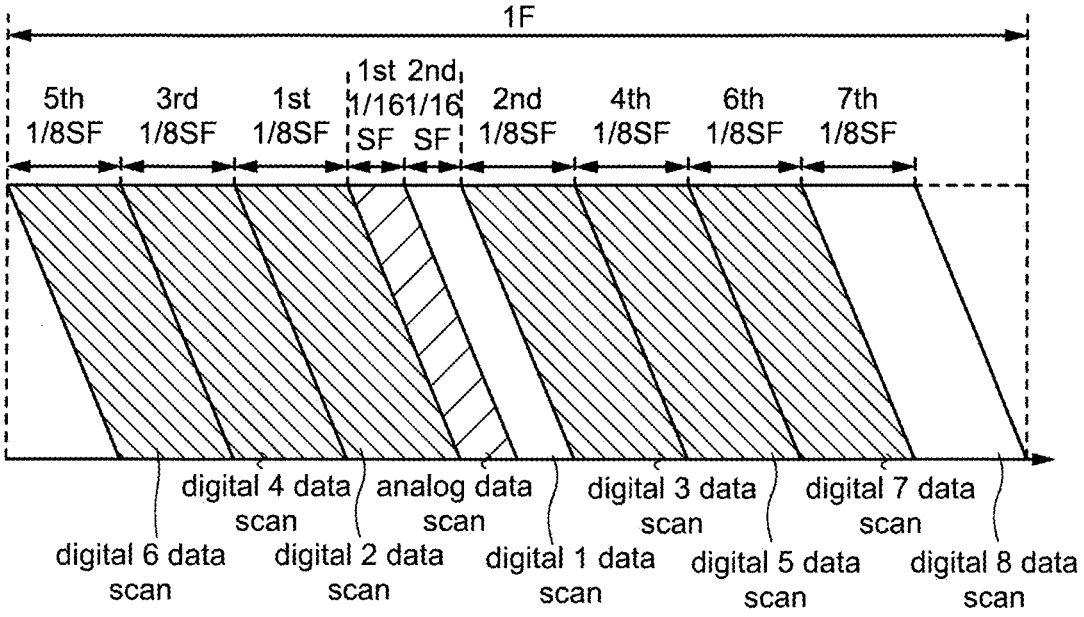
FIG. 30A is a diagram showing a gray-scale (13/16) when a light-emitting device according to an embodiment of the present invention is made to emit light or not to emit light.
Figure 30B:
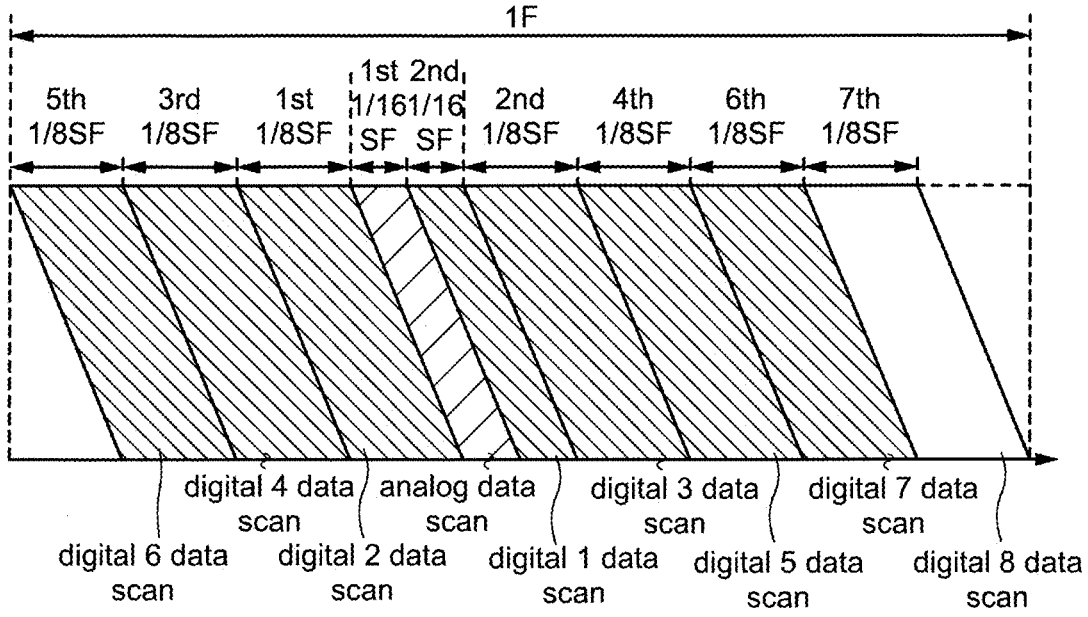
FIG. 30B is a diagram showing a gray-scale (14/16) when a light-emitting device according to an embodiment of the present invention is made to emit light or not to emit light.

As shown in FIGS. 30A and 30B, the seventh digital data scan period (7th digital data scan, digital 7 data scan, D7) in the sixth 1/8SF period is provided in a sub-frame period on the side opposite to the side where the analog data scan period is provided with respect to the third digital data scan period. The thirteenth step of 16 steps (thirteenth level, 13/16) is shown in FIG. 30A, similar to the configuration of the thirteenth level shown in FIG. 25A. The fourteenth step of 16 steps (fourteenth level, 14/16) is shown in FIG. 30B, similar to the configuration of the fourteenth step shown in FIG. 25B.

Figure 30C:
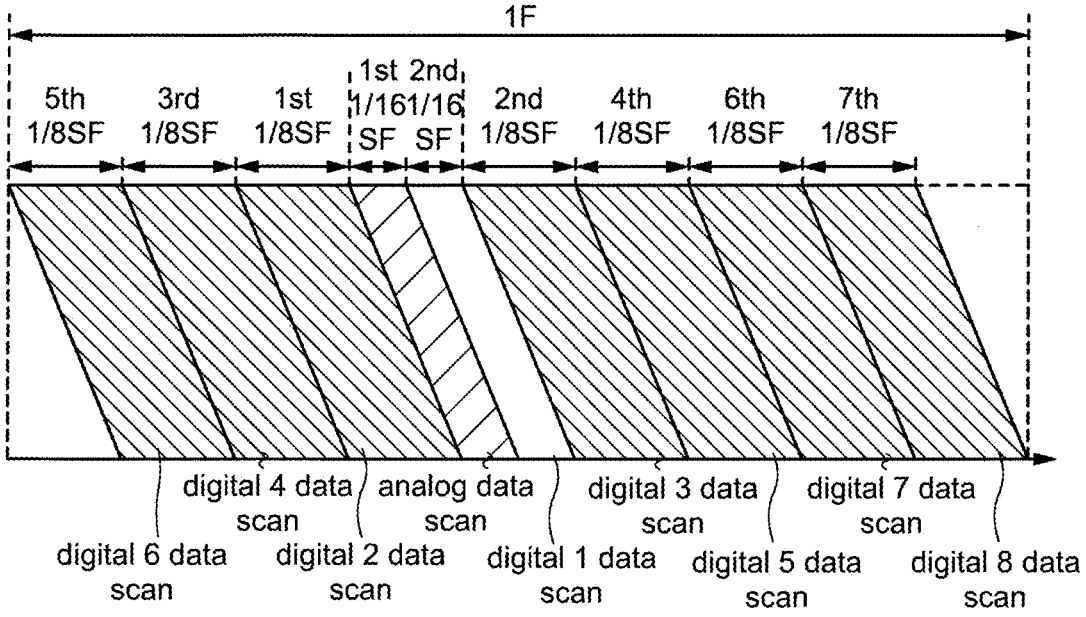
FIG. 30C is a diagram showing a gray-scale (15/16) when a light-emitting device according to an embodiment of the present invention is made to emit light or not to emit light.
Figure 30D:
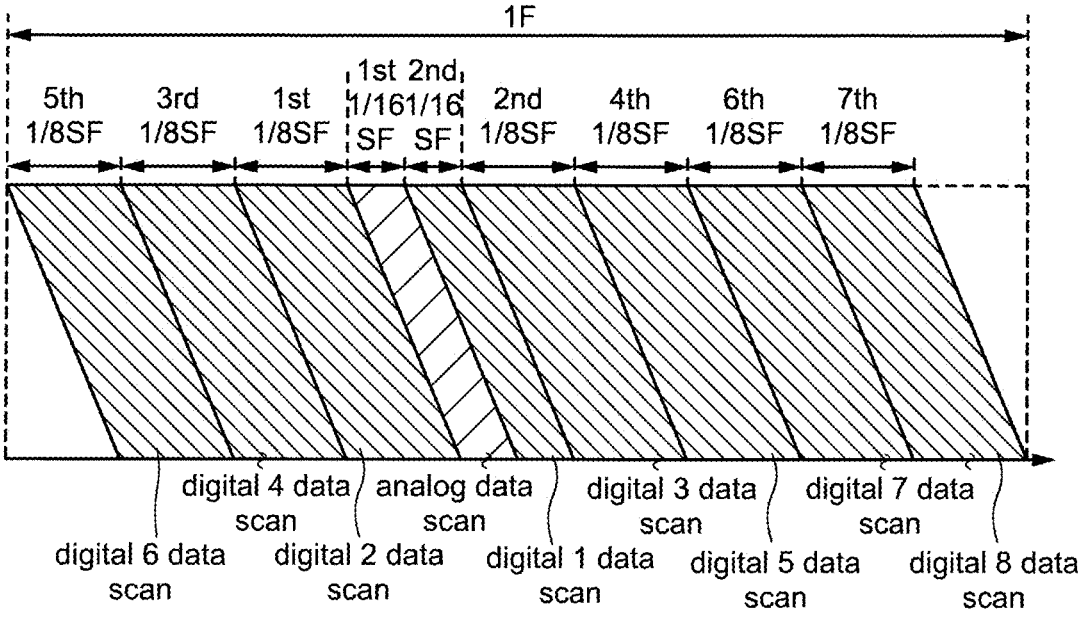
FIG. 30D is a diagram showing a gray-scale (16/16) when a light-emitting device according to an embodiment of the present invention is made to emit light or not to emit light.

As shown in FIGS. 30C and 30D, the eighth digital data scan period (8th digital data scan, digital 8 data scan, D8) in the seventh 1/8SF period is provided in a sub-frame period on the side opposite to the side where the analog data scan period is provided with respect to the seventh digital data scan period. The fifteenth step of 16 steps (fifteenth level, 15/16) is shown in FIG. 30C, similar to the configuration of the fifteenth level shown in FIG. 25C. The sixteenth step of 16 steps (sixteenth level, 16/16) is shown in FIG. 30D, similar to the configuration of the sixteenth step shown in FIG. 25D.

In the timing chart for explaining the driving method of the light-emitting device 10B shown in FIG. 26 and the diagrams showing gray-scales of the pixels according to an embodiment of the present invention and data corresponding to each gray-scale shown in FIGS. 31 to 34, the configuration, the driving method, and the like in each frame other than those described above are the same as the timing chart for explaining the driving method of the light-emitting device 10B shown in FIG. 20 and the gray-scales when the light-emitting device according to an embodiment of the present invention shown in FIGS. 22 to 25 is made to emit light or not to emit light, and therefore, detailed description thereof is omitted here.

The diagrams showing the gray-scales of the pixels according to an embodiment of the present invention and data corresponding to each gray-scale shown in FIGS. 31 to 34, as compared with the diagrams showing the gray-scales of the pixels according to an embodiment of the present invention and data corresponding to each gray-scale shown in FIGS. 6 to 9, the analog data scan is executed in the center sub-frame, the first digital data scan (1st digital data scan, digital 1 data scan, D1) is executed in a sub-frame to the right of the center with respect to the analogue data scan, the second digital data scan (2nd digital data scan, digital 2 data scan, D2) is executed in a sub-frame to the left of the center with respect to the analog data scan, the third digital data scan (3rd digital data scan, digital 3 data scan, D3) to the second digital data scan (6th digital data scan, digital 6 data scan, D6) are performed alternately, such as the sub-frame further to the right of the center with respect to the analog data scan, the sub-frame further to the left of the center with respect to the analog data scan, and the seventh digital data scan (7th digital data scan, digital 7 data scan, D7) is adjacent to the sub-frame performing the sixth digital data scan (6th digital data scan, digital 6 data scan, D6) and the seventh digital data scan is performed in the sub-frame further to the left of the center with respect to the analog data scan.

That is, as shown in FIGS. 31 to 34, the level of the gray-scale signal including analog data (Analog) is shown in the sixth column, the light emission (indicated by the symbol "O"), or non-light emission (indicated by the symbol "X") of the first control signal corresponding to each gray-scale level shown in the first column is shown in the seventh column. The first control signal is one of the time division gray-scale signals in the first digital data scan (D1). In the fifth column, the light emission (indicated by the symbol "O") or non-light emission (indicated by the symbol "X") of the second control signal corresponding to each gray-scale level shown in the first column is shown. The second control signal is one of the time division gray-scale signals in the second digital data scan (D2). In the eighth column, the light emission (indicated by the symbol "O") or non-light emission (indicated by the symbol "X") of the third control signal is shown. The third control signal is one of the time division gray-scale signals in the third digital data scan (D3). In the fourth column, the light emission (indicated by the symbol "O") or non-light emission (indicated by the symbol "X") of the fourth control signal is shown. The fourth control signal is one of the time division gray-scale signals in the fourth digital data scan (D4). In the ninth column, the light emission (indicated by the symbol "O") or non-light emission (indicated by the symbol "X") of the fifth control signal is shown. The fifth control signal is one of the time division gray-scale signals in the fifth digital data scan (D5). In the third column, the light emission (indicated by the symbol "O") or non-light emission (indicated by the symbol "X") of the sixth control signal is shown. The sixth control signal is one of the time division gray-scale signals in the sixth digital data scan (D6). In the tenth column, the light emission (indicated by the symbol "O") or non-light emission (indicated by the symbol "X") of the seventh control signal is shown. The seventh control signal is one of the time division gray-scale signals in the seventh digital data scan (D7). In the eleventh column, the emission (indicated by the symbol "O") or non-light emission (indicated by the symbol "X") of the eighth control signal is shown. The eighth control signal is one of the time division gray-scale signals in the eighth digital data scan (D8). In the diagrams showing the gray-scales of the pixels and the data corresponding to each gray-scale according to an embodiment of the present invention shown in FIG. 31 to FIG. 34, the configuration, the driving method, and the like other than those described above are the same as the diagrams showing the gray-scales of the pixels and the data corresponding to each gray-scale according to an embodiment of the present invention shown in FIG. 6 to FIG. 9, and therefore the description thereof is omitted here.

In the light-emitting device 10B and the driving method of the light-emitting device 10B according to an embodiment of the present invention, analog data scanning is performed in the center sub-frame, and digital data scanning is performed alternately in a sub-frame to the right and left of the center with respect to the analog data scanning, so that the sub-frame for performing the analog data scan can be further shifted to the center with respect to the position of the image on the retina of the human viewing the image associated with the light emission of the light-emitting element LED. As a result, by using the light-emitting device 10 and the driving method of the light-emitting device 10 according to an embodiment of the present invention, the false contour can be further alleviated, so that the deterioration of the image quality of the light-emitting device 10 can be further suppressed.

6. Sixth Embodiment

Figure 35:
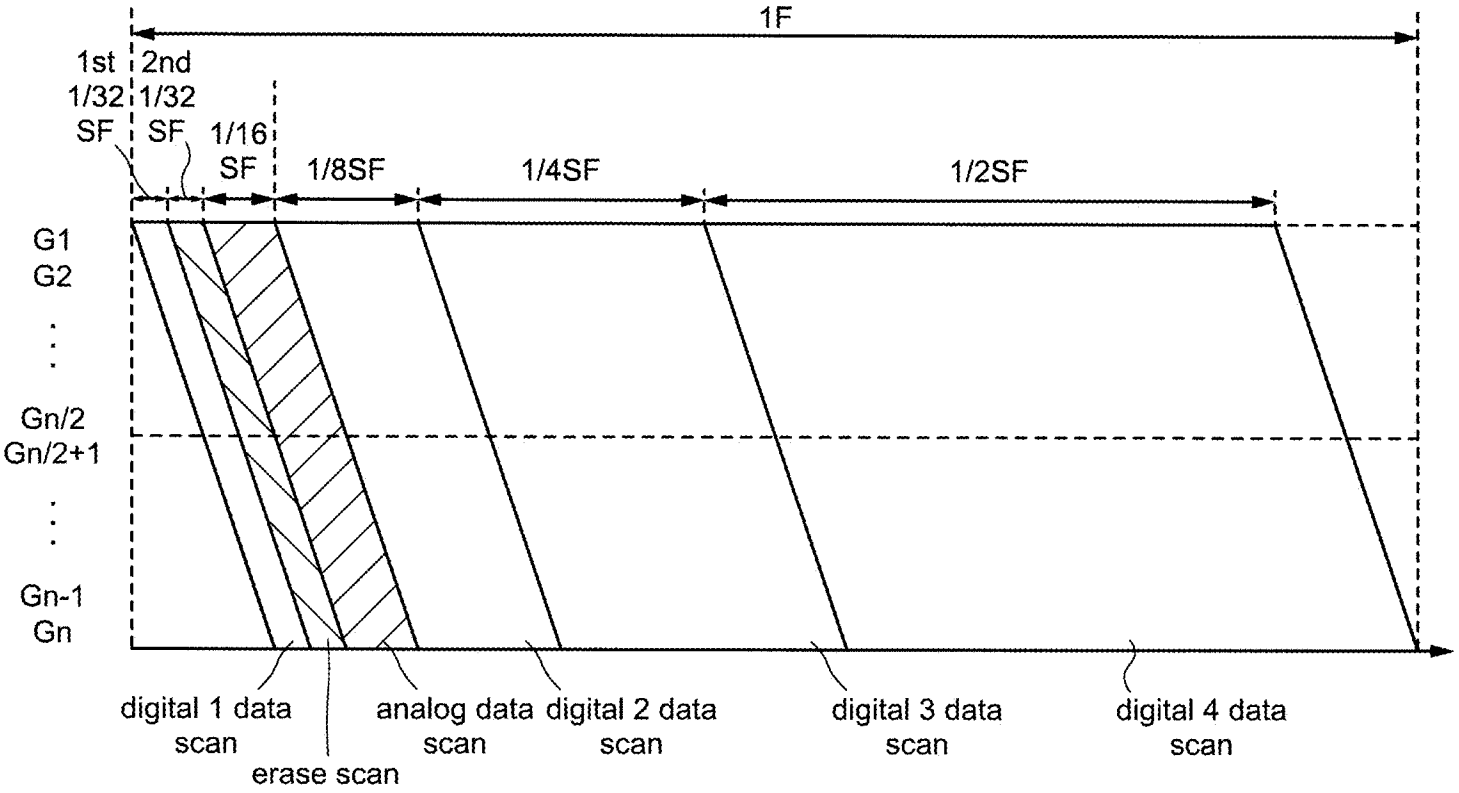
FIG. 35 is a timing chart for explaining a driving method of a light-emitting device according to an embodiment of the present invention.

FIG. 35 is a timing chart for explaining a driving method of the light-emitting device according to an embodiment of the present invention. FIGS. 36 to 39 are diagrams showing the gray-scales of the pixels according to an embodiment of the present invention and data corresponding to each gray-scale. The driving method and the like of the light-emitting device shown in FIGS. 35 to 39 are examples, and the driving method and the like of the light-emitting device are not limited to the configurations shown in FIGS. 35 to 39. Description of the same or similar components as those of the first to fifth embodiments is omitted here.

Since the configuration of the light-emitting device and the configuration of the pixel according to an embodiment of the present invention can be the same as those of the first embodiment, the description thereof is omitted here.

As shown in FIG. 35, in an embodiment of the present invention, one frame (1F) period is composed of six sub-frame (6SF) periods. 6SF is composed of two 1/32SF (first 1/32SF (1st1/32SF) and second 1/32SF (2nd1/32SF)) obtained by dividing the light-emitting period in the 1F period into 1/32, 1/16SF obtained by dividing the light-emitting period of the 1F period into 1/16, 1/8SF obtained by dividing the light-emitting period of the 1F period into 1/8, 1/4SF obtained by dividing the light-emitting period of the 1F period into 1/4, and 1/2SF obtained by dividing the light-emitting period of the 1F period into 1/2.

For example, in an embodiment of the present invention, the first scanning line G1 to the nth scanning line Gn are sequentially scanned in each SF. The pixel electrically connected to each scanning line receives the gray-scale signal, and the light-emitting element LED included in each pixel flows a current corresponding to the gray-scale signal. Consequently, the light-emitting element LED included in each pixel emits light with the emission intensity corresponding to the gray-scale signal. If the gray-scale signal corresponds to, for example, the reference voltage VSS or the common voltage VCOM, the light-emitting element LED included in each pixel does not flow a current and the light-emitting element LED does not emit light.

As shown in FIG. 35, in the driving method of the light-emitting device 10 according to an embodiment of the present invention, in the first 1/32SF period, the scan signal line drive circuit 110 scans each scanning line and the video signal line drive circuit 106 supplies the gray-scale signal including the first control signal to the pixels electrically connected to each scanning line. In the driving method of the light-emitting device 10 according to an embodiment of the present invention, the first 1/32SF period is a period for controlling the light emission or non-light emission in the 1/32SF period in the time division control method. The operation in the first 1/32SF period is referred to as, for example, the first digital data scan (1st digital data scan, digital 1 data scan, D1).

In the second 1/32SF period following the first 1/32SF period, the erasing signal line drive circuit 108 scans each erasing line, and the video signal line drive circuit 106 does not supply the gray-scale signal to the pixels electrically connected to each erasing line but supplies the drive voltage VDDH1 to the pixels electrically connected to each erasing line. Consequently, the erase transistor NEST (FIG. 4) turns off the drive transistor DRT (FIG. 4) and does not flow a current to the light-emitting element LED (FIG. 4), and the light-emitting element LED does not emit light. That is, in the second 1/32SF period, the display section 104 displays black. In the driving method of the light-emitting device 10 according to an embodiment of the present invention, the operation in the second 1/32SF period is referred to as, for example, erase scan.

For example, in the second 1/32SF period following the first 1/32SF period, when the analog data scan described later is performed, a period occurs in which the light emission or non-light emission in the first 1/32SF period and the light emission or non-light emission in the second 1/32SF period overlap. As a result, the light-emitting device cannot display an accurate image based on the gray-scale signal. The light-emitting device 10 according to an embodiment of the present invention may perform the erase scan in the second 1/32SF period following the first 1/32SF period, and then perform the analog data scan after performing the erase scan. As a result, the light-emitting device 10 according to an embodiment of the present invention can suppress the overlapping of the periods corresponding to the light emission or non-light emission, and can display an accurate image based on the gray-scale signal.

In the 1/16SF period following the second 1/32SF period, the scan signal line drive circuit 110 scans each scanning line and the video signal line drive circuit 106 supplies the gray-scale signal including analog data to the pixels electrically connected to each scanning line. In the driving method of the light-emitting device 10 according to an embodiment of the present invention, the operation in the 1/16SF period is a period for analog-controlling the light emission or non-light emission of the light-emitting element LED of the pixels electrically connected to each scanning line using analog data. The length of the 1/16SF period is twice the length of the first 1/32SF period and the length of the second 1/32SF period. In the driving method of the light-emitting device 10 according to an embodiment of the present invention, the operation of the 1/16SF period is referred to as, for example, the analog data scan (analog data scan).

In the 1/8SF period following the 1/16SF period, the scan signal line drive circuit 110 scans each scanning line and the video signal line drive circuit 106 supplies the gray-scale signal including the second control signal to the pixels electrically connected to each scanning line. In the driving method of the present light-emitting device 10 according to an embodiment of the present invention, the 1/8SF period is a period for controlling the light emission or non-light emission in the 1/8SF period in the time division control method. The length of the 1/8SF period is twice the length of the 1/16SF period. The operation in the 1/8SF period is referred to as, for example, the second digital data scan (2nd digital data scan, digital 2 data scan, D2).

In the 1/4SF period following the 1/8SF period, the scan signal line drive circuit 110 scans each scanning line and the video signal line drive circuit 106 supplies the gray-scale signal including the third control signal to the pixels electrically connected to each scanning line. In the driving method of the light-emitting device 10 according to an embodiment of the present invention, the 1/4SF period is a period for controlling the light emission or non-light emission in the 1/4SF period in the time division control method. The length of the 1/4SF period is twice the length of the 1/8SF period. The operation in the 1/4SF period is referred to as, for example, the third digital data scan (3rd digital data scan, digital 3 data scan, D3).

In the 1/2SF period following the 1/4SF period, the scan signal line drive circuit 110 scans each scanning line and the video signal line drive circuit 106 supplies the gray-scale signal including the fourth control signal to the pixels electrically connected to each scanning line. In the driving method of the light-emitting device 10 according to an embodiment of the present invention, the 1/2SF period is a period for controlling the light emission or non-light emission of the 1/2SF period in the time division control method. The length of the 1/2SF period is twice the length of the 1/4SF period. The operation in the 1/2SF period is referred to as, for example, the fourth digital data scan (4th digital data scan, digital 4 data scan, D4).

FIGS. 36 to 39 are diagrams showing the gray-scales of the pixels and data corresponding to each gray-scale according to an embodiment of the present invention. In the first column shown in FIGS. 35 to 39, the gray-scale level (Gray Level) of the gray-scale signal is indicated by 256 levels. In the second column, when the maximum value 255 of the gray-scale level (Gray Level) of the gray-scale signal shown in the first column is set to 1 of the emission intensity or luminance, the gamma value 2.2 (Gamma Value 2.2) is also set to 1, and the gray-scale level (Gray Level) of each gray-scale signal is indicated by the gamma value 2.2 (Gamma Value 2.2). That is, in the second column, the emission intensity or luminance is normalized, and the emission intensity or luminance normalized according to the gamma value 2.2 (Gamma Value 2.2) is shown.

In the third column, the light emission (indicated by the symbol "O") or non-light emission (indicated by the symbol "X") of the first control signal corresponding to each gray-scale level shown in the first column is shown. The first control signal is one of the time division gray-scale signals in the first digital data scan (D1). The first digital data scan is the operation for controlling the light emission and non-light emission in the 1/32SF period and includes the level of 4 bits (16 steps).

In the fifth column, the light emission (indicated by the symbol "O") or non-light emission (indicated by the symbol "X") of the second control signal corresponding to each gray-scale level shown in the first column is shown. The second control signal is one of the time division gray-scale signals in the second digital data scan (D2). The second digital data scan is the operation for controlling the light emission and non-light emission in the 1/8SF period and includes the level of 3 bits (8 steps).

In the sixth column, the light emission (indicated by the symbol "O") or non-light emission (indicated by the symbol "X") of the third control signal corresponding to each gray-scale level shown in the first column is shown. The third control signal is one of the time division gray-scale signals in the third digital data scan (D3). The third digital data scan is the operation for controlling the light emission and non-light emission in the 1/4SF period and includes the level of 2 bits (4 steps).

In the seventh column, the light emission (indicated by the symbol "O") or non-light emission (indicated by the symbol "X") of the fourth control signal corresponding to each gray-scale level shown in the first column is shown. The fourth control signal is one of the time division gray-scale signals in the fourth digital data scan (D4). The fourth digital data scan is the operation for controlling the light emission and non-light emission in the 1/2SF period and includes the level of 1 bit (2 steps).

In the fourth column, levels of the gray-scale signals including analogue data (Analog) are shown. The analogue data (Analog) includes data of 8 bits and 256 gray-scales (256 steps). For example, when the maximum value 255 of the gray-scale level (Gray Level) of the gray-scale signal is 1 of the gamma value 2.2 (Gamma Value 2.2), the emission intensity or luminance is 1. For example, the timing control circuit 30 generates a voltage or current corresponding to 1 of the emission intensity or luminance, and the generated voltage or current is set as the gray-scale signal in which the gray-scale level is 255 levels. Furthermore, the timing control circuit 30 may associate the video signal of each pixel with the gray-scale signal corresponding to the video signal of each pixel, and the storage device 20 may have the look-up table in which the video signal of each pixel and the gray-scale signal corresponding to the video signal of each pixel are linked. Although the analog data (Analog) is a gray-scale signal based on the gamma value 2.2, the analog data may be linear data of 256 gray-scales.

In an embodiment of the present invention, one gray-scale level is selected for at least one pixel electrically connected to one scanning line. For example, when the gray-scale level of 211 steps is selected for at least one pixel electrically connected to the first scanning line G1, in the analog data scanning in 1/16SF, the gray-scale signal corresponding to 0.547 is input to the at least one pixel, in the first digital data scan (D1) in 1/32SF, the first control signal corresponding to the non-light emission (indicated by the symbol "X") is input to the at least one pixel, in the second digital data scan (D2) in 1/8SF, the second control signal corresponding to the light emission (indicated by the symbol "O") is input to the at least one pixel, in the third digital data scan (D3) in 1/4SF, the third control signal corresponding to the non-emission (indicated by the symbol "X") is input to the pixels electrically connected to the first scanning line G1, and in the fourth digital data scan (D4) in 1/2SF, the fourth control signal corresponding to the light emission (indicated by the symbol "O") is input to the at least one pixel. Consequently, the light-emitting element LED of at least one pixel electrically connected to the first scanning line G1 emits light at the gray-scale level (0.6592) of 211 steps.

In the driving method of the light-emitting device 10 and the light-emitting device 10 according to an embodiment of the present invention, similar to the first embodiment, in one 1/16SF period in the 1F period, the analog data scanning is performed, and the light emission or non-light emission of the light-emitting element LED of the pixels electrically connected to each scanning line is analog-controlled using the analog data. In addition, in the light-emitting device 10 and the driving method of the light-emitting device 10, the first digital data scanning to fourth digital data scanning are performed, and the light emission or non-light emission of the light-emitting element LED of the pixels electrically connected to each scanning line can be digitally controlled using the time division control method. That is, in the light-emitting device 10 and the driving method of the light-emitting device 10 according to an embodiment of the present invention, similar to the first embodiment, the analog control and digital control can be used in combination. As a result, the light-emitting device 10 and the driving method of the light-emitting device 10 according to an embodiment of the present invention can exhibit the same effects and as those of the first embodiment.

7. Seventh Embodiment

<7-1. Overall Configuration of Lighting Device 15>

Figure 40:
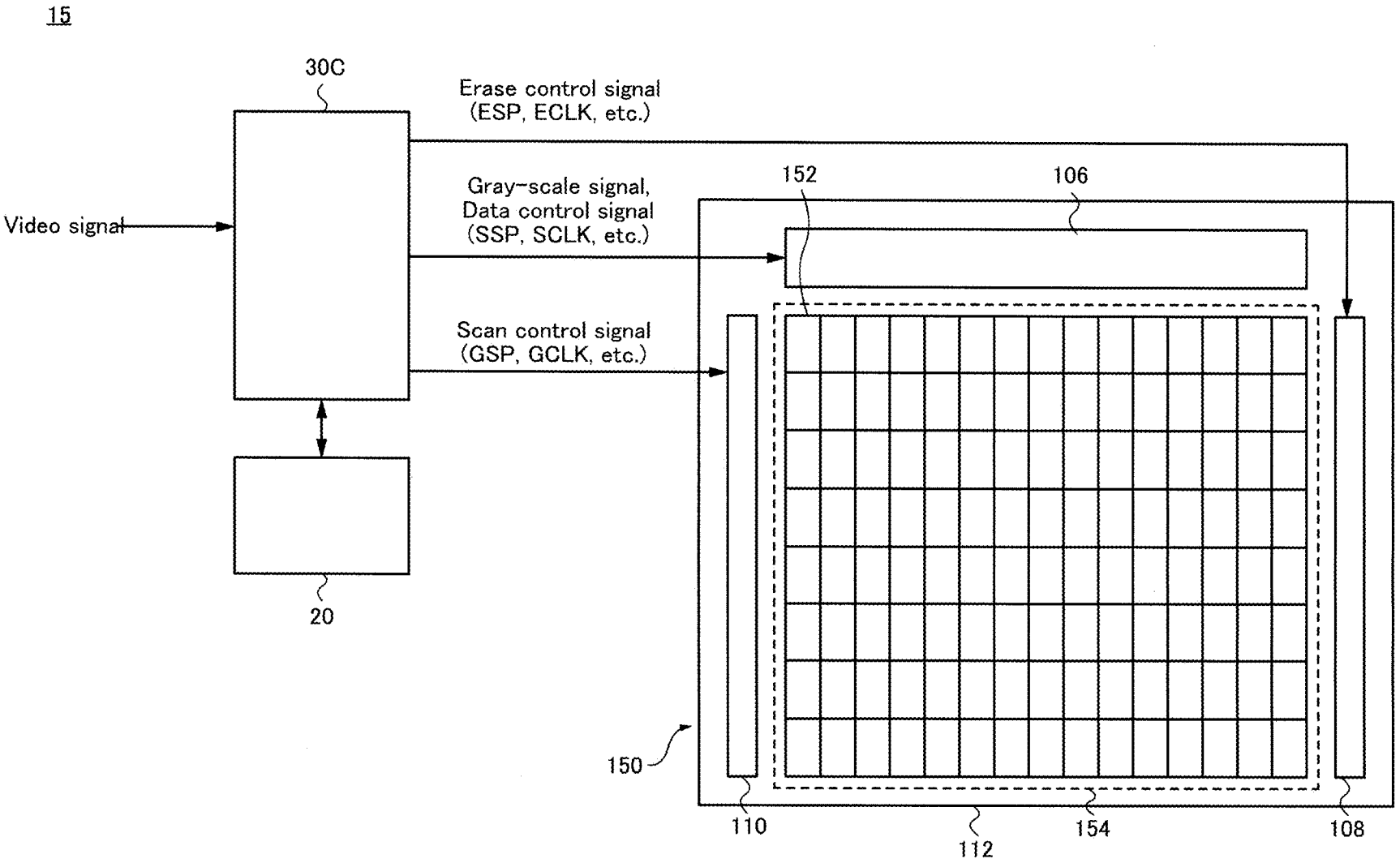
FIG. 40 is a schematic plan view showing a configuration of a light-emitting device according to an embodiment of the present invention.
Figure 41:
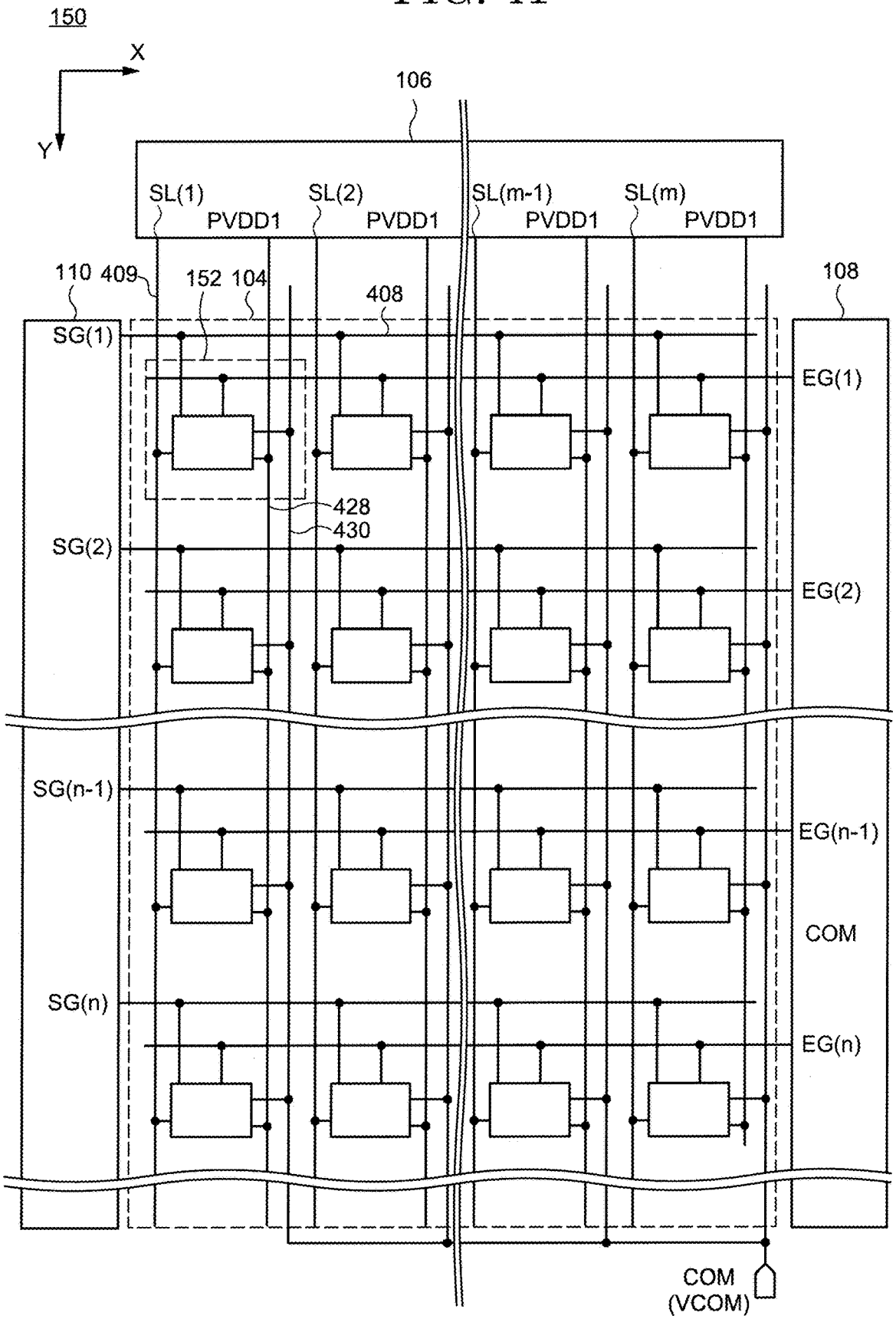
FIG. 41 is a schematic plan view showing a display panel included in a light-emitting device according to an embodiment of the present invention.

FIG. 40 and FIG. 41 are schematic plan views showing the configuration of a lighting device 15 according to an embodiment of the present invention. The configuration of the lighting device 15 shown in FIGS. 40 and 41 is an example, and the configuration of the lighting device 15 is not limited to the configuration shown in FIGS. 40 and 41. Description of the same or similar components as those of the first to sixth embodiments is omitted here. An embodiment of the present invention can be applied to, for example, a backlight.

As shown in FIG. 40, the lighting device 15 has the storage device 20, a timing control circuit 30C, and a light-emitting panel 150. The light-emitting panel 150 has a light-emitting section 154, the video signal line drive circuit 106, the erasing signal line drive circuit 108, the scan signal line drive circuit 110, and the substrate 112. The light-emitting section 154, the video signal line drive circuit 106, the erasing signal line drive circuit 108, and the scan signal line drive circuit 110 are provided on the top surface of the substrate 112. The storage device 20 and the timing control circuit 30C may be provided on the top surface of the substrate 112. The light-emitting section 154 has a plurality of pixels 152 for emitting a light-emitting device 100.

The plurality of pixels 152 is arranged in a matrix in the x-direction and the y-direction intersecting in the x-direction. The light-emitting device 10 according to an embodiment of the present invention can emit the light-emitting section 154 by driving the transistor and making the light-emitting element LED emit light or not to emit light. In an embodiment of the invention, for example, the x-direction is referred to as the first direction and the y-direction is referred to as the second direction. The emission intensity or luminance of the light-emitting element LED is controlled by the current flowing through the light-emitting element LED.

The timing control circuit 30C is supplied with the gray-scale signal from an external circuit (not shown), a timing signal for controlling the operation of the circuit, and the power supply voltage, and the like. The external circuit (not shown) supplies, for example, the drive voltage VDDH1 (FIG. 41), the common voltage VCOM (FIG. 41), and the reference voltage VSS (not shown) to the storage device 20, the timing control circuit 30C, and the light-emitting panel 150.

The timing control circuit 30C generates the data control signal, the scan control signal, and the erase control signal using, for example, the gray-scale signal, the timing signal for controlling the operation of the circuit, and the power supply voltage, and the like. The timing control circuit 30C may supply the drive voltage VDDH1, the common voltage VCOM, and the reference voltage VSS to the light-emitting panel 150, may generate a new voltage using the drive voltage VDDH1, the common voltage VCOM, and the reference voltage VSS, and may supply the generated new voltage to the light-emitting panel 150.

In the lighting device 15 according to an embodiment of the present invention shown in FIGS. 40 and 41, since the configuration, the signal, the driving method, and the like other than described above are the same as the configuration of the light-emitting device 10 shown in FIGS. 1 and 2, the same driving method and configuration as the light-emitting device 10 shown in FIGS. 1 and 2 can be used for the configuration, the signal, the driving method, and the like other than described above, as long as they do not contradict each other.

<7-2. Configuration of Pixel 152>

Figure 42:
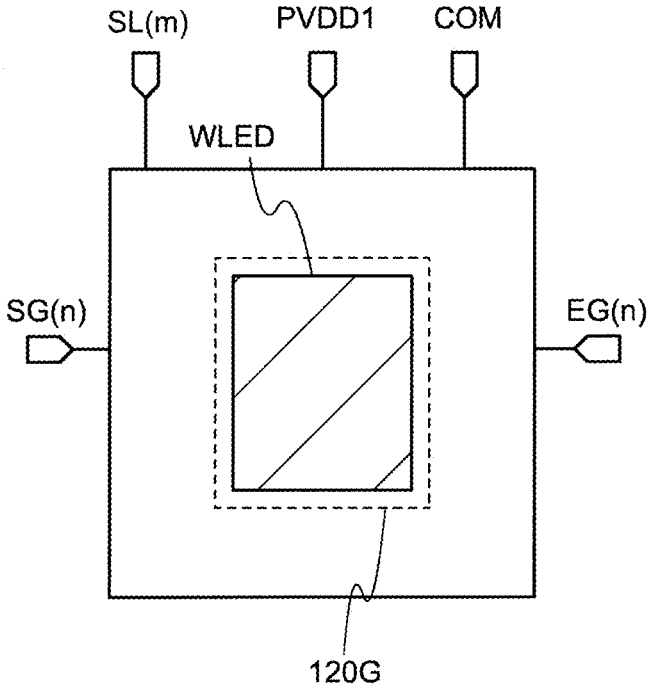
FIG. 42 is a schematic plan view showing a configuration of a pixel according to an embodiment of the present invention.

FIG. 42 is a plan view showing a configuration of the pixel 152 according to an embodiment of the present invention. The configuration of the pixel 152 shown in FIG. 42 is an example, and the configuration of the pixel 152 is not limited to the configuration shown in FIG. 42. Description of the same or similar components as those in FIGS. 1 to 41 is omitted here.

As shown in FIG. 42, the pixel 152 is composed of one pixel that does not include sub-pixels. The pixel 152 has a light-emitting element WLED. The light-emitting element WLED is a white light-emitting diode. The shape of the light-emitting element WLED is, for example, square. Each of the plurality of pixels 152 may use the light-emitting element drive section 440 shown in FIG. 4.

In the configuration of the pixel 152 according to an embodiment of the present invention shown in FIG. 42, the same configuration as that of sub-pixel shown in FIG. 3 can be used as long as the configurations other than those described above do not conflict with each other.

In the lighting device 15 and the driving method of the lighting device 15 according to an embodiment of the present invention, similar to the first embodiment, in one 1/16SF period in the 1F period, the analog data scan is performed, and the light emission or non-light emission of the light-emitting element of the pixels electrically connected to each scanning line is analog-controlled using the analog data. In addition, in the lighting device 15 and the driving method of the lighting device 15, the first digital data scan to fourth digital data scan are performed, and the light emission or non-light emission of the light-emitting element of the pixels electrically connected to each scanning line can be digitally controlled using the time division control method. That is, in the lighting device 15 and the driving method of the lighting device 15 according to an embodiment of the present invention, the analog control and digital control (the time division control method) can be used in conjunction as in the first embodiment. As a result, by using the lighting device 15 and the driving method of the lighting device 15 according to an embodiment of the present invention, the lighting device 15 can smoothly and stably emit low gray-scales, and can stably emit light in steps.

Each of the embodiments described above as an embodiment of the present invention can be appropriately combined and implemented as long as they do not contradict each other.

Even if it is another working effect which is different from the working effect brought about by the mode of each above-mentioned embodiment, what is clear from the description in this description, or what can be easily predicted by the person skilled in the art is naturally understood to be brought about by the present invention.

What is claimed is:

1. A driving method of a light emitting device,
the light emitting device comprising:
a plurality of pixels;
dividing a frame period for displaying an image of one frame into a plurality of sub-frame periods; and
displaying gray-scales in each of the plurality of sub-frame periods;
the driving method comprising:
writing analog gray-scale data to the plurality of pixels to display analog gray-scales in one sub-frame period of the plurality of sub-frame periods; and
writing first digital gray-scale data to the plurality of pixels to display first digital gray-scales in a sub-frame period of the same length as the one sub-frame period, and in a sub-frame period different from the one sub-frame period.

2. The driving method according to claim 1, further comprising:
erasing the analog gray-scale data written to the plurality of pixels in a period of the same length as the one sub-frame period after displaying the analog gray-scales; and wherein
the one sub-frame period is 1/16 of a light-emitting period of the one frame period.

3. The driving method according to claim 1, further comprising:
displaying the first digital gray-scales after displaying the analog gray-scales; and
writing second digital gray-scale data to the plurality of pixels to display second digital gray-scales in a sub-frame period twice as long as the one sub-frame period after displaying the first digital gray-scales.

4. The driving method according to claim 1, further comprising:
displaying the first digital gray-scales before displaying the analog gray-scales; and
erasing the first digital gray-scale data written to the plurality of pixels in the sub-frame period of the same length as the one sub-frame period in a sub-frame period between the sub-frame period of displaying the first digital gray-scales and the sub-frame period of displaying the analog gray-scales.

5. The driving method according to claim 1, further comprising:
displaying the first digital gray-scales after erasing the analog gray-scale data; and
erasing the first digital gray-scale data written to the plurality of pixels in the sub-frame period of the same length as the one sub-frame period after displaying the first digital gray-scales.

6. The driving method according to claim 5, further comprising:
writing second digital gray-scale data to the plurality of pixels to display second digital gray-scales in a sub-frame period twice as long as the one sub-frame period after erasing the first digital gray-scales.

7. The driving method according to claim 1, further comprising:
alternately displaying the analog gray-scales and displaying the first digital gray-scales; and wherein
the one sub-frame period is 1/16 of a light-emitting period of the one frame period.

8. The driving method according to claim 1, further comprising:
displaying the first digital gray-scales before displaying the analog gray-scales; and
writing second digital gray-scale data to the plurality of pixels to display second digital gray-scales in a sub-frame period twice as long as the one sub-frame period after displaying the analog gray-scales;

wherein a light-emitting intensity of the plurality of pixels in displaying the first digital gray-scales is half of a light-emitting intensity of the plurality of pixels in displaying the second digital gray-scales display, and a light-emitting intensity of the plurality of pixels in displaying the analog gray-scales is half of a light-emitting intensity of the plurality of pixels in displaying the second digital gray-scales display.

9. The driving method according to claim 8, wherein the one sub-frame period is 1/8 of a light-emitting period of the one frame period.

10. The driving method according to claim 1, wherein the analog gray-scale data is any one of 256 gray-scale data.

11. A light emitting device comprising:

a plurality of pixels each provided with a light emitting element;

a frame memory for storing analog gray-scale data and first digital gray-scale data; and a control section writing the analog gray-scale data to any one pixel of the plurality of pixels upon receiving an input of the analog gray-scale data from the frame memory, and writing the first digital gray-scale data to any one pixel upon receiving an input of the first digital gray-scale data from the frame memory; wherein the control section divides a frame period for displaying an image of one frame into a plurality of sub-frame periods, one of the plurality of sub-frame periods is the period of a displaying an analog gray-scale in which the plurality of pixels is written with the analog gray-scale data by the control section, and a sub-frame period different from the one sub-frame period is a period of the same length period as the one sub-frame period and is the period of a displaying the first digital gray-scales in which the plurality of pixels is written with the first digital gray-scale data by the control section.

12. The light emitting device according to claim 11, wherein each of the plurality of sub-frame periods is a period of the same length as the one sub-frame period, and further includes a period of erasing the analog gray-scale data in which the plurality of pixels is written with the analog gray-scale data by the control section, the period of erasing the analog gray-scale data is set after the period of displaying the analog gray-scales, and the one sub-frame period is 1/16 of the light emitting period of the one frame period.

13. The light emitting device according to claim 11, wherein each of the plurality of sub-frame periods is twice as long as the one sub-frame period and further includes a period of displaying second digital gray-scales in which the plurality of pixels is written with the second digital gray-scale data by the control section, the period of displaying the first digital gray-scales is set after the period of displaying the analog gray-scales, and the period of displaying the second digital data is set after the period of displaying the first digital gray-scales.

14. The light emitting device according to claim 11, wherein each of the plurality of sub-frame periods is a period of the same length as said one sub-frame period and further includes a period of displaying second digital gray-scales in which the plurality of pixels is written with the second digital gray-scale data by the control section, the period of displaying the first digital gray-scales is set after the period of displaying the analog gray-scales, and the period of erasing the first digital data is set between the period of displaying the analog gray-scales and the period of displaying the first digital gray-scales.

15. The light emitting device according to claim 11, wherein each of the plurality of sub-frame periods is a period of the same length as said one sub-frame period and further includes a period of displaying second digital gray-scales in which the plurality of pixels is written with the second digital gray-scale data by the control section, the period of displaying the first digital gray-scales is set after the period of erasing the analog gray-scale data, and the period of erasing the first digital data is set after the period of displaying the first digital gray-scales.

16. The light emitting device according to claim 15, wherein each of the plurality of sub-frame periods is twice as long as the one sub-frame period and further includes a period of displaying second digital gray-scales in which the plurality of pixels is written with the second digital gray-scale data by the control section, and the period of displaying the second digital gray-scales is set after the period of erasing the first digital gray-scale data.

17. The light emitting device according to claim 11, wherein the control section performs alternately the period of displaying the analog gray-scales and the period of displaying the first digital gray-scales, and the one sub-frame period is 1/16 of a light-emitting period of the one frame period.

18. The light emitting device according to claim 11, wherein each of the plurality of sub-frame periods is twice as long as the one sub-frame period and further includes a period of displaying second digital gray-scales in which the plurality of pixels is written with the second digital gray-scale data by the control section, the period of displaying the first digital gray-scales is set before the period of displaying the analog gray-scales, a light-emitting intensity of each light emitting element of the plurality of pixels in displaying the first digital gray-scales is half of a light-emitting intensity of each light emitting element of the plurality of pixels in displaying the second digital gray-scales display, and a light-emitting intensity of each light emitting element of the plurality of pixels in displaying the analog gray-scales is half of a light-emitting intensity of each light emitting element of the plurality of pixels in displaying the second digital gray-scales display.

19. The light emitting device according to claim 18, wherein the one sub-frame period is 1/8 of a light-emitting period of the one frame period.

20. The light emitting device according to claim 11, wherein the analog gray-scale data is any one of 256 gray-scale data.

* * * * *